US010272290B2

(12) United States Patent
Yeh

(10) Patent No.: US 10,272,290 B2
(45) Date of Patent: Apr. 30, 2019

(54) EXERCISE APPARATUS

(71) Applicant: PREVENTIVE MEDICAL HEALTH CARE CO., LTD., Taichung (TW)

(72) Inventor: Ching-Yu Yeh, Taichung (TW)

(73) Assignee: PREVENTIVE MEDICAL HEALTH CARE CO., LTD., Taichung (TW)

( * ) Notice: Subject to any disclaimer, the term of this patent is extended or adjusted under 35 U.S.C. 154(b) by 70 days.

(21) Appl. No.: 15/715,180

(22) Filed: Sep. 26, 2017

(65) Prior Publication Data

US 2018/0015324 A1 Jan. 18, 2018

Related U.S. Application Data

(63) Continuation-in-part of application No. 14/834,370, filed on Aug. 24, 2015, now Pat. No. 9,802,078, (Continued)

(30) Foreign Application Priority Data

Mar. 18, 2013 (TW) ..... 102204977 U
Sep. 19, 2017 (CN) ..... 2017 1 0847142

(51) Int. Cl.
*A63B 21/00* (2006.01)
*A63B 21/22* (2006.01)
(Continued)

(52) U.S. Cl.
CPC ..... *A63B 23/0417* (2013.01); *A63B 21/0051* (2013.01); *A63B 21/00192* (2013.01); *A63B 22/001* (2013.01); *A63B 22/0012* (2013.01); *A63B 22/0017* (2015.10); *A63B 22/0056* (2013.01); *A63B 22/06* (2013.01); *A63B 22/0605* (2013.01); *A63B 22/201* (2013.01); *A63B 21/225* (2013.01); *A63B 2022/0038* (2013.01); *A63B 2022/0041* (2013.01); (Continued)

(58) Field of Classification Search
CPC ..... A63B 21/00192; A63B 21/225; A63B 22/001; A63B 22/0012; A63B 22/0056; A63B 22/06; A63B 22/0605; A63B 22/0664; A63B 23/02; A63B 23/0205; A63B 23/0216; A63B 23/0222; A63B 23/0227; A63B 2022/0017; A63B 2022/0041; A63B 2022/0051; A63B 2022/0688; A63B 2022/0038; A63B 2022/0611; A63B 2022/0635; A63B 2208/0204; A63B 2208/0233
USPC ..... 482/51–53, 57–65
See application file for complete search history.

(56) References Cited

U.S. PATENT DOCUMENTS 3,759,511 A * 9/1973 Zinkin ..... A63B 21/015 297/423.1
4,550,908 A * 11/1985 Dixon ..... A63B 21/00181 482/111
5,836,855 A * 11/1998 Eschenbach ..... A63B 22/001 482/57

* cited by examiner

*Primary Examiner* — Garrett K Atkinson
(74) *Attorney, Agent, or Firm* — CKC & Partners Co., LLC

(57) ABSTRACT

An exercise apparatus includes a frame body, two driving levers, two pedals, a linking device and at least one resistance device. The driving levers are pivotally connected to two side frames of the frame body, respectively. The pedals are connected to the two driving levers, respectively. The linking device is connected the driving levers so as to lead the driving levers to be swung reciprocally and simultaneously. The resistance device is driven by one of the driving levers so as to generate a magnetic resistance.

11 Claims, 54 Drawing Sheets

Related U.S. Application Data which is a continuation of application No. 14/185,936, filed on Feb. 21, 2014, now Pat. No. 9,155,933.

(60) Provisional application No. 61/879,151, filed on Sep. 18, 2013, provisional application No. 62/445,217, filed on Jan. 11, 2017.

(51) Int. Cl.

| | |
|---|---|
| ***A63B 22/00*** | (2006.01) |
| ***A63B 22/06*** | (2006.01) |
| ***A63B 22/20*** | (2006.01) |
| ***A63B 23/04*** | (2006.01) |
| ***A63B 21/005*** | (2006.01) |

(52) U.S. Cl.

CPC ..... *A63B 2022/0051* (2013.01); *A63B 2022/0688* (2013.01); *A63B 2022/206* (2013.01); *A63B 2208/0204* (2013.01); *A63B 2208/0233* (2013.01)

EXERCISE APPARATUS

RELATED APPLICATIONS

This application is a Continuation-in-part of U.S. application Ser. No. 14/834,370, filed on Aug. 24, 2015, which is a continuation of the application Ser. No. 14/185,936, filed Feb. 21, 2014, the entire contents of which are hereby incorporated herein by reference, which claims priority to Taiwan Application Serial Number 102204977, filed Mar. 18, 2013, and U.S. Provisional Patent Application No. 61/879,151, filed Sep. 18, 2013, which are herein incorporated by reference. Further, this application claims priority to U.S. Provisional Application Ser. No. 62/445,217 filed Jan. 11, 2017, and China Application Serial Number 201710847142.5, filed Sep. 19, 2017, which are herein incorporated by reference.

BACKGROUND

Technical Field

The present disclosure relates to an exercise apparatus.

Description of Related Art

Exercise apparatuses make raining day and limited ground no longer be problems of doing exercise. Therefore, exercise apparatuses are main priority for modern people who are always busy but want to keep in shape. It is well-known that walking and running are body exercise which not only can burn calories and firm muscles but also can enhance myocardial function and increase lung capacity. Accordingly, treadmills, steppers, and elliptical trainers are most common exercise apparatus compared to others on the present market. However, users barely lift their knees high when using those exercise apparatus and improvements of muscle strength and body shape are mostly concentrated on their calf only.

High knees exercise is usually taken as a component of warm-up exercise to get heart rate going and also can burn calories and firm muscles as walking and running. This exaggerated knee motion further provides an excellent workout for the knees, hips, lower body, lower abdomen, and lower back and can enhance body strength, speed, balance, and flexibility. But, no apparatus for executing high knees exercise has been developed nowadays.

SUMMARY

According to one aspect of the present disclosure, an exercise apparatus includes a frame body, two driving levers, two pedals, a linking device and at least one resistance device. The frame body includes a bottom base and two side frames connected to the bottom base. The two driving levers are pivotally connected to the two side frames, respectively, wherein each of the driving levers is pivotally connected to each of the two side frames via a pivoting axle. The two pedals are connected to the two driving levers, respectively. The linking device is connected the two driving levers so as to lead the two driving levers to be swung reciprocally and simultaneously. The resistance device is driven by one of the two driving levers so as to generate a magnetic resistance. The resistance device includes a magnet base, a first magnetic resistance element and a second magnetic resistance element. The magnet base is connected to the one of the two driving levers. The first magnetic resistance element is disposed on the magnet base. The second magnetic resistance element is disposed on the frame body and adjacent to the first magnetic resistance element, wherein at least one of the first magnetic resistance element and the second magnetic resistance element is at least one magnet, and the other one of the first magnetic resistance element and the second magnetic resistance element is made of copper, silver, aluminum or alloys thereof, the magnet base is driven by the driving lever so as to move the first magnetic resistance element relative to the second magnetic resistance element for generating the magnetic resistance. When a central distance between the pivoting axle of each of the driving lever and the pedal connected the driving lever is R, and a central distance between the pivoting axle of the driving lever which is connected to the magnet base and the resistance device is r, the following relationship is satisfied:

$$r \geq 0.5\ R.$$

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
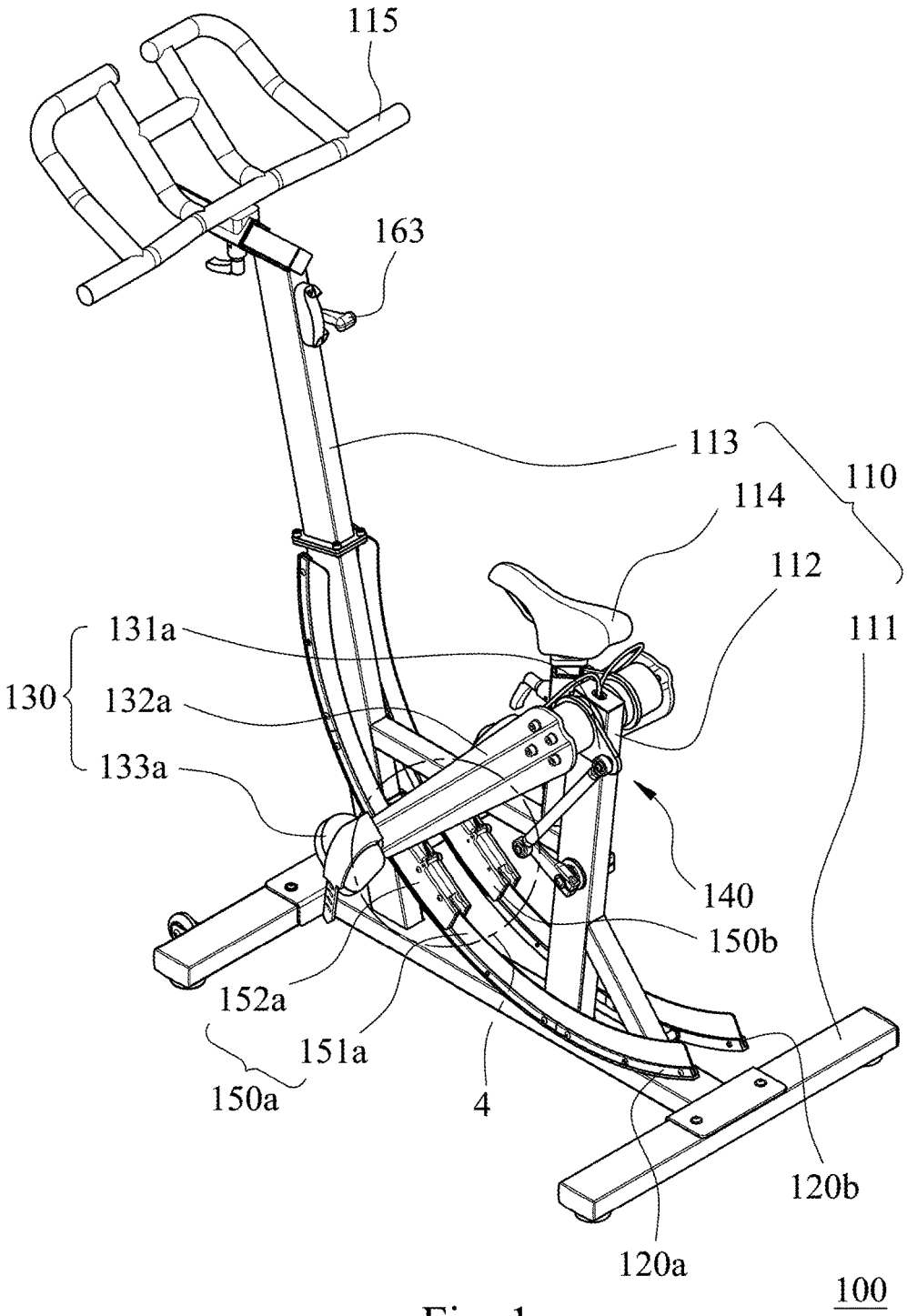
FIG. 1 shows a three dimensional view of a high knees exercise apparatus according to one embodiment of the present disclosure.

FIG. 1 shows a three dimensional view of a high knees exercise apparatus 100 according to one embodiment of the present disclosure. In FIG. 1, the high knees exercise apparatus 100 includes a base 110, two slide rails 120*a*, 120*b*, a driving member 130, a linkage mechanism 140 and two magnetic resistance devices 150*a*, 150*b*.

In detail, the base 110 includes a bottom base 111, a first supporting base 112, a second supporting base 113 and a seat base 114. The first supporting base 112 and the second supporting base 113 are disposed on the bottom base 111. That is, one end of each of the first supporting base 112 and the second supporting base 113 is connected to the bottom base 111. The seat base 114 is disposed on the other end of the first supporting base 112. The user sits on the seat base 114 and faces the second supporting base 113 during using the high knees exercise apparatus 100. Moreover, the base 110 can further includes a handle 115 connected to the second supporting base 113.

The slide rails 120*a*, 120*b* are disposed on the bottom base 111 of the base 110 and located on two sides of each of the first supporting base 112 and the second supporting base 113 respectively. Each of the slide rails 120*a*, 120*b* is arc-shaped which extend from the second supporting base 113 to the first supporting base 112.

The driving mechanism 130 includes two pivot members 131*a*, 131*b*, two driving members 132*a*, 132*b* and two pedals 133*a*, 133*b* (131*b*, 132*b* and 133*b* are not shown in FIG. 1). The two pivot members 131*a*, 131*b* are symmetrically and pivotally connected to two sides of the first supporting base 112 respectively. In each of the driving members 132*a*, 132*b*, one end of the driving member 132*a* is connected to the pivoting member 131*a*, the other end of the driving member 132*a* is slidably connected to the slide rail 120*a*. Therefore, the driving member 132*a* can be driven for swinging along the arc-shaped of the slide rail 120*a*. The pedal 133*a* is connected to the driving members 132*a*. (The relationships among 120*b*, 131*b*, 132*b* and 133*b* are the same with the relationships among 131*a*, 132*a* and 133*a*, and will not describe herein.)

Figure 2:
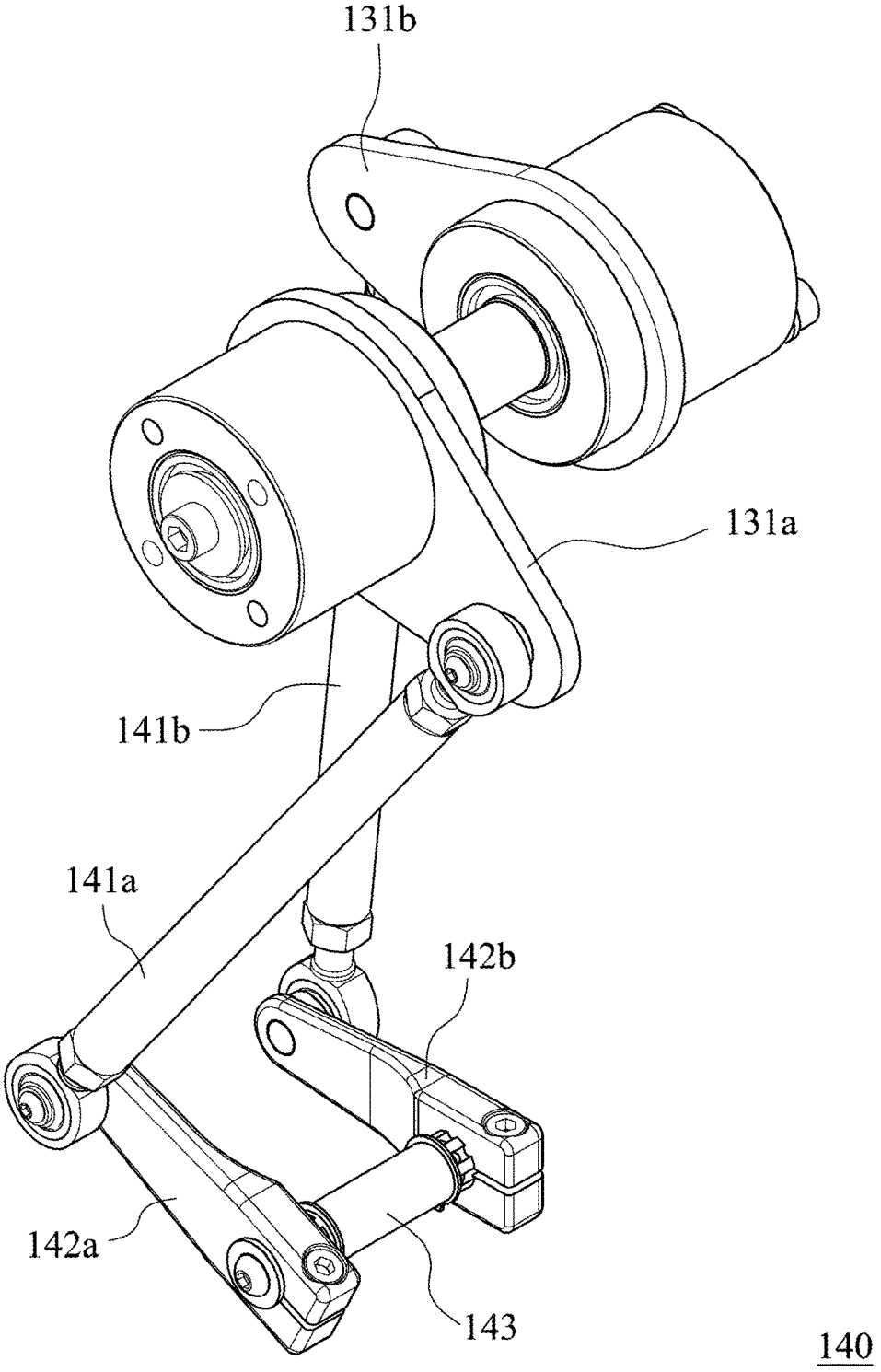
FIG. 2 shows a schematic view of the linkage mechanism of FIG. 1.

The linkage mechanism 140 is linked up with the pivoting members 131*a*, 131*b* for leading the driving members 132*a*, 132*b* slid reversely in response to each other. FIG. 2 shows a schematic view of the linkage mechanism 140 of FIG. 1. In FIG. 2, the linkage mechanism 140 includes two first linkage rods 141*a*, 141*b*, two second linkage rods 142*a*, 142*b* and a rotatable axis 143. One end of each of the first linkage rods 141*a*, 141*b* is connected to each of the pivoting members 131*a*, 131*b*, so that the first linkage rods 141*a*, 141*b* are linked up with the pivoting members 131*a*, 131*b* respectively. One end of each of the second linkage rods 142*a*, 142*b* is pivotally connected to the other end of each of the first linkage rods 141*a*, 141*b*. The rotatable axis 143 pivotally connects the other ends of the two second linkage rods 142*a*, 142*b* to the first supporting base 112. By such arrangement, when the driving members 132*a*, 132*b* are driven, the linkage mechanism 140 can be linked up via the pivoting members 131*a*, 131*b*, and the linkage mechanism 140 leads the two driving members 132*a*, 132*b* slid reversely in response to each other.

Figure 3A:
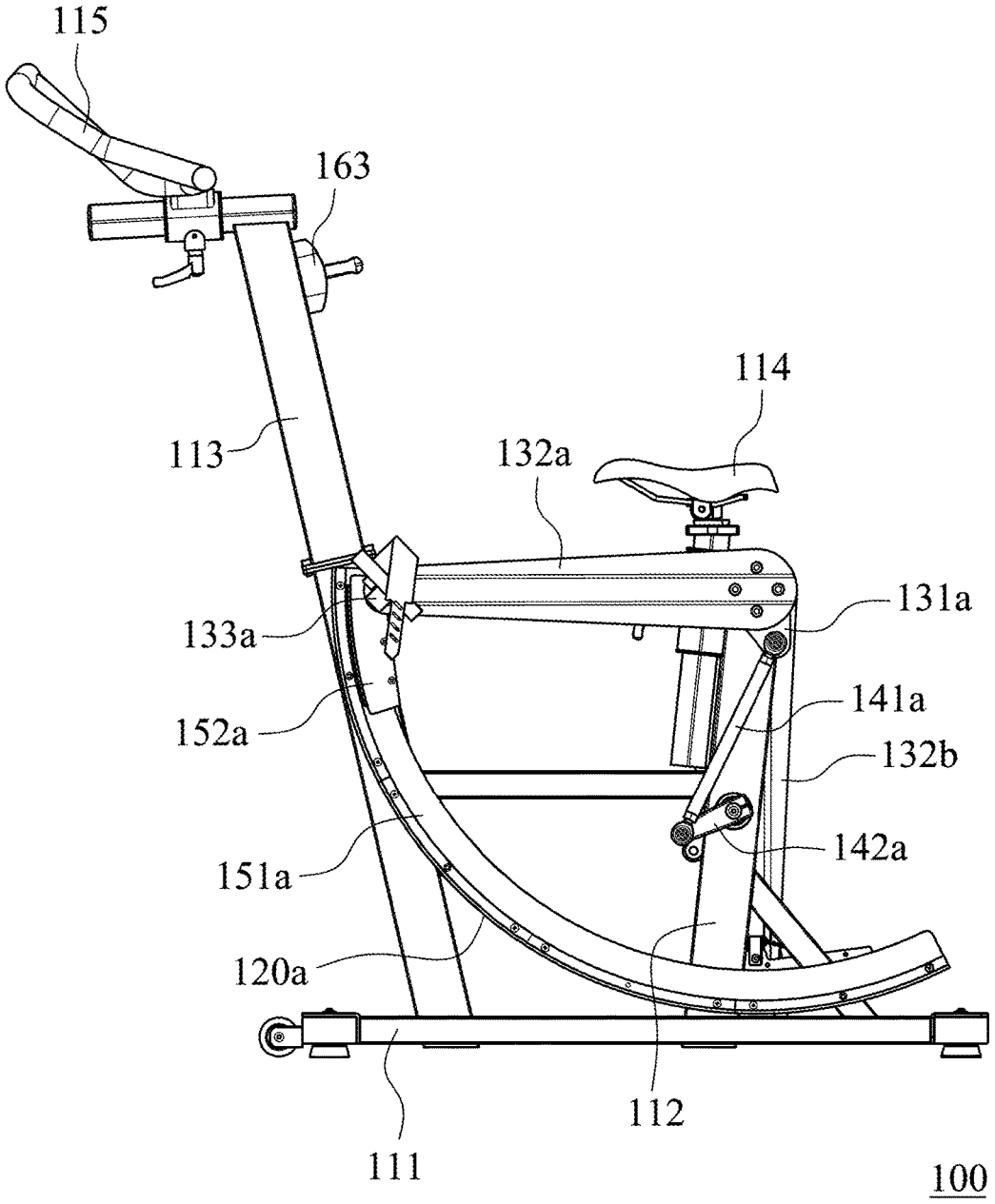
FIG. 3A shows a schematic view of one using state of the high knees exercise apparatus of FIG. 1.
Figure 3B:
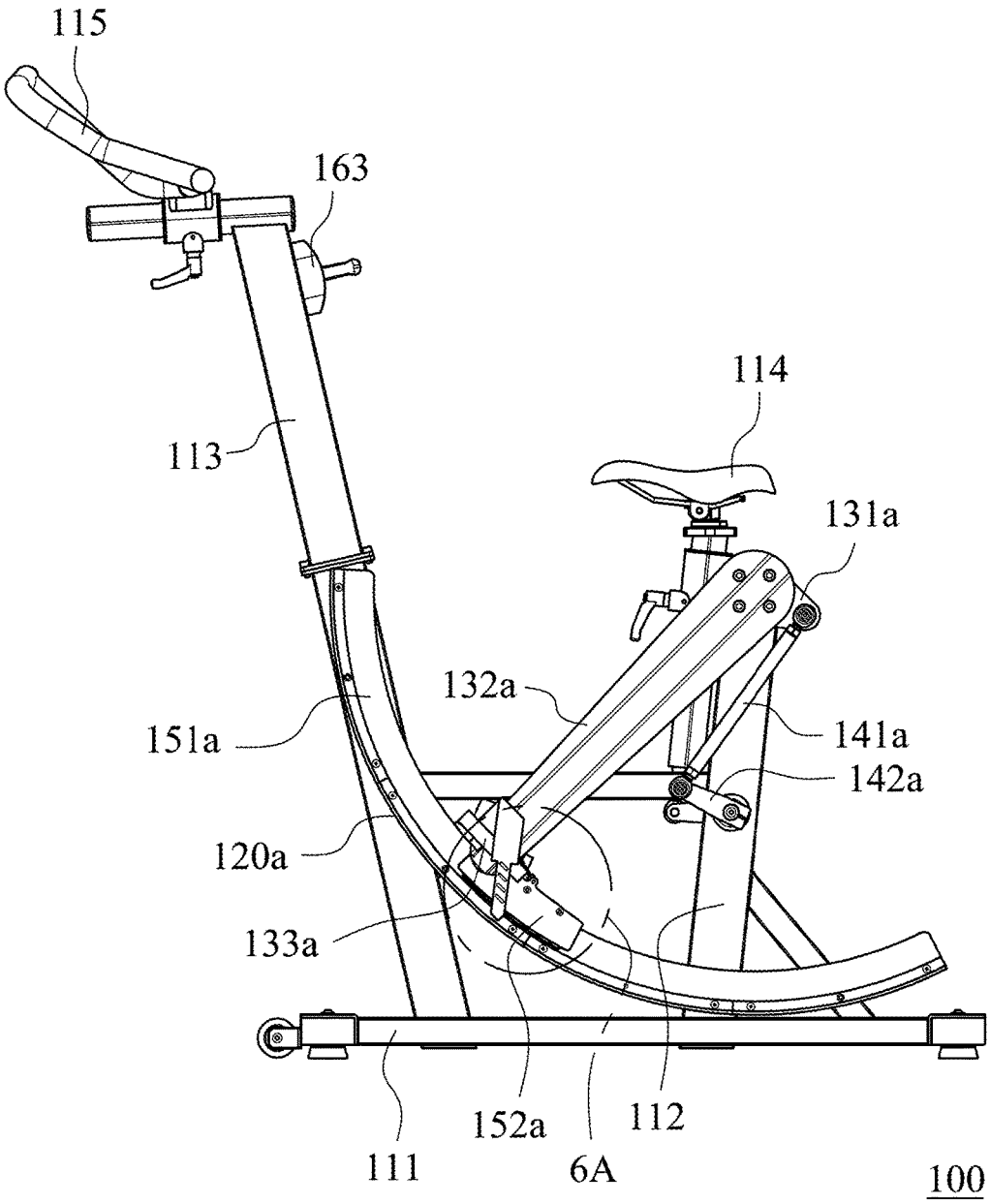
FIG. 3B shows a schematic view of another using state of the high knees exercise apparatus of FIG. 1.
Figure 3C:
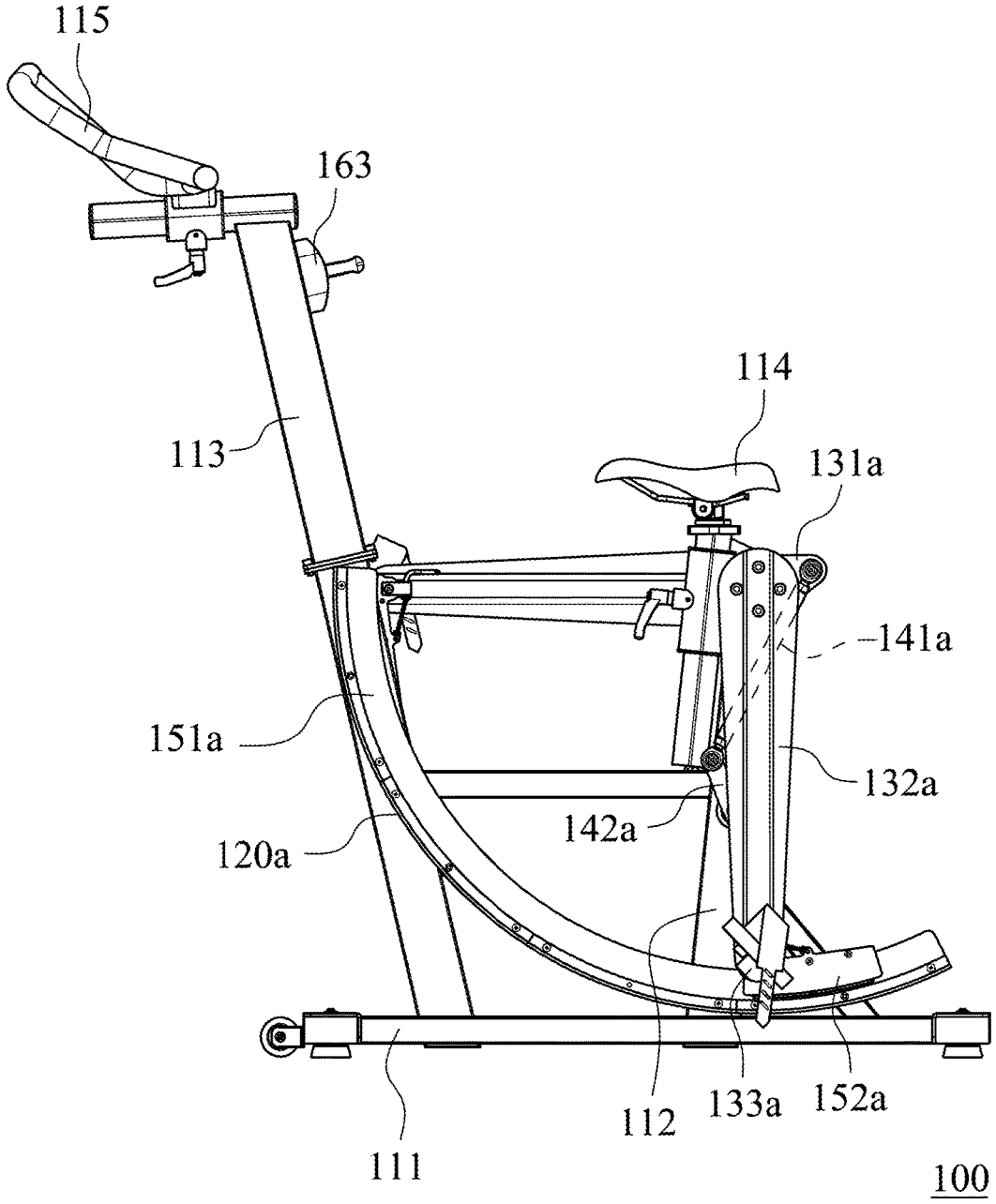
FIG. 3C shows a schematic view of yet another using state of the high knees exercise apparatus of FIG. 1.

FIGS. 3A, 3B and 3C show schematic views of three using states of the high knees exercise apparatus 100 of FIG. 1. In FIG. 3A, when one driving member 132*a* is slid from the first supporting base 112 to the second supporting base 113 along the slide rail 120*a* and is parallel to the ground which is the highest position of the driving member 132*a*, the other driving member 132*b* is perpendicular to the ground. In FIG. 3B, when the driving member 132*a* is slid from the second supporting base 113 to the first supporting base 112, the driving member 132*b* is moved from the first supporting base 112 to the second supporting base 113 along the slide rail 120*b* (In FIG. 3B, the driving member 132*b* just covered by the first supporting base 112). In FIG. 3C, when the driving member 132*a* is perpendicular to the ground, the driving member 132*b* is slid to the end of the slide rail 120*b* and is parallel to the ground. Therefore, the slide direction of the driving member 132*a*, 132*b* can be controlled by the linkage mechanism 140, so that the two driving member 132*a*, 132*b* slid reversely in response to each other.

Figure 4:
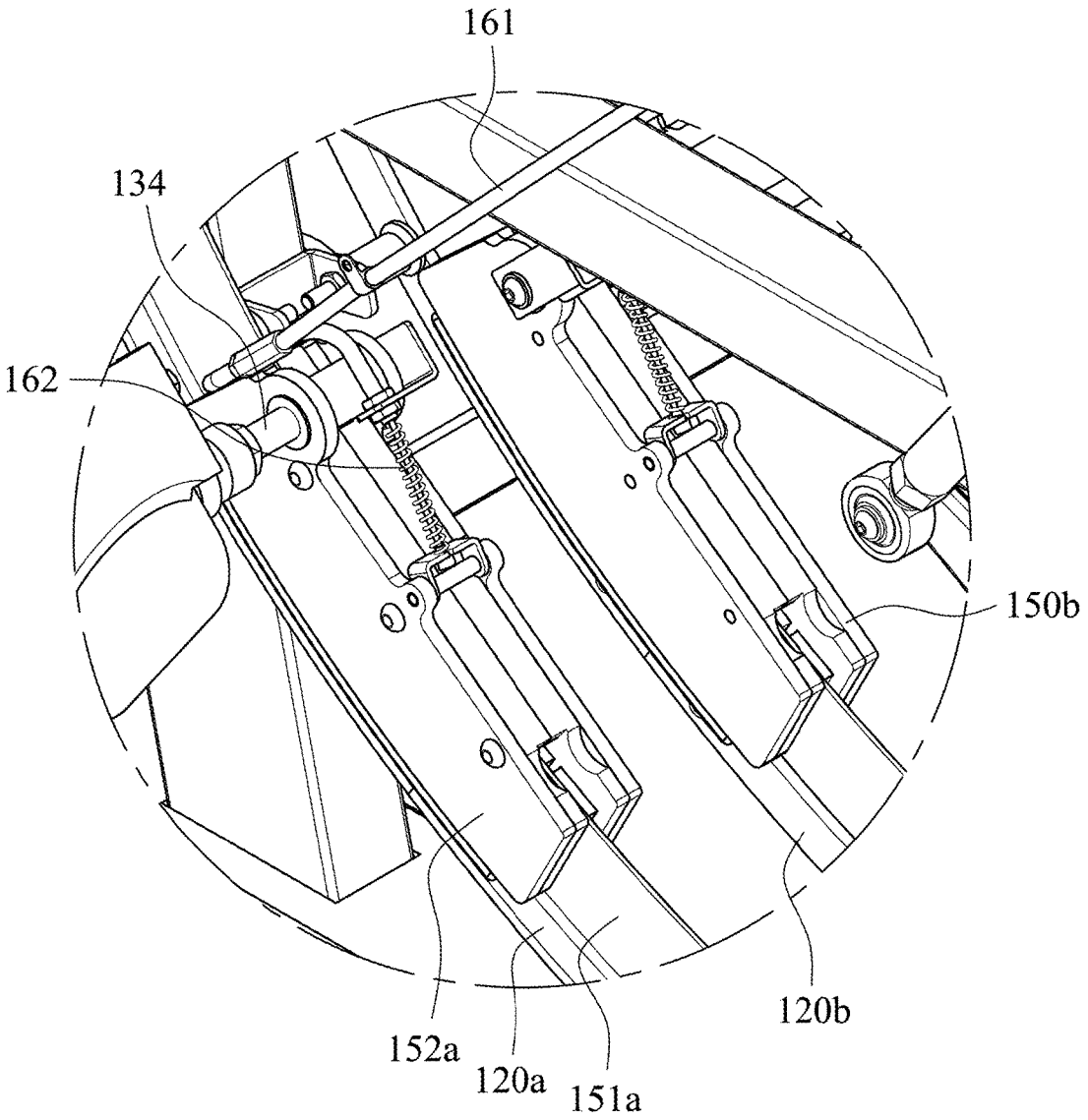
FIG. 4 is an enlarged view of magnetic resistance devices of FIG. 1.

FIG. 4 is an enlarged view of magnetic resistance devices 150*a*, 150*b* of FIG. 1. The two magnetic resistance devices 150*a*, 150*b* are the same, thus, only one magnetic resistance device 150*a* is described and labeled in FIG. 4. The magnetic resistance device 150*a* includes a conductive member 151*a*, a magnet base 152*a* and at least one magnet 153*a* (shown in FIGS. 5B and 5C). The conductive member 151*a* is disposed on the slide rail 120*a*, wherein the conductive member 151*a* can be made of copper, silver, aluminum or steel. The magnet base 152*a* is connected to the driving member 132*a* and linked up with the driving member 132*a*, and is slid along the slide rail 120*a*. In FIG. 4, the conductive member 151*a* is plate-shaped and vertical disposed on the slide rail 120*a*. The conductive member 151*a* is embedded into the magnet base 152*a*, that is, two sides of the conductive member 151*a* are faced to the inner walls of the magnet base 152*a* respectively.

Figure 5A:
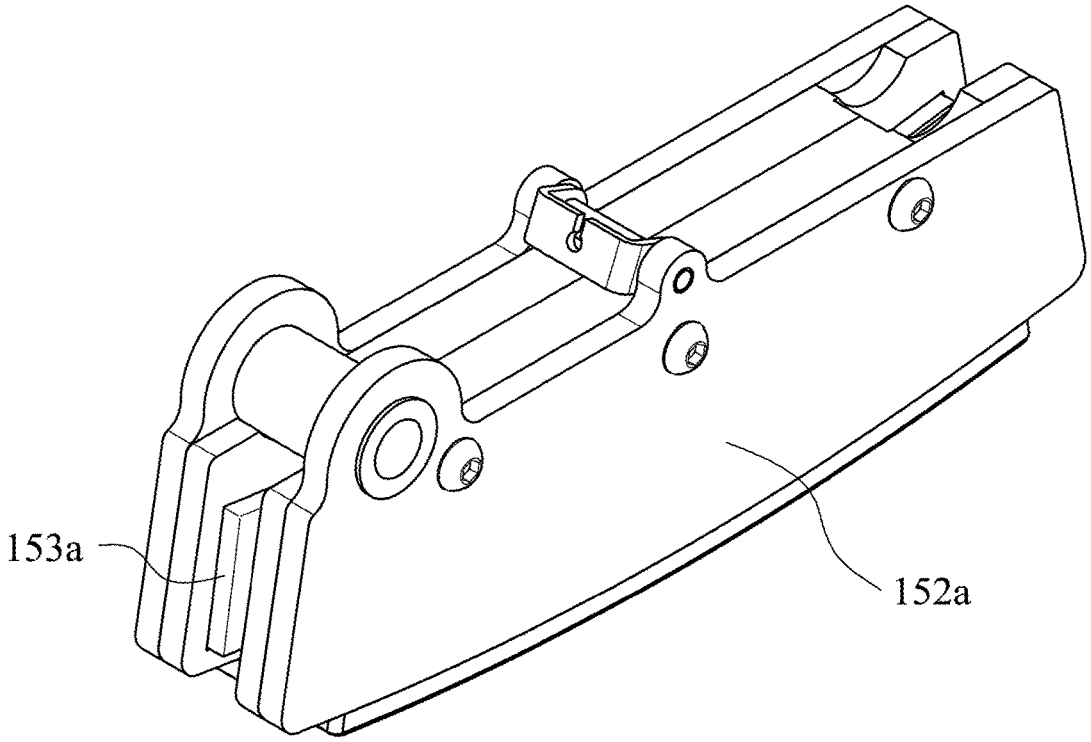
FIG. 5A is a three dimensional view of the magnet base and magnets of FIG. 1.
Figure 5B:
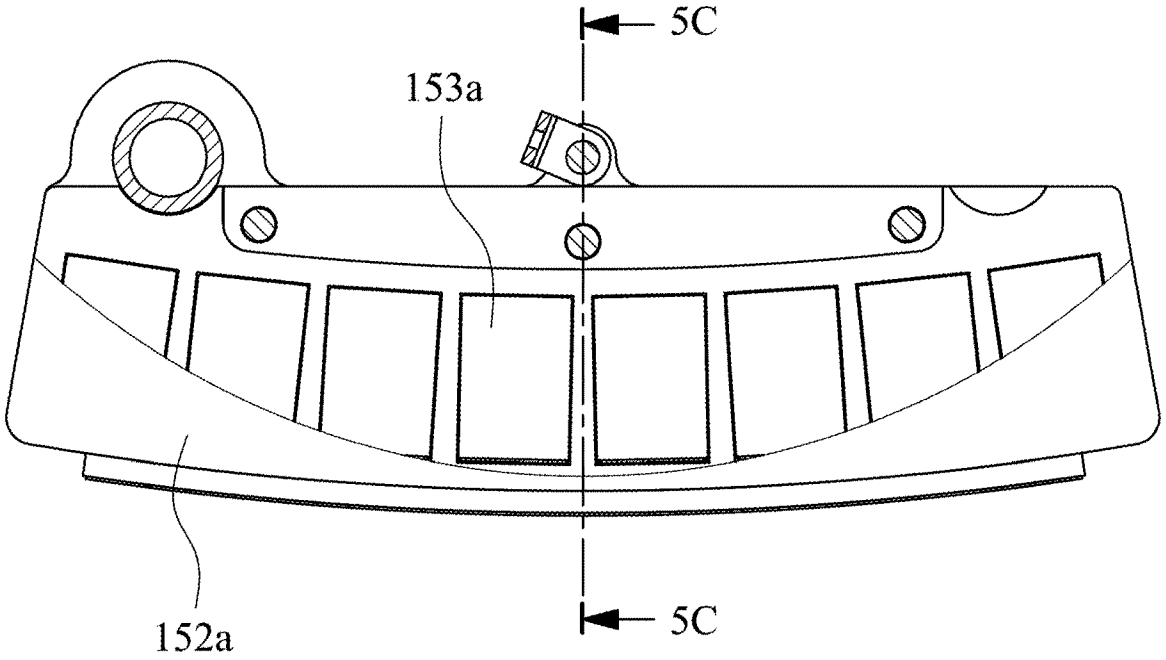
FIG. 5B is a schematic view of the magnet base and the magnets of FIG. 1.
Figure 5C:
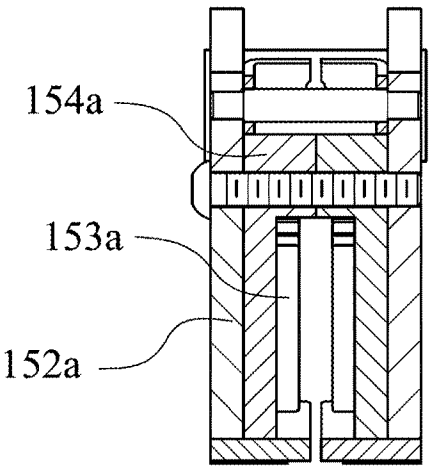
FIG. 5C is a cross-sectional view of the magnet base along line 5C-5C of FIG. 5B.

FIG. 5A is a three dimensional view of the magnet base 152*a* and magnets 153*a* of FIG. 1, FIG. 5B is a schematic view of the magnet base 152*a* and the magnets 153*a* of FIG. 1, and FIG. 5C is a cross-sectional view of the magnet base 152*a* along line 5C-5C of FIG. 5B. In FIGS. 5A-5C, the plurality of magnets 153*a* are arranged on the inner walls of the magnet base 152*a*. Further, the magnets 153*a* can be arranged on the inner walls of the magnet base 152*a* via partitions 154*a*.

The conductive member 151*a* is embedded into the magnet base 152*a*, so that each side of the conductive member 151*a* is faced to the magnets 153*a* which are disposed on each inner wall of the magnet base 152*a*. When the magnet base 152*a* is linked with the driving member 132*a* for sliding along the slide rail 120*a*, a movement between one surface of each of the magnets 153*a* and the surfaces of the conductive member 151*a* which are faced to each other is provided, and the magnetic resistance is generated.

In order to provide an adjustable magnetic resistance function, the high knees exercise apparatus 100 can further include a resistance adjusting device. The resistance adjusting device can change a relative position between the surface of the magnet and the surface of the conductive member. In FIGS. 1 and 4, the resistance adjusting device includes two forcing mechanisms 161, a controlling member 163 and two restoring members 162 (only one forcing mechanism and one forcing mechanism are labelled). The forcing mechanisms 161 can be steel wire ropes. The forcing mechanisms 161 is connected to the magnet base 152*a* of each of the magnetic resistance devices 150*a*. The forcing mechanism 161 is for adjusting an embedded position between the magnet base 152*a* and the conductive member 151*a*. The controlling member 163 is connected to the forcing mechanisms 161 for controlling thereof, wherein the controlling member 163 can be disposed on the second supporting base 113 and adjacent to handle 115 for operating conveniently. The two restoring members 162 are connected to each of the forcing mechanisms 161 and each of the magnet bases 152*a* respectively. The restoring members 162 can have elasticity for restoring the embedded position between the magnet base 152*a* and the conductive member 151*a*.

Figure 6A:
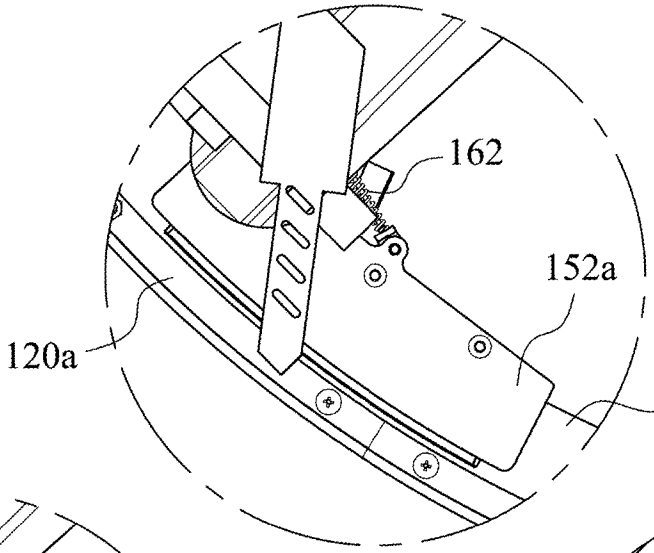
FIG. 6A is a schematic view of one using state between the magnet base and the conductive member of the high knees exercise apparatus of FIG. 3B.
Figure 6B:
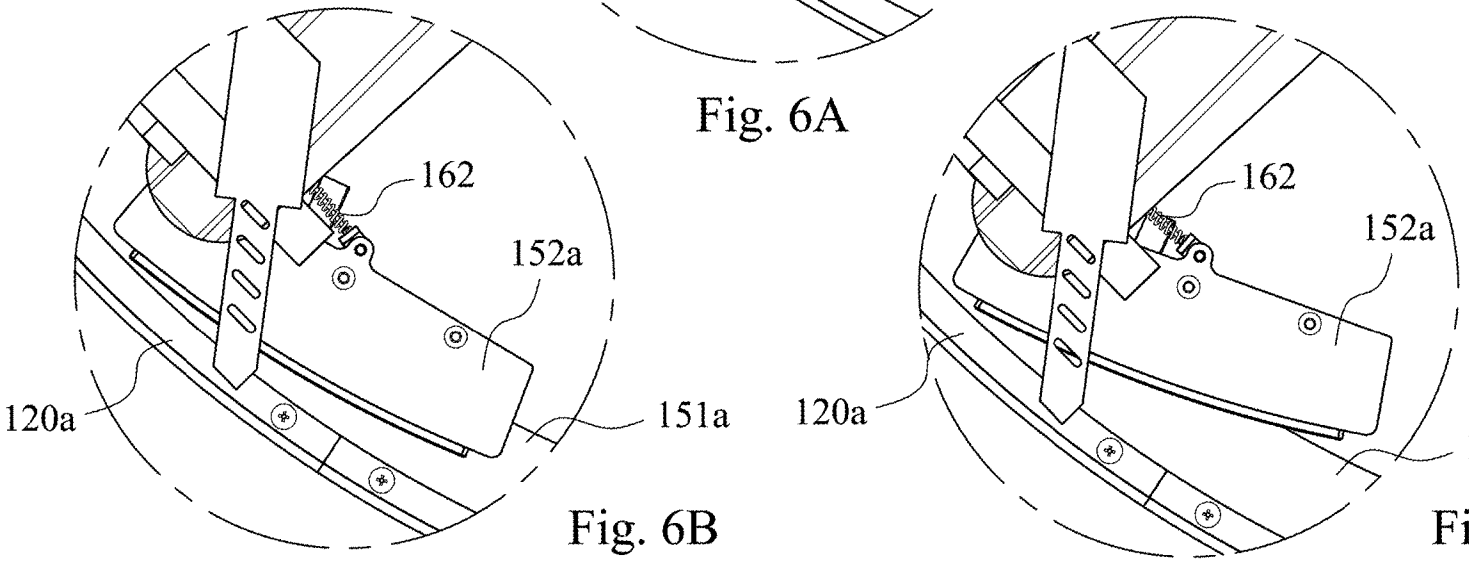
FIG. 6B is a schematic view of another using state between the magnet base and the conductive member of the high knees exercise apparatus of FIG. 3B.
Figure 6C:
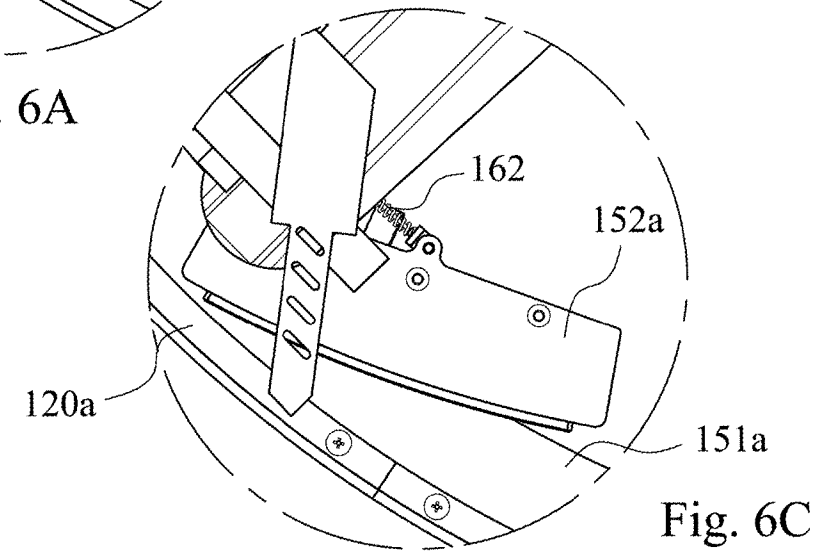
FIG. 6C is a schematic view of yet another using state between the magnet base and the conductive member of the high knees exercise apparatus of FIG. 3B.

FIGS. 6A, 6B and 6C are schematic views of three using states between the magnet base 152*a* and the conductive member 151*a* of the high knees exercise apparatus 100 of FIG. 3B. In FIG. 4, the magnet base 152 can be pivotally connected to the driving member 132*a* via a connecting axis 134. In FIGS. 6A, 6B and 6C, when the magnet base 152*a* is driven by the forcing mechanism 161 and relatively pivoted to the driving member 132*a*, the embedded position between the magnet base 152*a* and the conductive member 151*a* is changed. Therefore, the facing area between the magnets 153*a* and the conductive member 151*a* is reduced, and the magnetic resistance is reduced.

Figure 7:
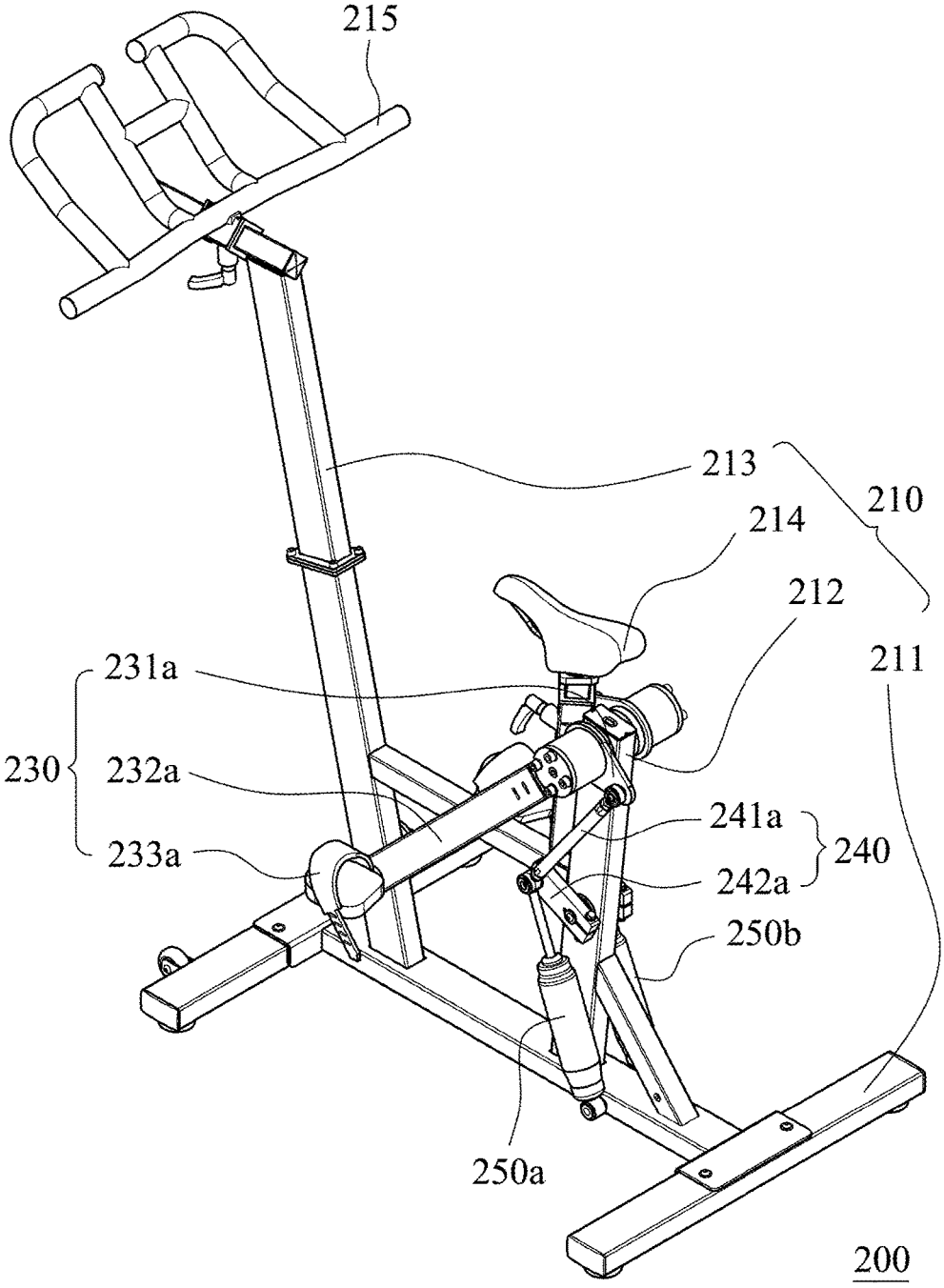
FIG. 7 shows a three dimensional view of a high knees exercise apparatus according to another embodiment of the present disclosure.

FIG. 7 shows a three dimensional view of a high knees exercise apparatus 200 according to another embodiment of the present disclosure. The high knees exercise apparatus 200 includes a base 210, a driving mechanism 230, a linkage mechanism 240 and two magnetic resistance devices 250*a*, 250*b*.

In FIG. 7, the base 210 includes a bottom base 211, a first supporting base 212, a second supporting base 213, a seat base 214 and a handle 215. The relationships among the bottom base 211, the first supporting base 212, the second supporting base 213, the seat base 214 and the handle 215 are the same with the relative elements in FIG. 1, and will not describe again herein.

The driving mechanism 230 includes two pivot members 231*a*, two driving members 232*a* and two pedals 233*a* (the other pivot member, driving member and pedal are not labelled in FIG. 7). The pivoting members 231*a* are symmetrically and pivotally connected to two sides of the first supporting base 212 respectively. One end of each of the driving members 232*a* is connected to each of the pivoting members 231*a*, wherein each of the driving members 232*a* is swung along an arc path. The angle of the arc path can be 45 degrees to 100 degrees. The two pedals 233*a* are connected to each of the driving members 232*a* respectively.

The linkage mechanism 240 includes two first linkage rods 241*a*, two second linkage rods 242*a*, and a rotatable axis (not labelled in FIG. 7, and only one first linkage rod and one second linkage rod are labelled in FIG. 7). The linkage mechanism 240 is linked up with the pivoting members 231*a* for leading the driving members 232*a* swung reversely in response to each other. The detail structure of the linkage mechanism 240 is the same with the illustration in FIG. 2, and will not describe herein again.

Figure 8:
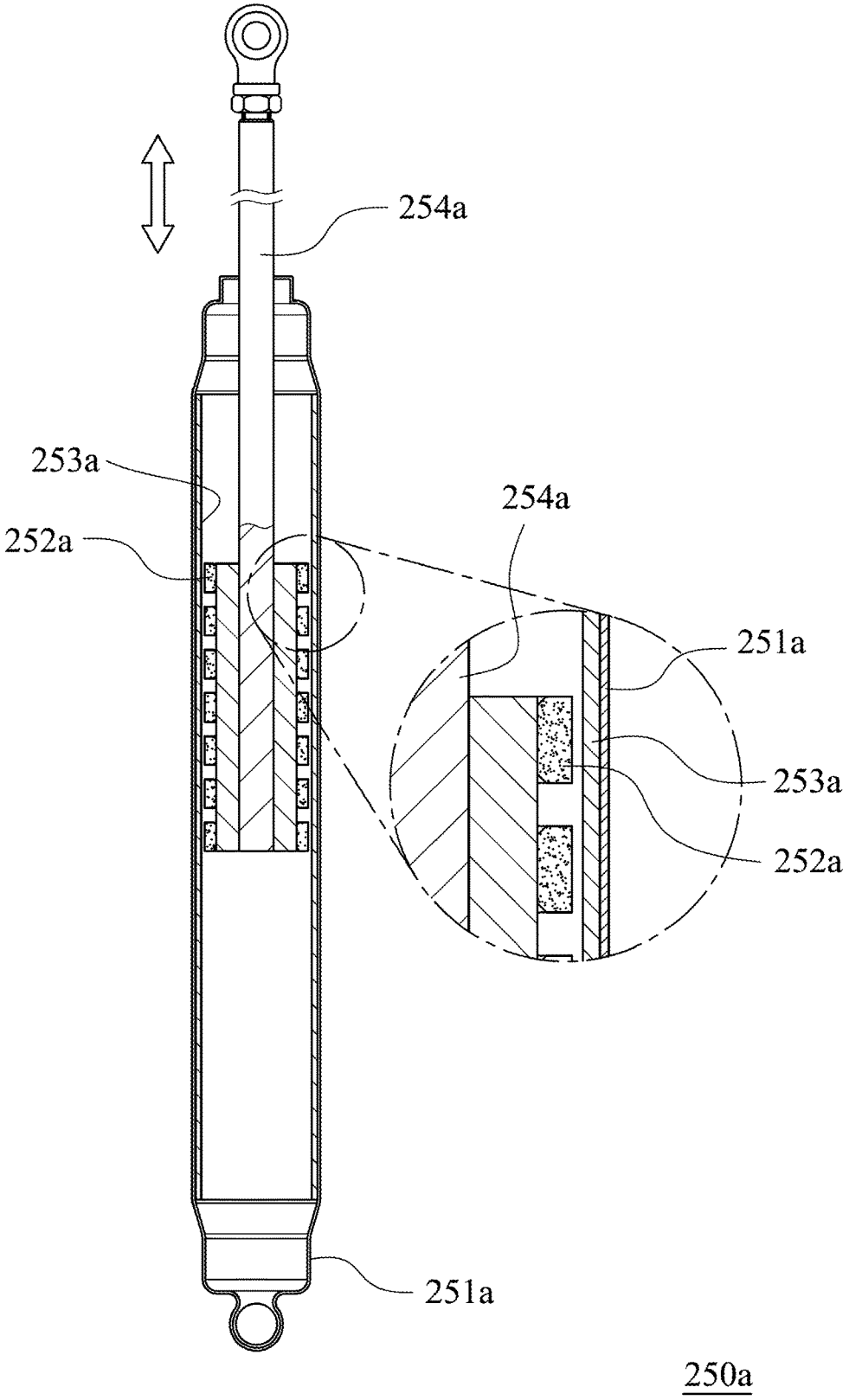
FIG. 8 shows a cross-sectional view of the magnetic resistance device of FIG. 7.

The magnetic resistance devices 250*a*, 250*b* are for providing magnetic resistances in accordance with swings of the two driving members 232*a* respectively. FIG. 8 shows a cross-sectional view of the magnetic resistance device 250*a* of FIG. 7. The magnetic resistance device 250*a* includes a cylinder case 251*a*, a magnetic resistance component assembly, and a piston rod 254*a*, wherein the magnetic resistance component assembly includes magnets 252*a* and a conductive member 253*a*. The cylinder case 251*a* is disposed on the bottom base 211. The magnetic resistance component assembly is located in the cylinder case 251*a*, wherein the conductive member 253*a* is connected to an inner wall of the cylinder case 251*a*, the magnets 252*a* surround the piston rod 254*a*, and the conductive member 253*a* is adjacent to the magnet 252*a*. One end of the piston rod 254*a* is linked up with the linkage mechanism 240 which is linked up with the swings of the driving member 232*a*, so that a movement between the magnet 252*a* and the conductive member 253*a* is provided, and the magnetic resistance is generated.

Figure 9A:
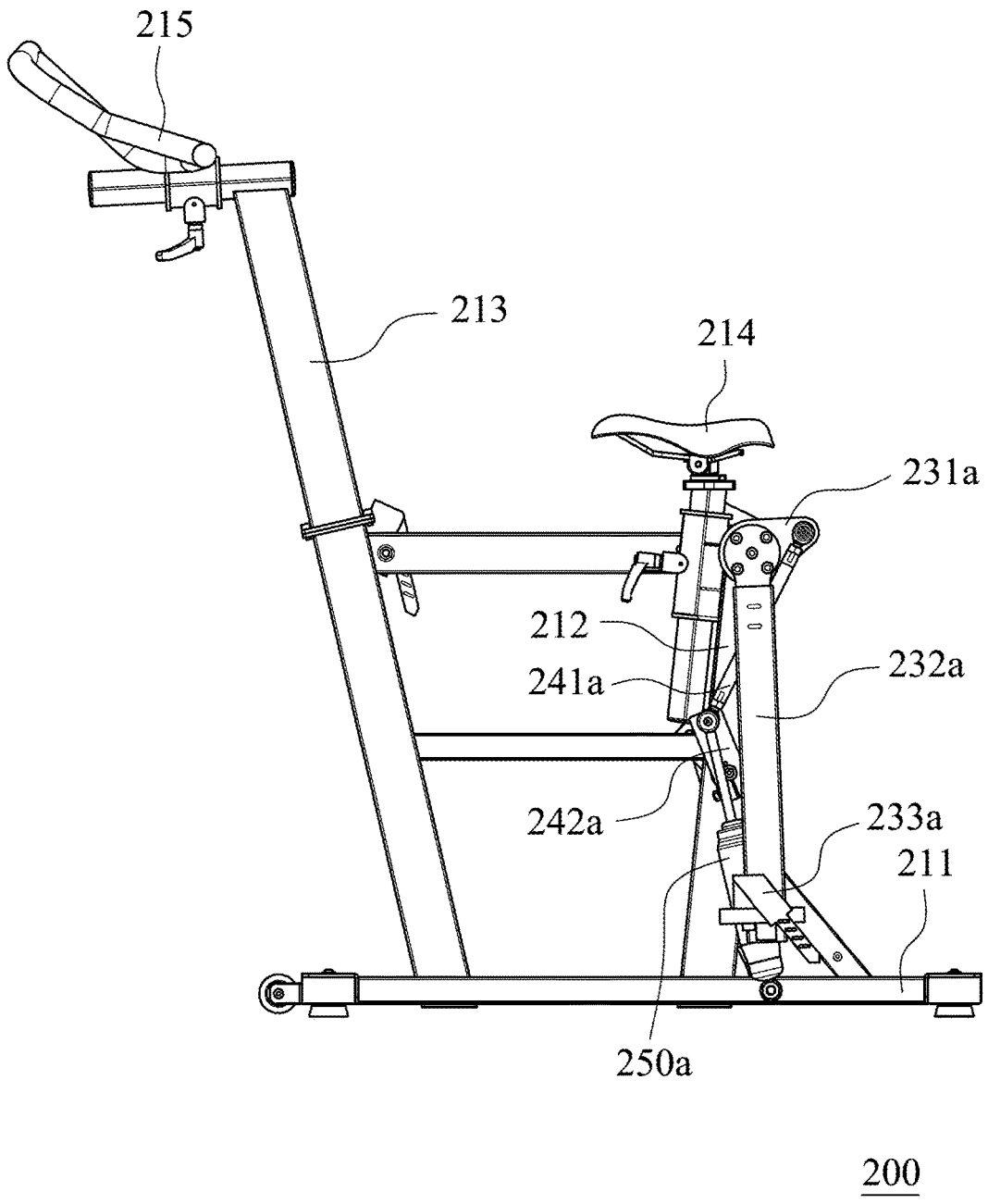
FIG. 9A is a schematic view of one using state of the magnetic resistance device of FIG. 8.
Figure 9B:
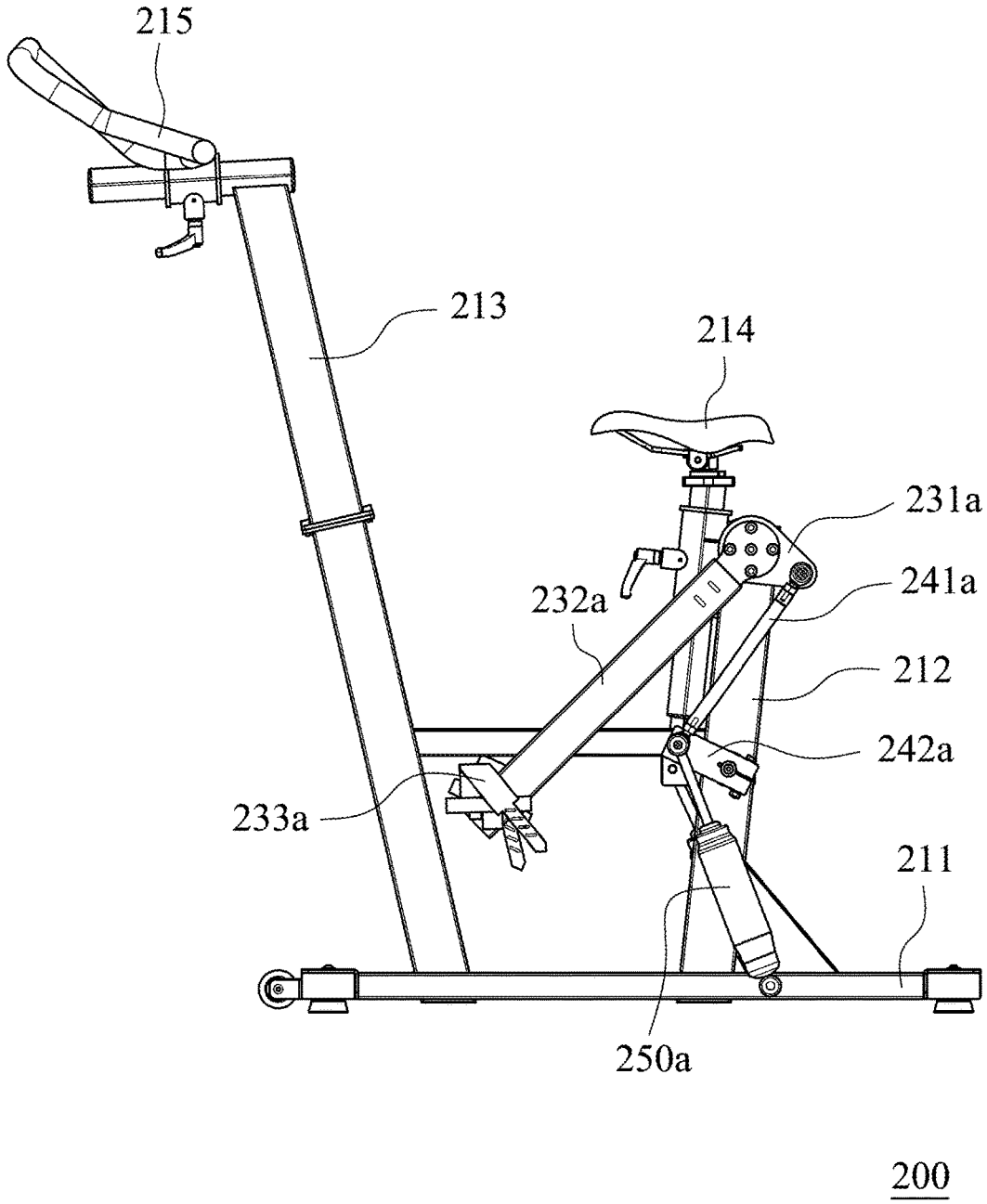
FIG. 9B is a schematic view of another using state of the magnetic resistance device of FIG. 8.
Figure 9C:
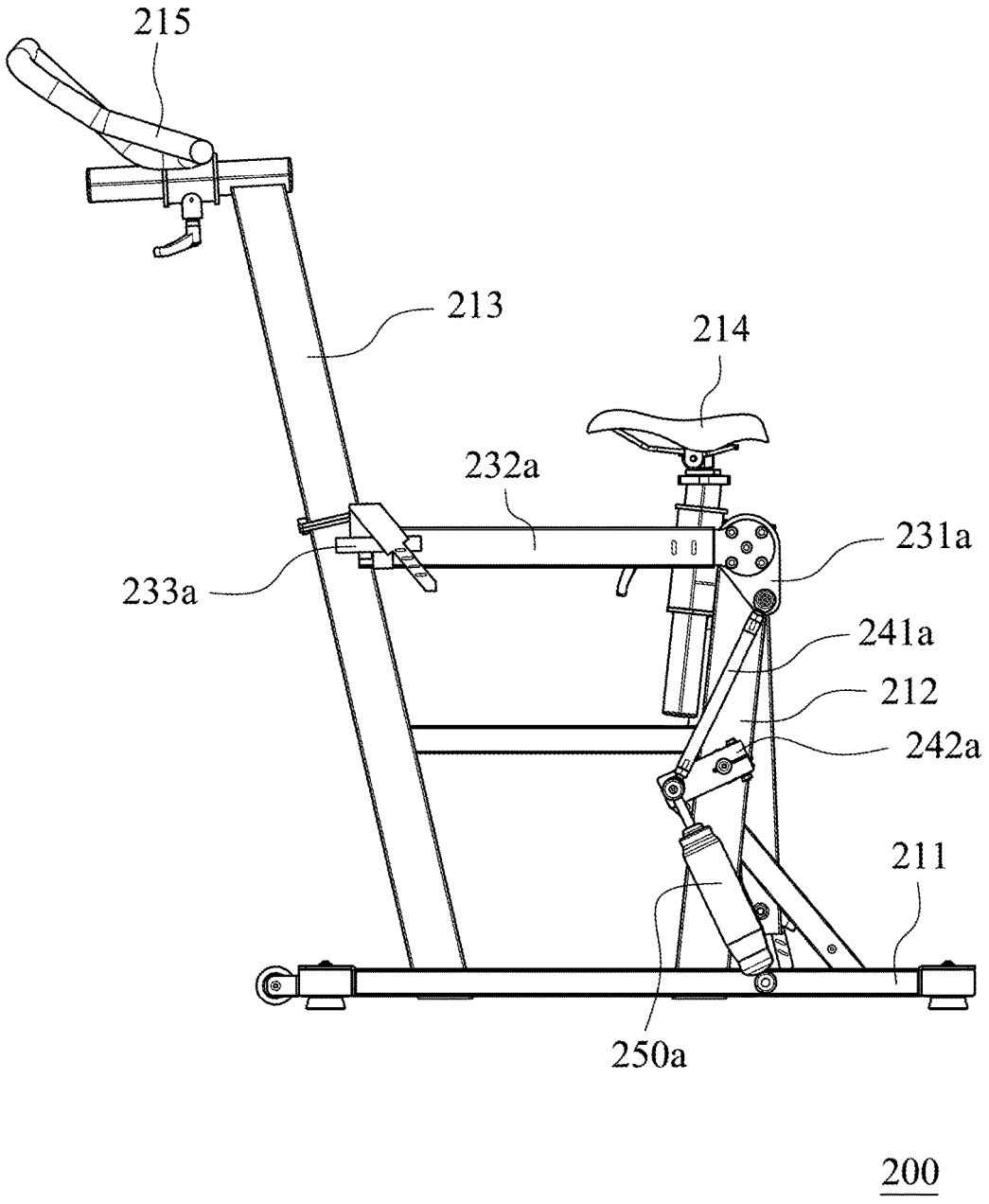
FIG. 9C is a schematic view of yet another using state of the magnetic resistance device of FIG. 8.

FIGS. 9A, 9B and 9C are schematic views of three using states of the magnetic resistance device 250*a* of FIG. 8. In FIG. 9A, the driving member 232*a* is perpendicular to the ground, at this time, the piston rod 254*a* is not be driven, and there is no movement between the magnets 252*a* and the conductive member 253*a*, thus, no magnetic resistance is generated. In FIGS. 9B and 9C, the driving member 232*a* is swung from the first supporting base 212 to the second supporting base 213, the pivoting member 231*a* is linked up with the driving member 232*a*, and links up with the first linkage rod 241*a*. When the first linkage rod 241*a* is linked up with the pivoting member 231*a*, the piston rod 254*a* of the magnetic resistance device 250*a* is pushed, so that the magnet 252*a* disposed on the piston rod 254*a* is moved within the cylinder case 251*a*. Therefore, the movement between the magnet 252*a* and the conductive member 253*a* which is disposed on the inner wall of the cylinder case 251*a* for generating the magnetic resistance.

Figure 10A:
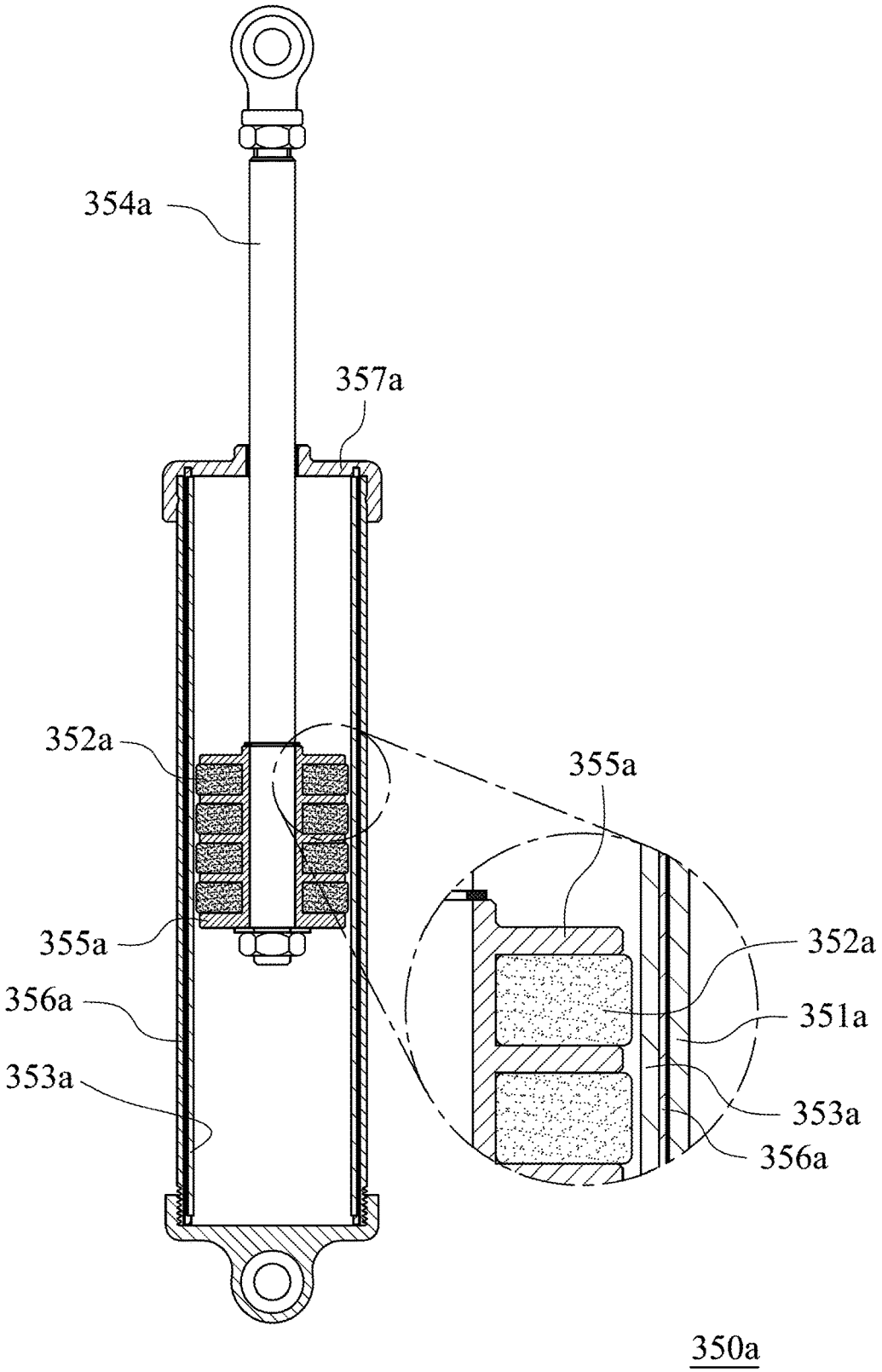
FIG. 10A shows a cross-sectional view of a magnetic resistance device of the high knees exercise apparatus according to yet another embodiment of the present disclosure.

FIG. 10A shows a cross-sectional view of a magnetic resistance device 350*a* of the high knees exercise apparatus according to yet another embodiment of the present disclosure. In FIG. 10A, the magnetic resistance device 350*a* further includes a magnet base 355*a*, a rotating base 356*a* and an adjusting cover 357*a*. The magnet base 355*a* can include a plurality of layer frames and the magnets 352*a* can be arranged on the layer frames. Therefore, the magnets can be moved stably. The rotating base 356*a* is rotatably connected to the inner wall of the cylinder case 351*a* and a plurality of the conductive members 353*a* is disposed on the rotating base 356*a*. The adjusting cover 357*a* is rotatably connected to the open end of the cylinder case 351*a*, and linked up with the rotating base 356*a*, wherein the piston rod 354*a* is passed through the adjusting cover 357*a* and inserted into the cylinder case 351*a*.

Figure 10B:
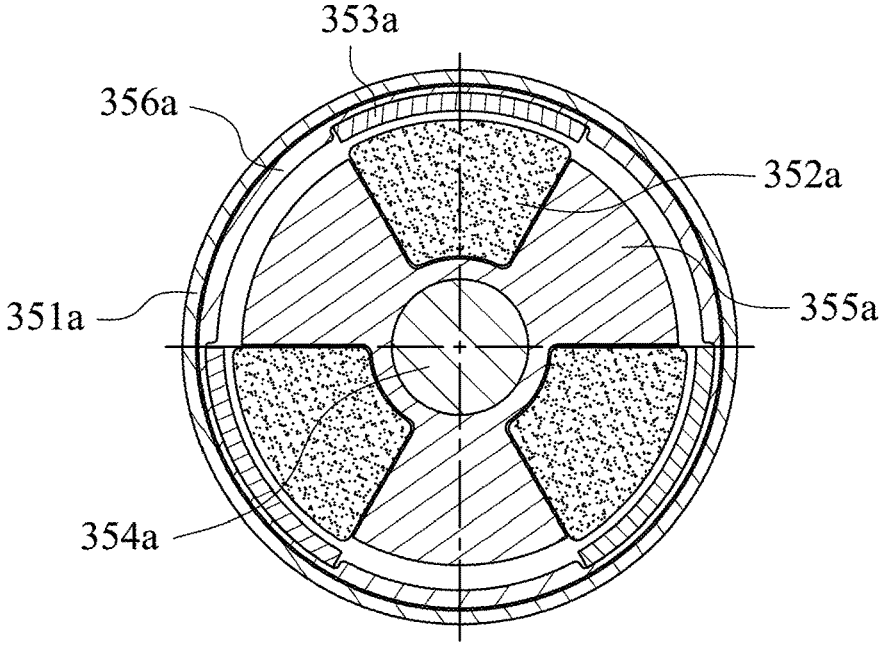
FIG. 10B shows a cross-sectional view of the magnetic resistance device along line 10B-10B of FIG. 10A.

FIG. 10B shows a cross-sectional view of the magnetic resistance device 350*a* along line 10B-10B of FIG. 10A. In FIG. 10B, number of the conductive members 353*a* is three and equally arranged on the rotating base 356*a*. There are three magnets 352*a* located on each of the layer frames of the magnet base 355*a*. When the entire side surface of each magnet 352*a* is faced to each conductive member 353*a*, the magnetic resistance is largest.

Figure 10C:
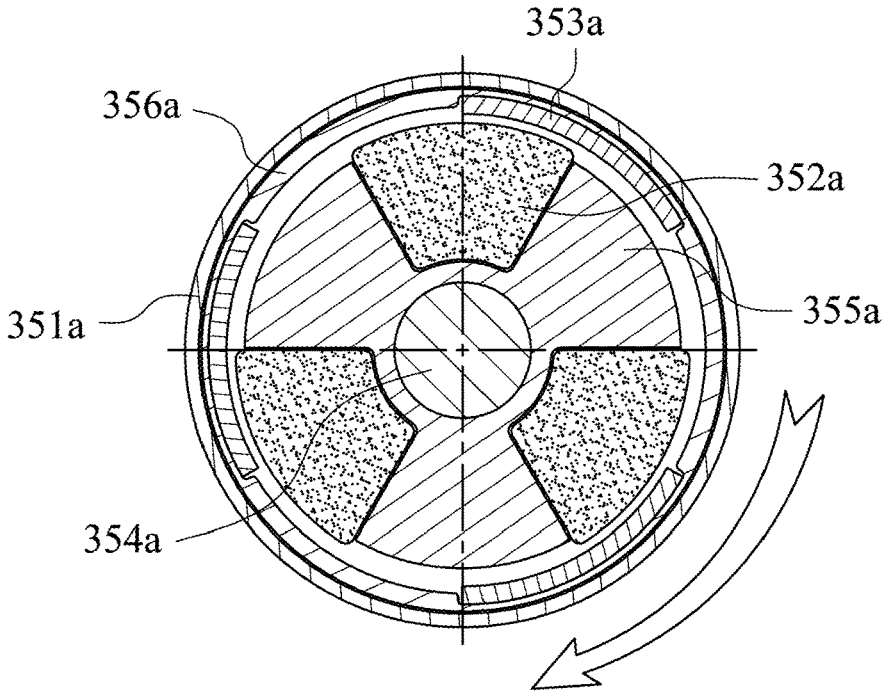
FIG. 10C shows a cross-sectional view of another state of the magnetic resistance device of FIG. 10B.

FIG. 10C shows a cross-sectional view of another state of the magnetic resistance device 350*a* of FIG. 10B. When the adjusting cover 357*a* is turned, the rotating base 356*a* is rotated and the conductive members 353*a* thereon is moved. Therefore, partial surface of each magnet 352*a* is not faced to each conductive member 353*a*, thus, the magnetic resistance is smaller during the piston rod 354*a* is driven.

Figure 11:
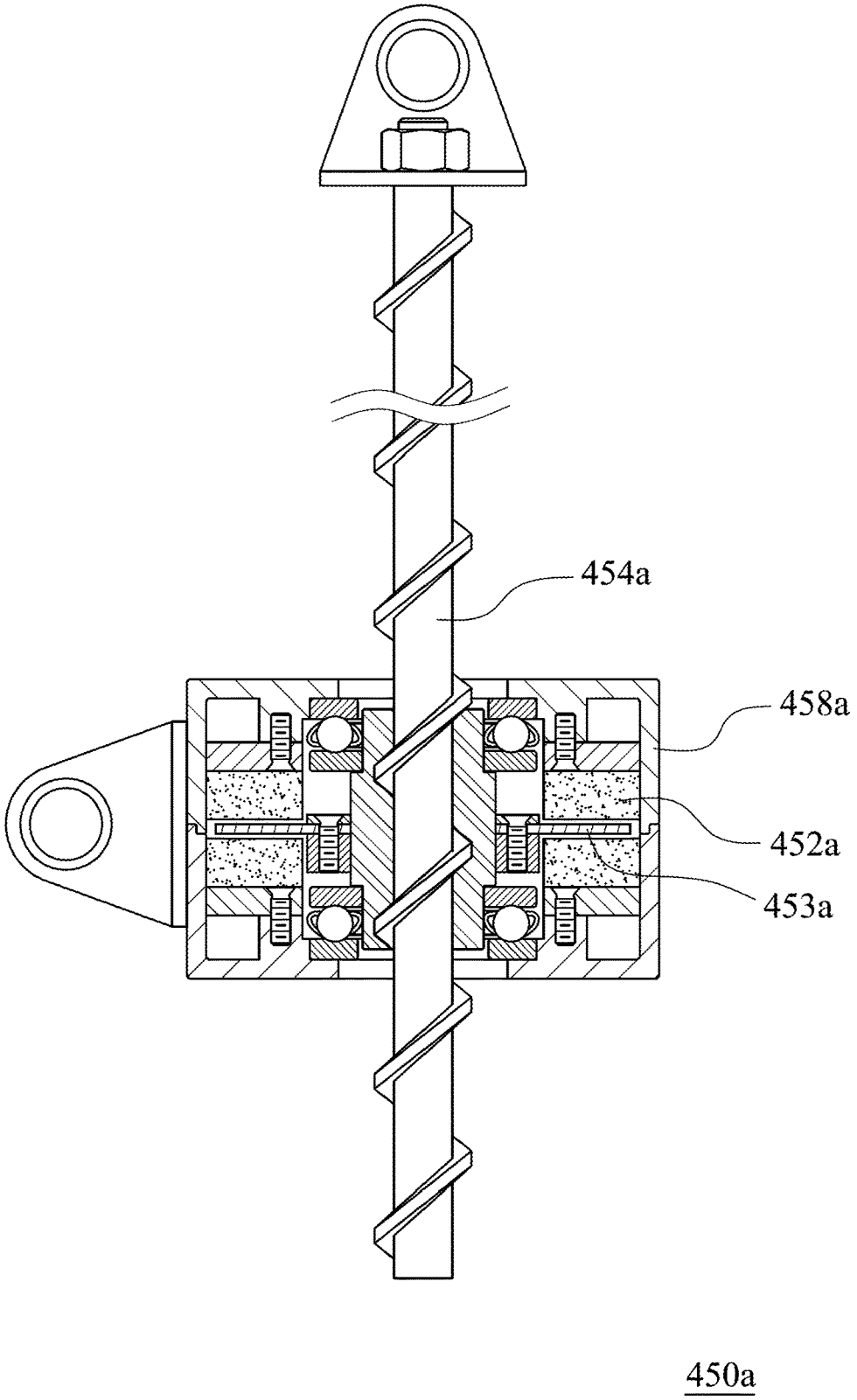
FIG. 11 shows a schematic view of a magnetic resistance device of the high knees exercise apparatus according to further another embodiment of the present disclosure.

FIG. 11 show a schematic views of a magnetic resistance device 450*a* of the high knees exercise apparatus according to further another embodiment of the present disclosure, wherein the cylinder case of the magnetic resistance device 450*a* will not be shown in FIG. 11. In FIG. 11, the piston rod 454*a* is a screw rod. The magnetic resistance component assembly includes a plurality of magnets 452*a*, a conductive member 453*a* and a magnet case 458*a*, wherein the magnets 452*a* and the conductive member 453*a* is located in the magnet case 458*a*. The magnets 452*a* is connected to two inner side of the magnet case 458*a*, and the magnets 452*a* on each inner side is faced to the surface of the conductive member 453*a*. The piston rod 454*a* is inserted through the conductive member 453*a* and the magnet case 458*a*, wherein the conductive member 453*a* is linked up with the piston rod 454*a*, so that when the piston rod 454*a* is moved, the conductive member 453*a* is rotated, and the movement between the magnet 452*a* and the conductive member 453*a* is provided. Especially, the piston rod 454*a* is a screw rod, so that the rotational speed of the conductive member 453*a* can be increased, and the magnetic resistance can also be increased.

Figure 12:
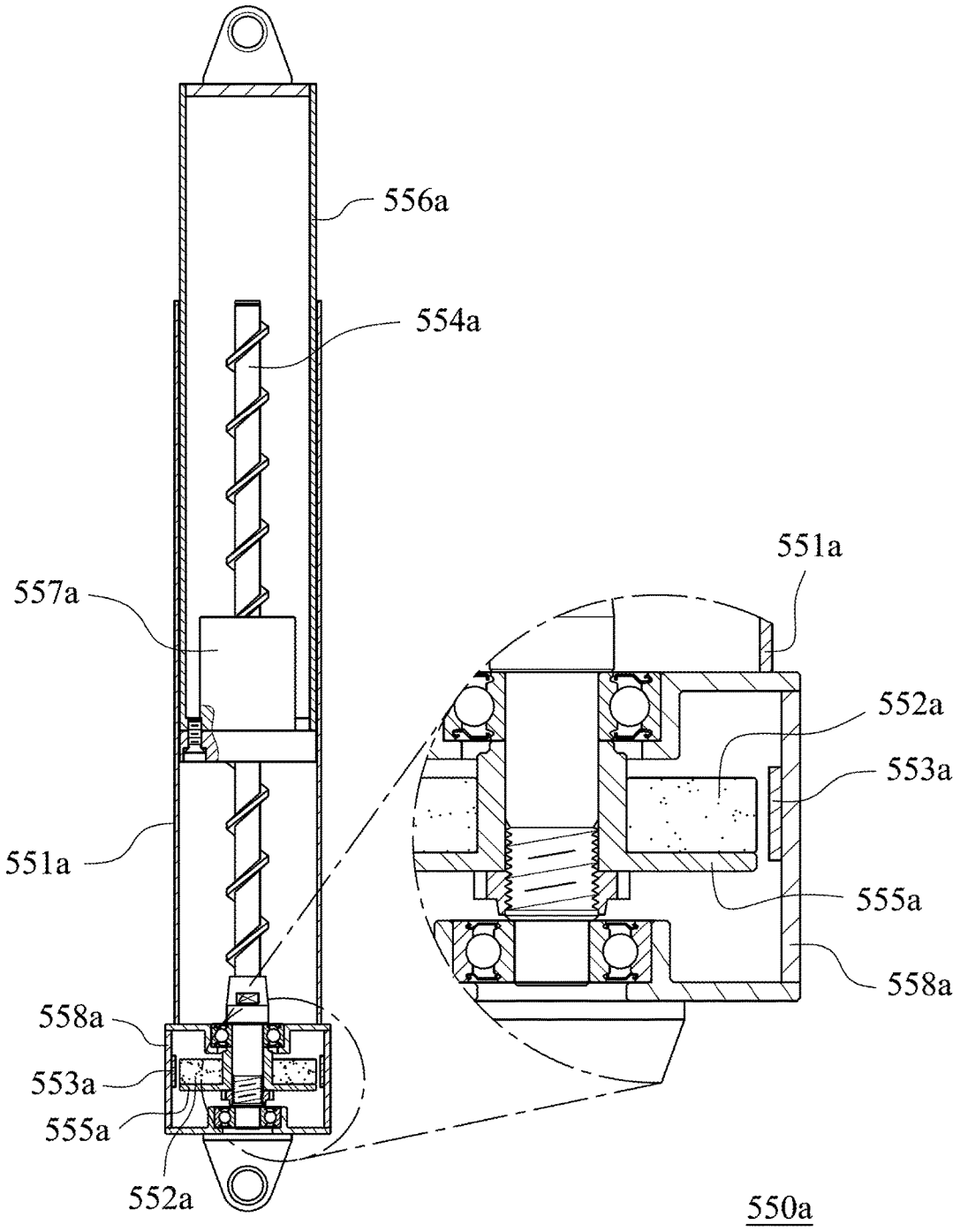
FIG. 12 shows a schematic view of a magnetic resistance device of the high knees exercise apparatus according to still another embodiment of the present disclosure.

FIG. 12 show a schematic views of a magnetic resistance device 550*a* of the high knees exercise apparatus according to still another embodiment of the present disclosure. In FIG. 12, the magnetic resistance device 550*a* includes a cylinder case 551*a*, a magnet case 558*a*, a magnet 552*a*, a conductive member 553*a*, a magnet base 555*a*, a piston rod 554*a*, a telescopic tube 556*a* and a ball screw cap 557*a*. The magnet case 558*a* is fixed to one end of the cylinder case 551*a*, wherein the conductive member 553*a* is disposed on the inner wall of the magnet case 558*a*, and the magnet base 555*a* is located in the magnet case 558*a* and the magnet 552*a* is disposed on the magnet base 555*a*. One surface of the conductive member 553*a* is adjacent to one surface of the magnet 552*a*. The piston rod 554*a* is a ball screw rod which is located in the cylinder case 551*a*, wherein one end of the piston rod 554*a* is inserted to the magnet case 558*a* and connected to the magnet base 555*a*, so that the magnet 552*a* on the magnet base 555*a* can be rotated by the piston rod 554*a*. The ball screw cap 557*a* is located in the telescopic tube 556*a* and is inserted by the piston rod 554*a*. When the telescopic tube 556*a* is driven, the piston rod 554*a* can be rotated by the ball screw cap 557*a*, and the magnet 552*a* on the magnet base 555*a* can be linked up. Therefore, the magnetic resistance can be generated.

Figure 13:
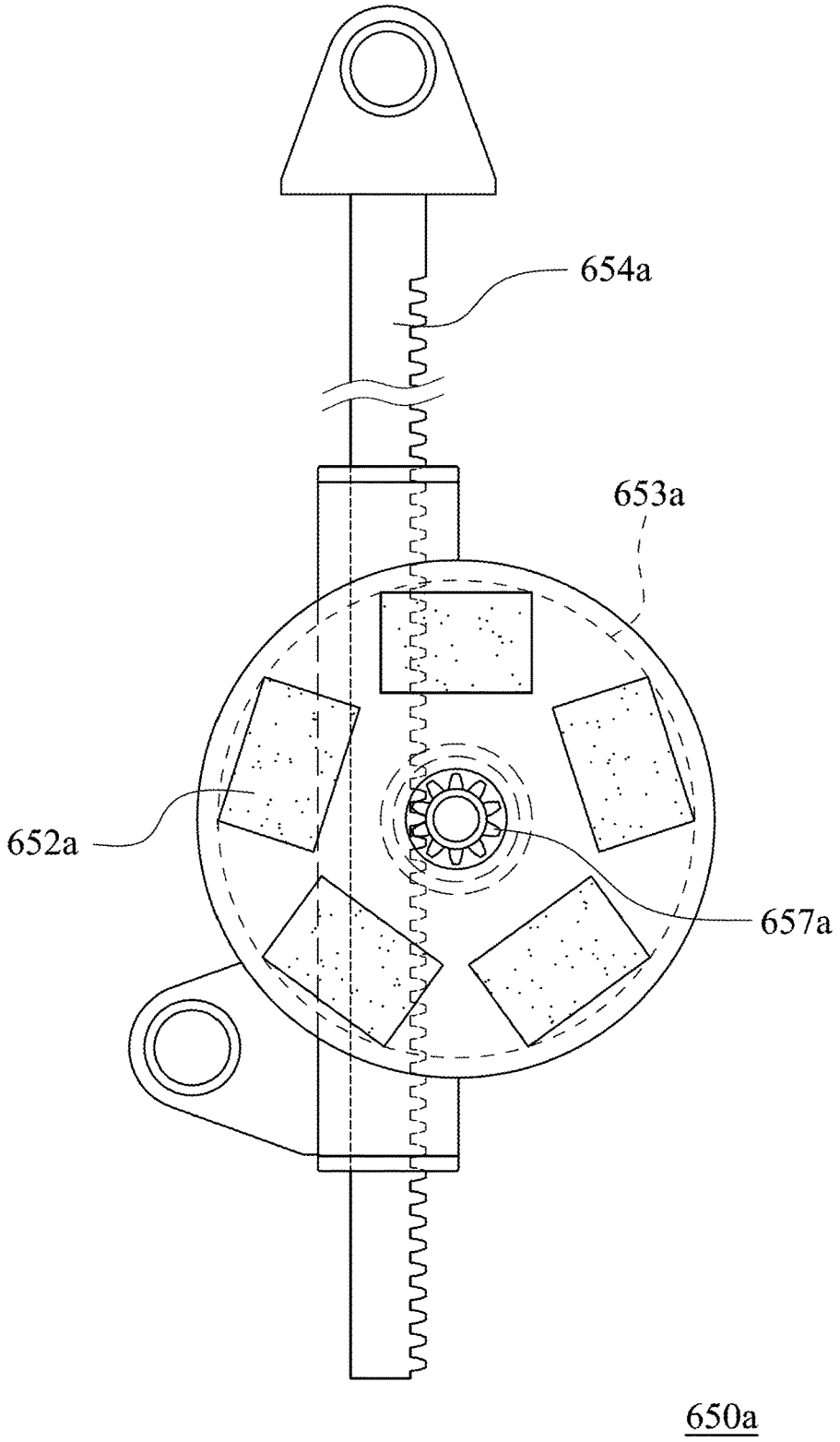
FIG. 13 shows a schematic view of a magnetic resistance device of the high knees exercise apparatus according to still another embodiment of the present disclosure.

FIG. 13 show a schematic views of a magnetic resistance device 650*a* of the high knees exercise apparatus according to still another embodiment of the present disclosure. In FIG. 13, the magnetic resistance device 650*a* includes a cylinder case (not shown), a plurality of magnets 652*a*, a conductive member 653*a*, a piston rod 654*a* and a gear 657*a*. The magnets 652*a* are disposed on the inner wall of the cylinder case, and are adjacent to two surfaces of the conductive member 653*a*. The gear 657*a* is located on the center of the conductive member 653*a*. The piston rod 654*a* is a gear rack, and is meshed to the gear 657*a*. When the piston rod 654*a* is driven, the gear 657*a* can be rotated and links up with the conductive member 653*a*. Therefore, the conductive member 653*a* can be rotated, and the movement between the magnet 652*a* and the conductive member 653*a* is provided for generating the magnetic resistance.

Figure 14:
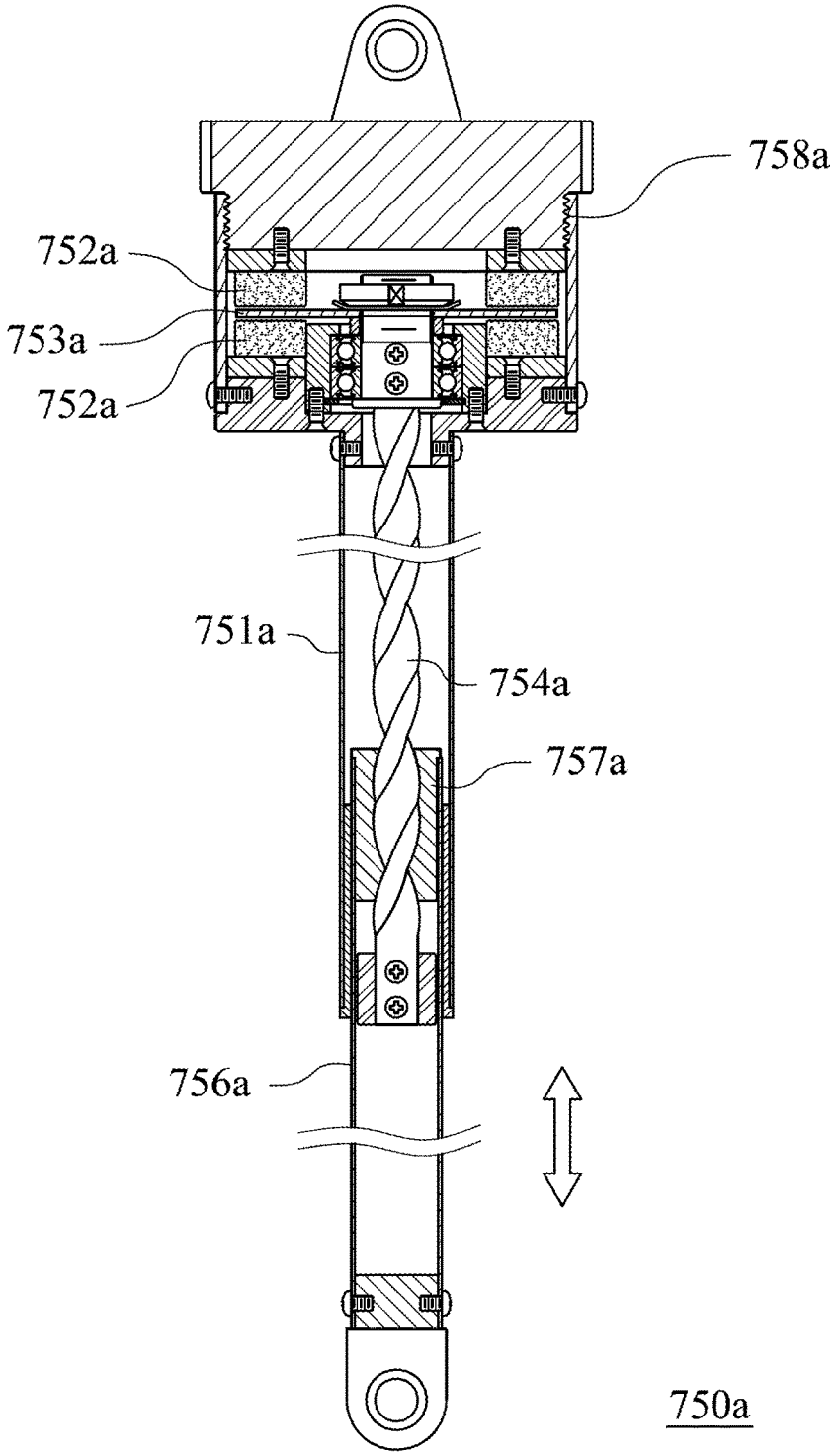
FIG. 14 shows a schematic view of a magnetic resistance device of the high knees exercise apparatus according to still another embodiment of the present disclosure.

FIG. 14 show a schematic views of a magnetic resistance device 750*a* of the high knees exercise apparatus according to still another embodiment of the present disclosure. In FIG. 14, the magnetic resistance device 750*a* includes a cylinder case 751*a*, a magnet case 758*a*, a plurality of magnets 752*a*, a conductive member 753*a*, a piston rod 754*a*, a telescopic tube 756*a* and a twist screw cap 757*a*. The magnet case 758*a* is connected to the bottom base 211 and one end of the cylinder case 751*a*. In the magnet case 758*a*, the magnets 752*a* is arranged on two inner end walls of the magnet case 758*a*, and the magnets 752*a* are adjacent to two surfaces of the conductive member 753*a*. The piston rod 754*a* is a twist screw rod which is located in the cylinder case 751*a*, wherein one end of the piston rod 754*a* is inserted to the magnet case 758*a* and coaxially connected to the conductive member 753*a*, so that the conductive member 753*a* can be rotated by the piston rod 754*a*. The twist screw cap 757*a* is located in the telescopic tube 756*a* and is inserted by the piston rod 754*a*. When the telescopic tube 756*a* is driven, the piston rod 754*a* can be rotated by the twist screw cap 757*a*, and the conductive member 753*a* in the magnet case 758*a* can be linked up. Therefore, the magnetic resistance can be generated.

Figure 15:
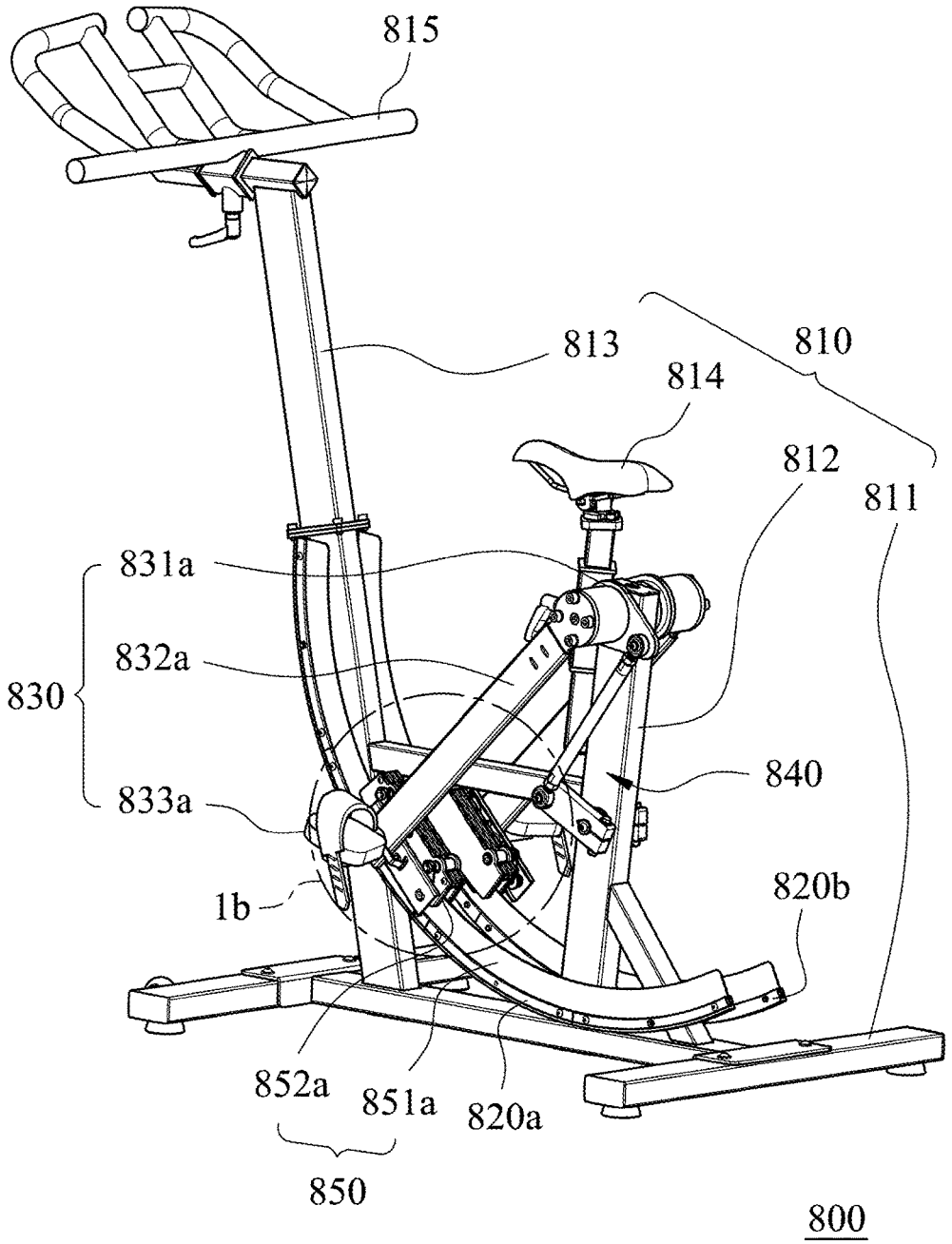
FIG. 15 shows a three dimensional view of a high knees exercise apparatus according to yet another embodiment of the present disclosure.

FIG. 15 shows a three dimensional view of a high knees exercise apparatus 800 according to yet another embodiment of the present disclosure. In FIG. 15, the high knees exercise apparatus 800 includes a base 810, two slide rails 820*a*, 820*b*, a driving member 830, a linkage mechanism 840 and two magnetic resistance devices 850*a*, 850*b*. The mentioned elements and the relationships among the mentioned element are arranged as the aforementioned embodiment of FIG. 1, and will not state again herein.

Figure 16A:
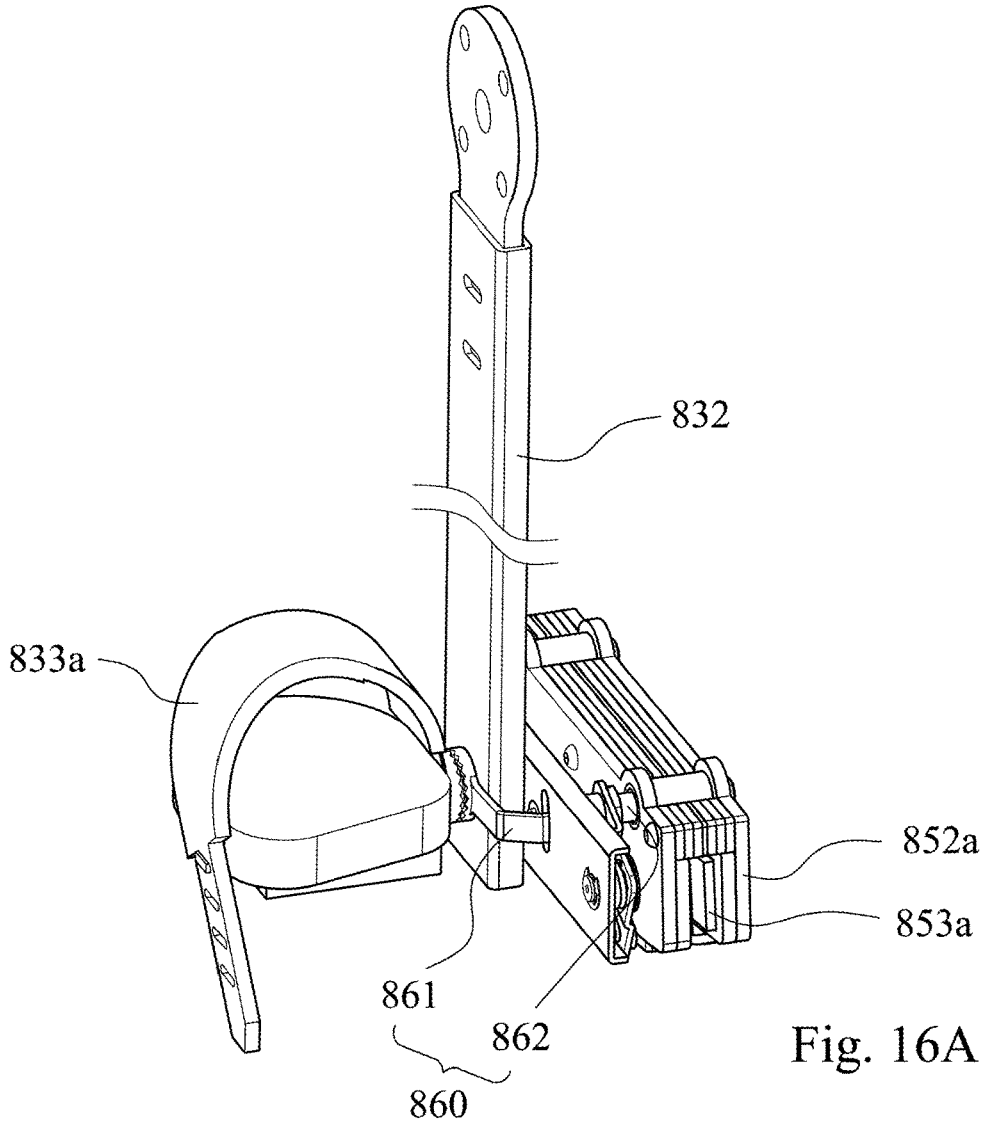
FIG. 16A shows a schematic view of a resistance adjusting device of the high knees exercise apparatus of FIG. 15.
Figure 16B:
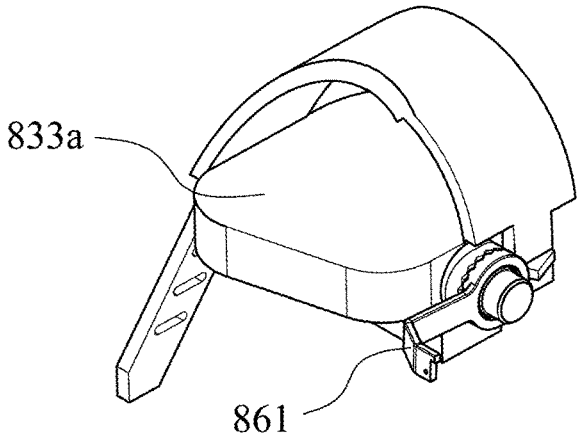
FIG. 16B shows a schematic view of a shift shaft of the resistance adjusting device of FIG. 16A.

FIG. 16A shows a schematic view of a resistance adjusting device 860 of the high knees exercise apparatus 800 of FIG. 15. FIG. 16B shows a schematic view of a shift shaft 861 of the resistance adjusting device 860 of FIG. 16A. In FIGS. 16A and 16B, the resistance adjusting device 860 includes two shift mechanisms, each of the shift mechanisms (only one be shown in FIG. 16A) includes a shift shaft 861 and a linking shaft 862. One end of the shift shaft 861 is connected to the pedal 833*a*, so that the shift shaft 861 is linked up with the pedal 833*a*. One end of the linking shaft 862 is connected to the shift shaft 861, the other end of the linking shaft 862 is connected to the magnet base 852*a*. Therefore, the user can shift the pedal 833*a* for linking up the shift shaft 861, and the linking shaft 862 can also be linked up with the shift shaft 861 for moving the magnet base 852*a*, so that the relative position between the magnets 853*a* and the conductive member 851*a* can be changed. Thus, the magnetic resistance can be adjusted.

Figure 17A:
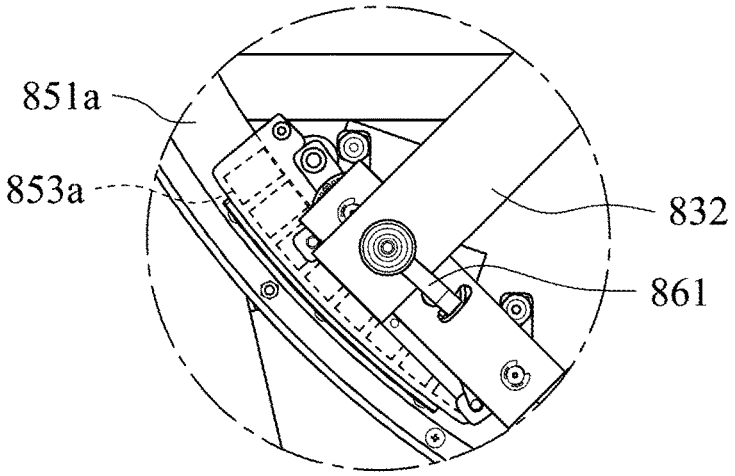
FIG. 17A is schematic views of one using states between the magnet base and the conductive member of the high knees exercise apparatus of FIG. 15.
Figure 17B:
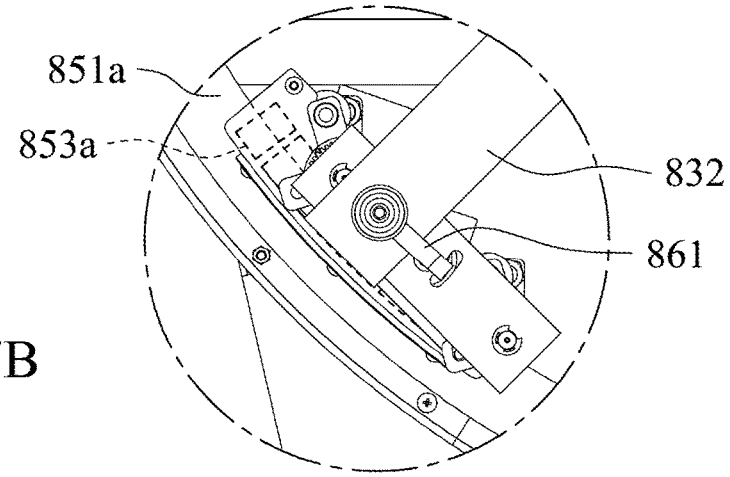
FIG. 17B is schematic views of another using states between the magnet base and the conductive member of the high knees exercise apparatus of FIG. 15.
Figure 17C:
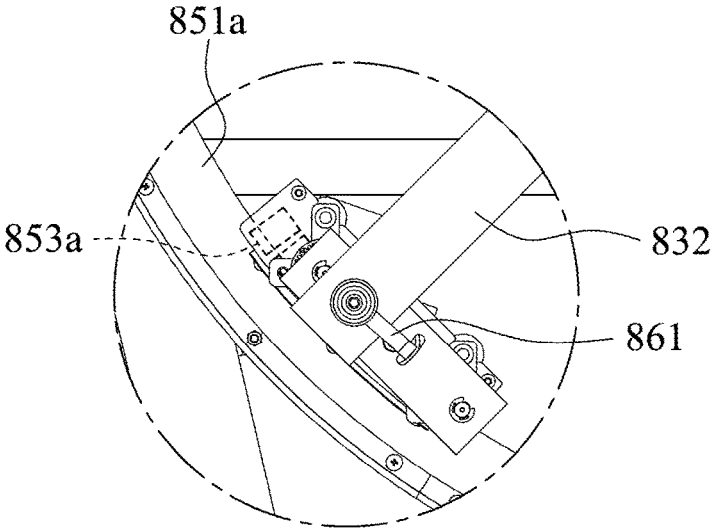
FIG. 17C is schematic views of the other using states between the magnet base and the conductive member of the high knees exercise apparatus of FIG. 15.

FIGS. 17A, 17B and 17C are schematic views of three using states between the magnet base 853*a* and the conductive member 851*a* of the high knees exercise apparatus 800 of FIG. 15. In FIGS. 17A, 17B and 17C, the relative position between the magnets 853*a* and the conductive members 851*a* can be changed by driving the shift shaft 861 and the linking shaft 862 via the pedal 833*a*.

Figure 18A:
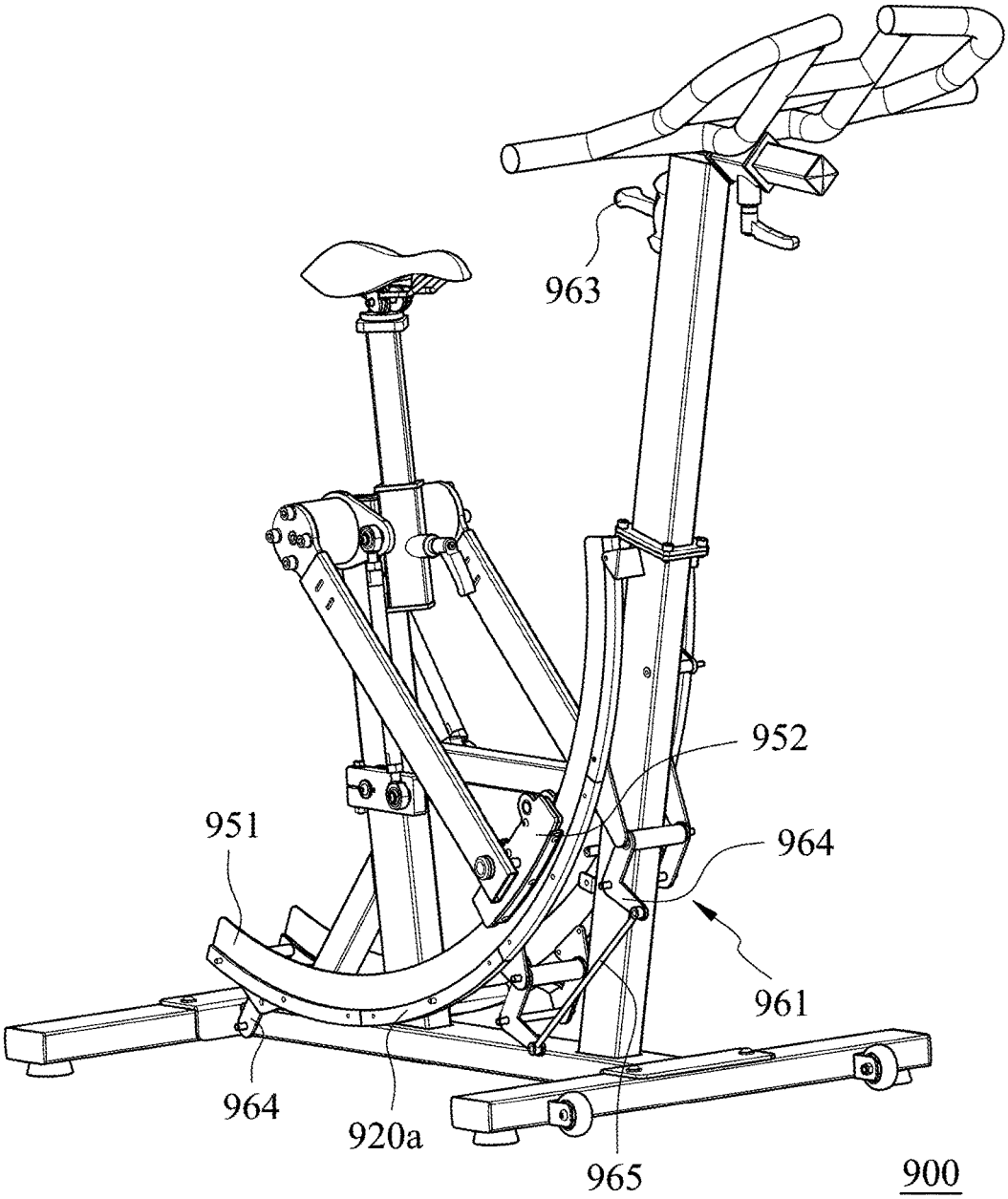
FIG. 18A is a three dimensional view of a high knees exercise apparatus according to still another embodiment of the present disclosure.
Figure 18B:
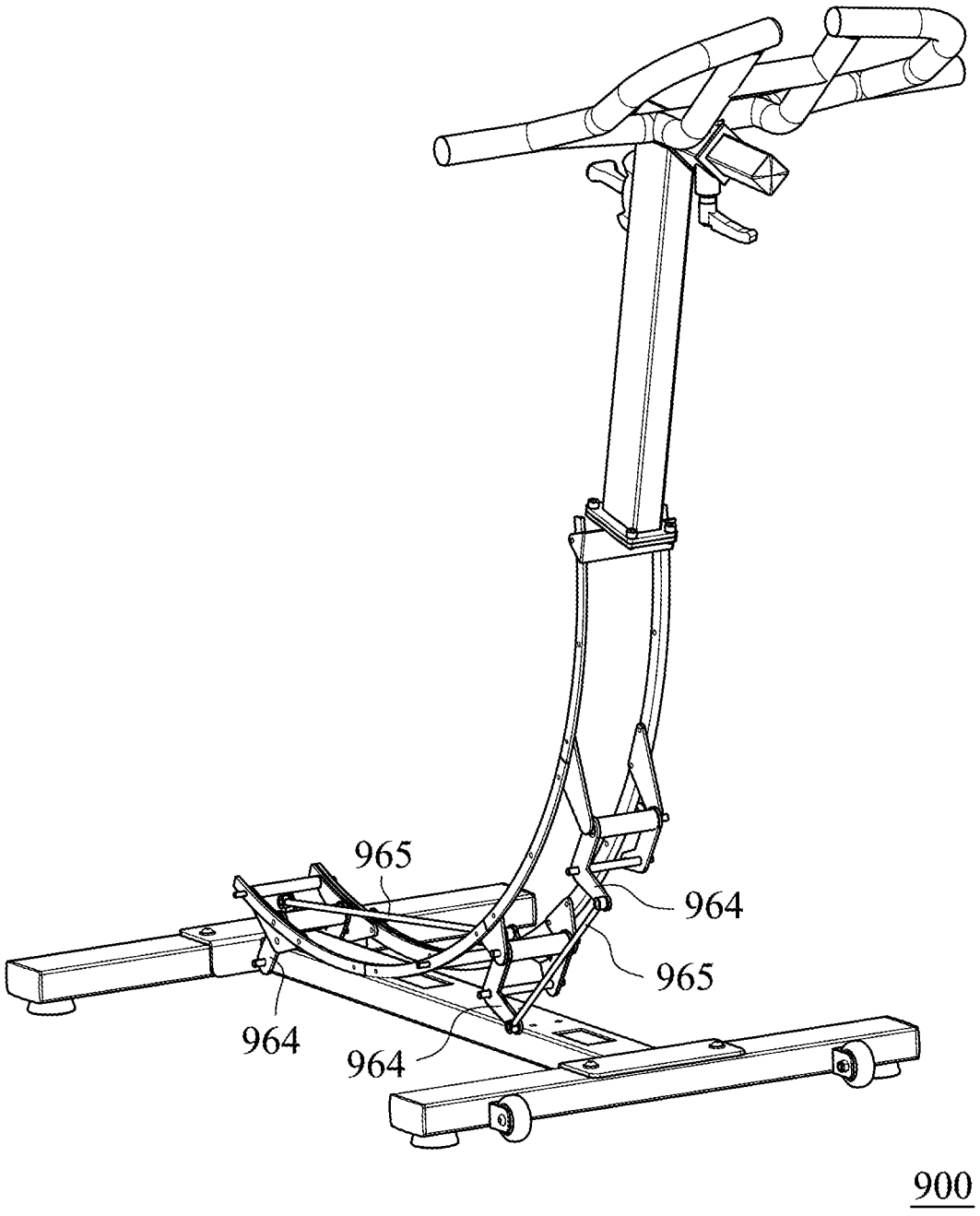
FIG. 18B shows a three dimensional view of a forcing mechanism of the high knees exercise apparatus of FIG. 18A.

FIG. 18A is a three dimensional view of a high knees exercise apparatus 900 according to still another embodiment of the present disclosure. FIG. 18B shows a three dimensional view of a forcing mechanism 961 of the high knees exercise apparatus 900 of FIG. 18A. In FIGS. 18A and 18B, the resistance adjusting device of the high knees exercise apparatus 900 includes a forcing mechanism 961 and a controlling member 963, wherein the forcing mechanism 961 is connected to the slide rails 920*a*, 920*b* for adjusting an embedded position between the magnet bases 952 and the conductive member 951, and the controlling member 963 is connected to the forcing mechanism 961.

In detail, the forcing mechanism 961 includes a plurality of operating assemblies 964 and a plurality of linkage members 965, wherein each of the operating assemblies 964 is connected to and linked up with each other via each of the linkage members 965. In FIGS. 18A and 18B, the forcing mechanism 961 includes three operating assemblies 964 and two linkage members 965.

Figure 19A:
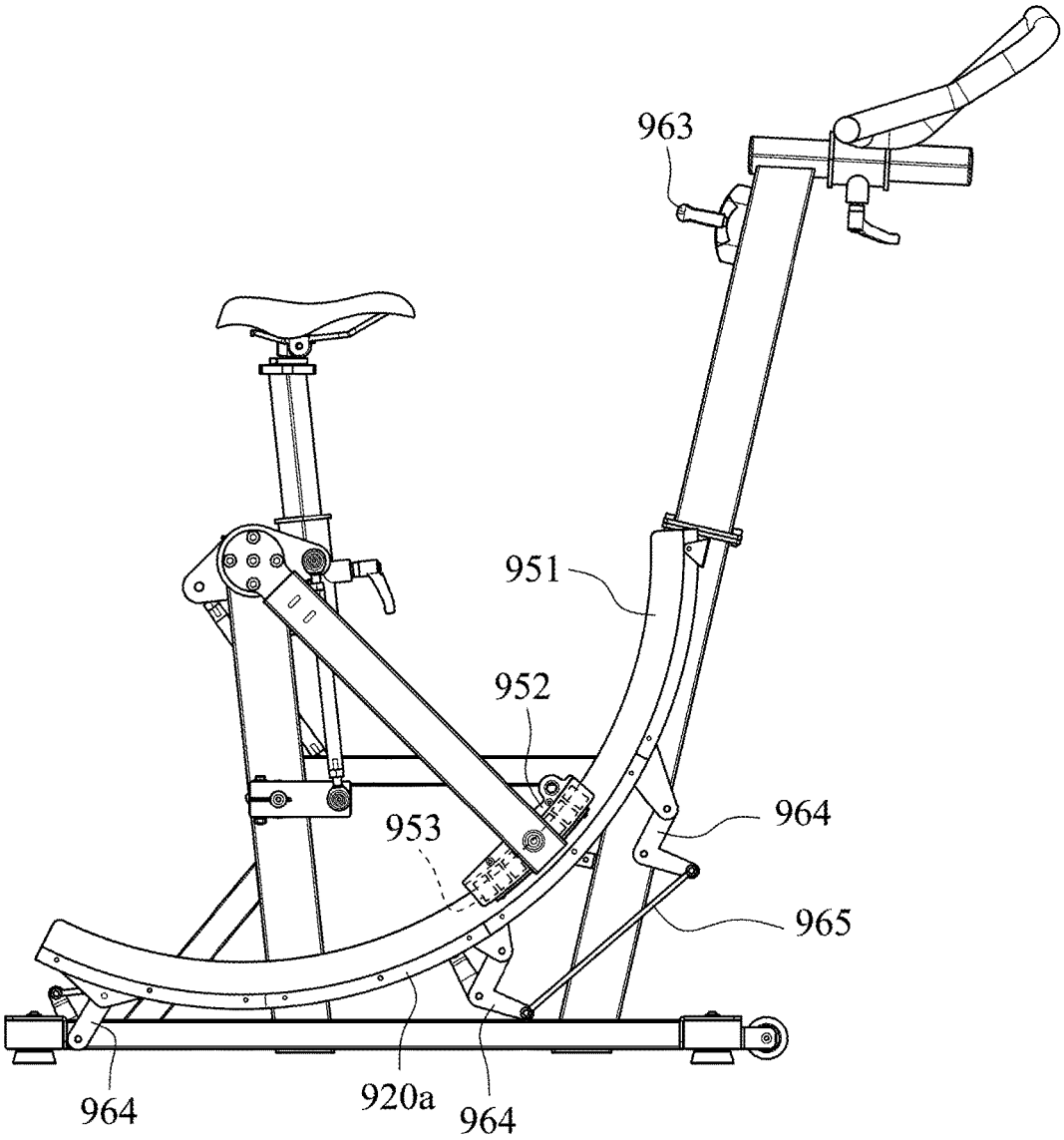
FIG. 19A is schematic views of one using states of the high knees exercise apparatus of FIG. 18A.
Figure 19B:
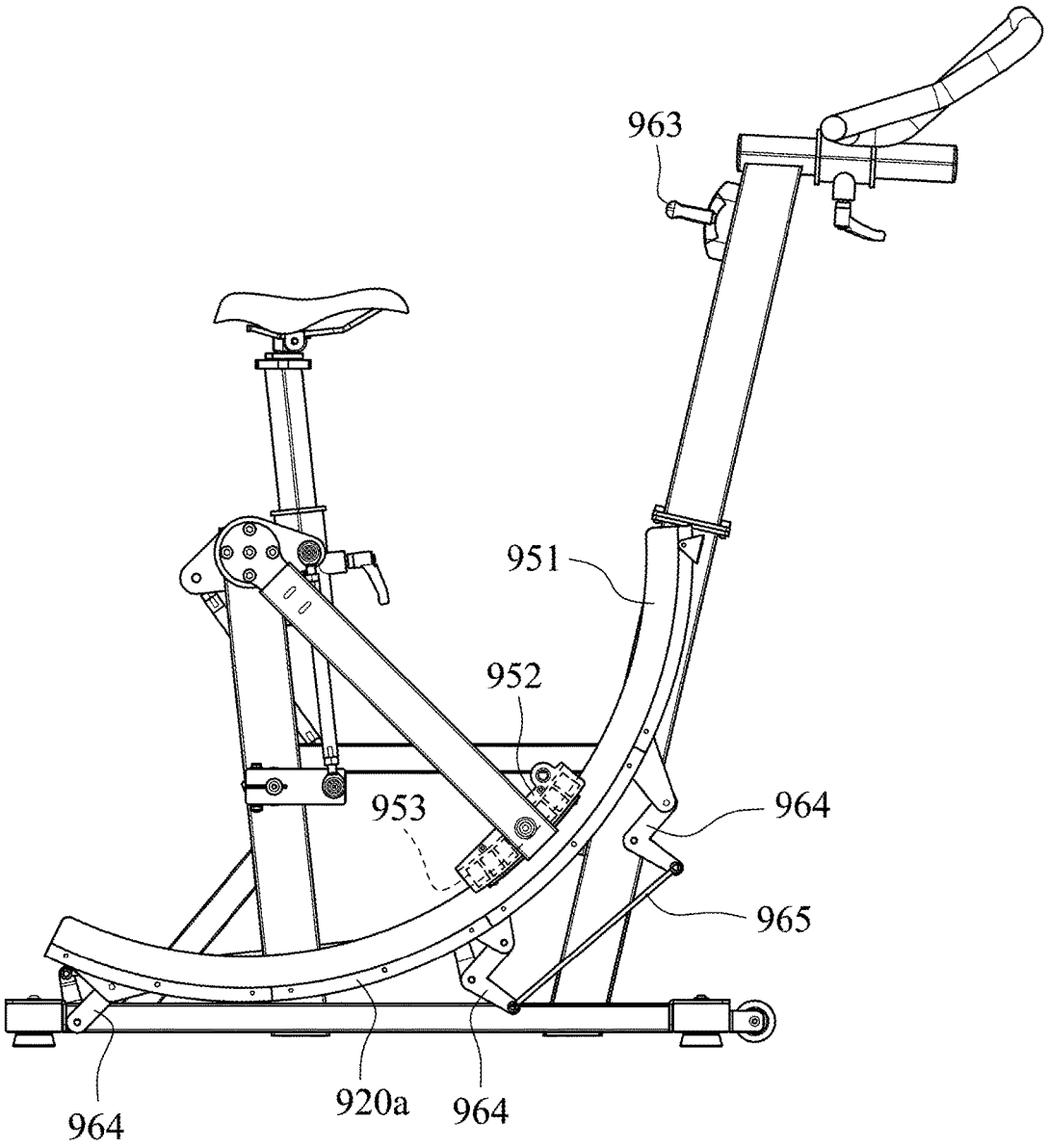
FIG. 19B is schematic views of the other using states of the high knees exercise apparatus of FIG. 18A.

FIG. 19A and FIG. 19B are schematic views of two using states of the high knees exercise apparatus 900 of FIG. 18A. In FIG. 19A, the adjacent area of the magnets 953 and the conductive member 951 is largest, so that the high knees exercise apparatus 900 can provide the maximum of the magnetic resistance during driving. In FIG. 19B, when the user pulls the controlling member 963, one of the operating assemblies 964 is moved, and other operating assemblies 964 are linked up via the linkage members 965. Therefore, the slide rails 920*a*, 920*b* can be moved. The conductive members 951 disposed on the slide rail 920*a* can also be moved, that is, the relative position (adjacent area) between the surface of the magnets 953 in the magnet base 952 and the surface of the conductive member 951 can be changed, and the magnetic resistance is adjusted (decreased).

Figure 20:
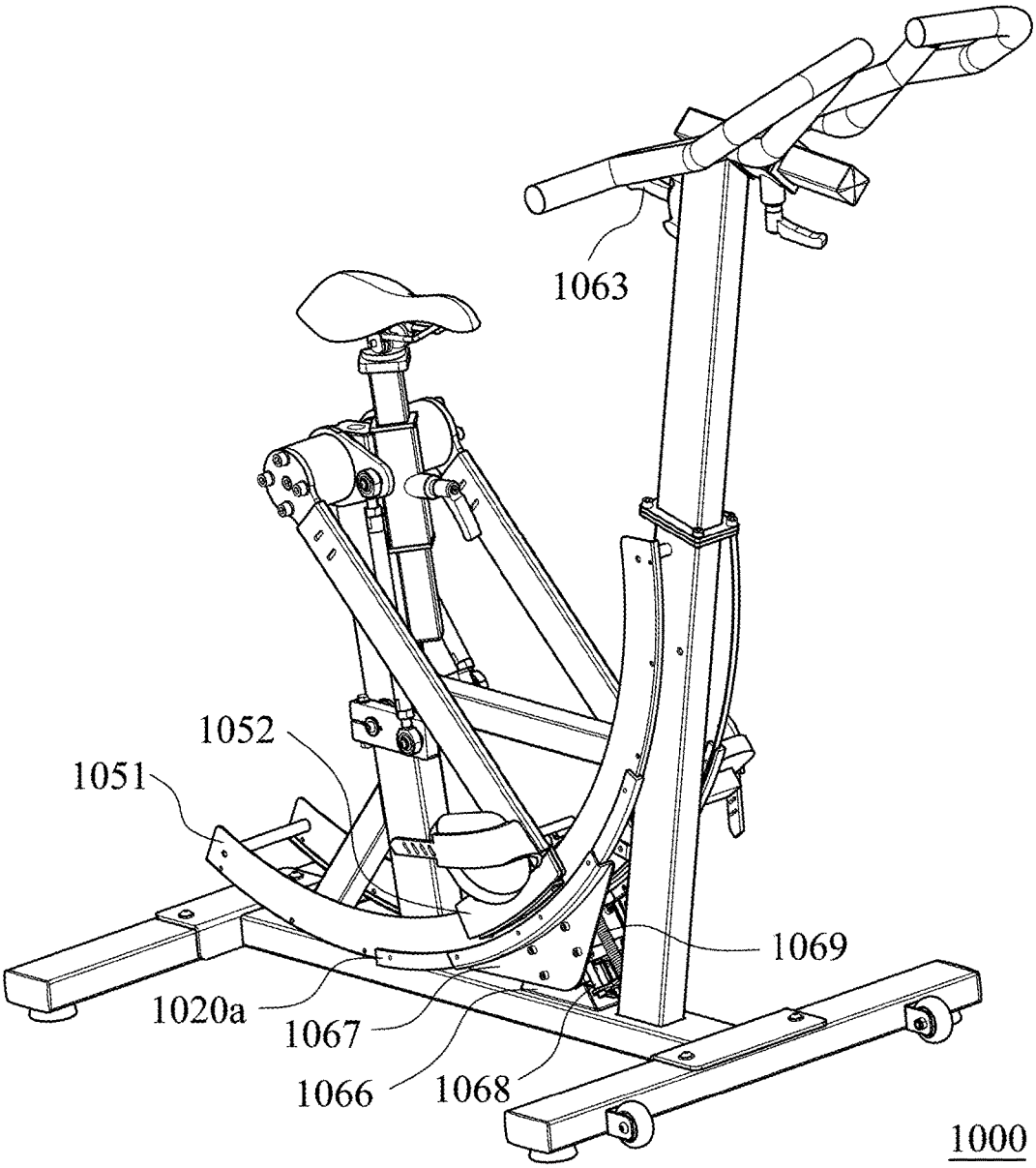
FIG. 20 is a side view of a high knees exercise apparatus according to further another embodiment of the present disclosure.

FIG. 20 is a side view of a high knees exercise apparatus 1000 according to further another embodiment of the present disclosure. In FIG. 19, the resistance adjusting device of the high knees exercise apparatus 1000 includes a forcing mechanism 1061 and a controlling member 1063, wherein the forcing mechanism 1061 is connected to the slide rails 1020*a* for adjusting an embedded position between the magnet bases 1052 and the conductive member 1051, and the controlling member 1063 is connected to the forcing mechanism 1061.

In detail, the forcing mechanism 1061 includes a forcing base 1066, a linkage member 1067, at least one operating rod 1068 and a restoring member 1069, wherein the linkage member 1067 is movably connected to the forcing base 1066, at least one operating rod 1068 and a restoring member 1069 are located in the forcing base 1066, and the linkage member 1067 is moved by at least one operating rod 1068 and a restoring member 1069 (such as a spring). The operating rod 1068 can be driven by electric device (such as motor) or non-electric device (calm wheel) for pushing or pulling the linkage member 1067 to move the slide rails 1020*a*. When the operating rod 1068 pushes the slide rails 1020*a*, the restoring member 1069 would be compressed. The restoring member 1069 can provide a restoring force for pulling the linkage member 1067 and the slide rails 1020*a* back. Therefore, the relative position between the surface of the magnets (not be labeled) in the magnet base 1052 and the surface of the conductive member 1051 which is disposed on the slide rails 1020*a* can be changed, and the magnetic resistance is adjusted.

Figure 21A:
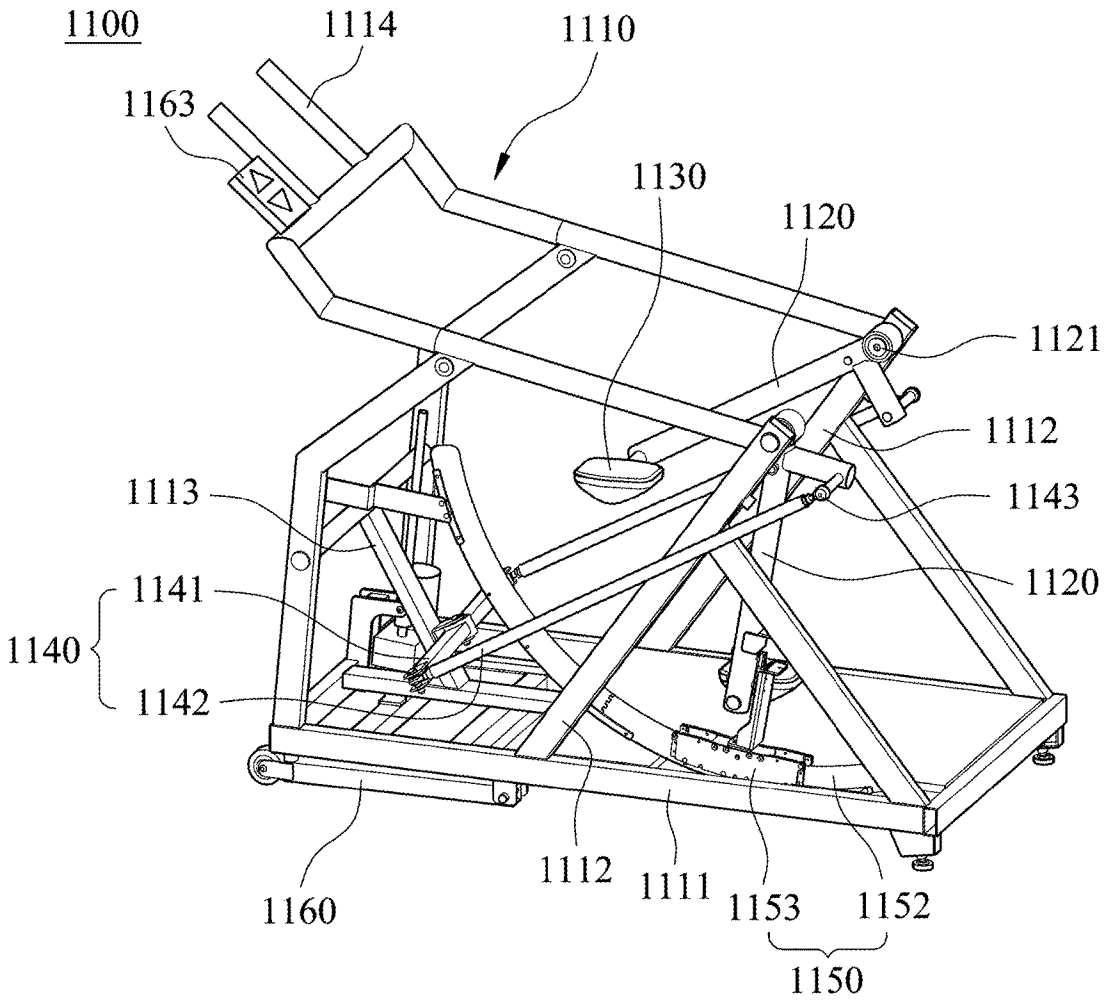
FIG. 21A is a three dimensional view of an exercise apparatus 1100 according to another embodiment of the present disclosure.
Figure 21B:
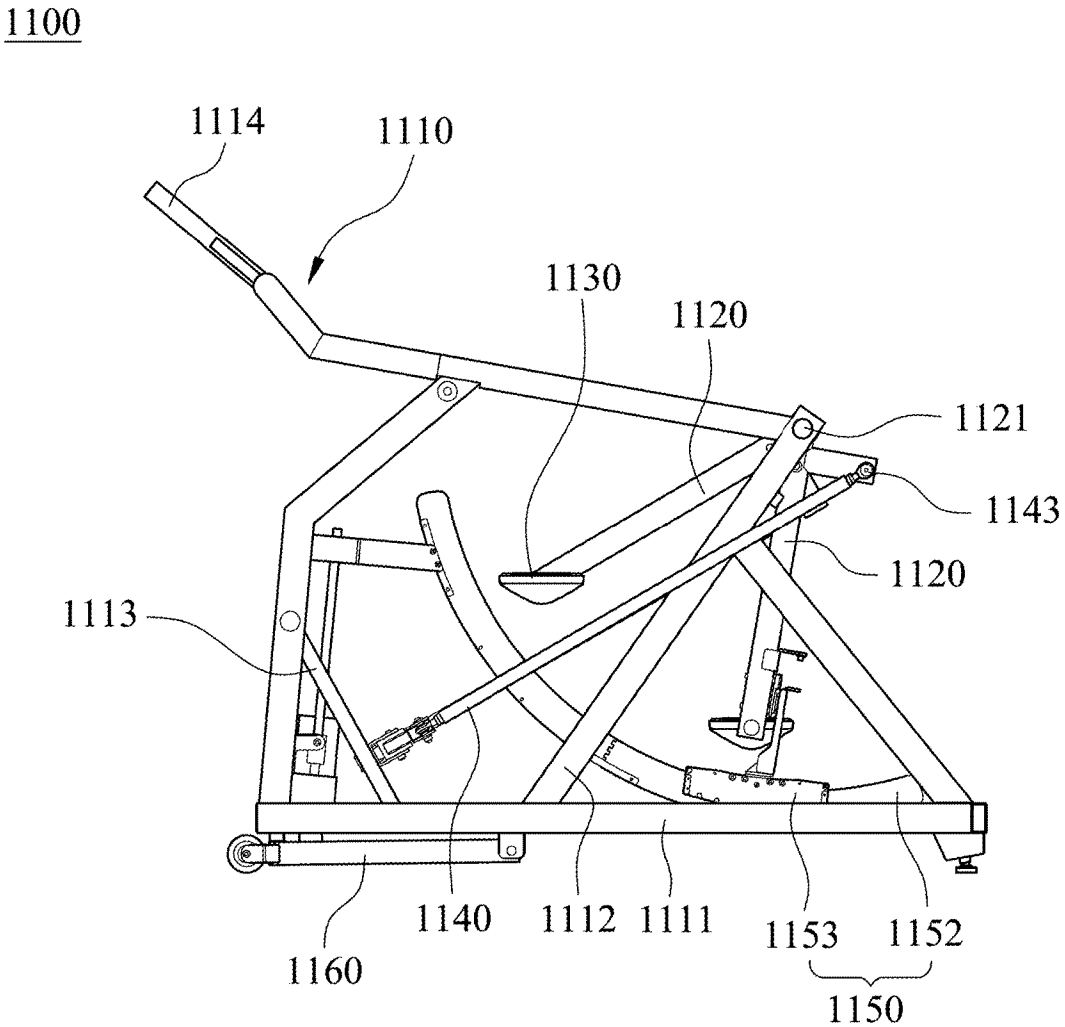
FIG. 21B is a side view of the exercise apparatus of FIG. 21A.

FIG. 21A is a three dimensional view of an exercise apparatus 1100 according to another embodiment of the present disclosure, and FIG. 21B is a side view of the exercise apparatus 1100 of FIG. 21A. In FIGS. 21A and 21B, the exercise apparatus 1100 includes a frame body 1110, two driving levers 1120, two pedals 1130, a linking device 1140 and at least one resistance device 1150. The two driving levers 1120 are pivotally connected to two side of the frame body 1110, respectively. The two pedals 1130 are connected to the two driving levers 1120, respectively. The linking device 1140 is connected the two driving levers 1120 so as to lead the two driving levers 1120 to be swung reciprocally and simultaneously. The at least one resistance device 1150 is driven by one of the two driving levers 1120 so as to generate a magnetic resistance. Therefore, the user can stand on the two pedals 1130 during operating the exercise apparatus 1100, and can reciprocally swing the two driving levers 1120 for exercising and training.

In detail, the frame body 1110 includes a bottom base 1111 and two side frames 1112, wherein the bottom base 1111 is for putting on the ground or a plane to be disposed, and the two side frames 1112 are connected to two side of the bottom base 1111 and extend uptoward. Moreover, the frame body 1110 can further include a front frame 1113 and a handle 1114. In FIG. 21A, the front frame 1113 can be a T-shaped frame which connects the bottom base 1111 and the two side frames 1112. The handle 1114 is connected to the two side frames 1112 and extends toward the front of the exercise apparatus 1100. Therefore, the entire frame body 1110 is deemed as a frame, and the exercise apparatus 1100 is a frame like exercise apparatus.

The two driving levers 1120 are pivotally connected to the two side frames 1112, respectively, wherein each of the driving levers 1120 is pivotally connected to each of the two side frames 1112 via a pivoting axle 1121.

The two pedals 1130 are connected to the two driving levers 1120, respectively. Therefore, the user can stand thereon and swing the two driving levers 1120 for doing high knee exercise.

The linking device 1140 is connected the two driving levers 1120 so as to lead the two driving levers 1120 to be swung reciprocally and simultaneously. In detail, according to the embodiment of FIG. 21A, the linking device 1140 includes a linking shaft 1141 and two side shafts 1142. The linking shaft 1141 is pivotally connected to the frame body 1110, specifically, the linking shaft 1141 is pivotally connected to the front frame 1113 of the frame body 1110 according to the embodiment of FIG. 21A. One end of each of the side shafts 1142 is pivotally connected to each of two ends of the linking shaft 1141, and the other end of each of the side shafts 1142 is linked with each of the two driving levers 1120, wherein each of the side shafts 1142 is linked with each of the two driving levers 1120 via an universal joint 1143. However, the detailed element of the linking device of the present invention will not be limited thereto.

Figure 21C:
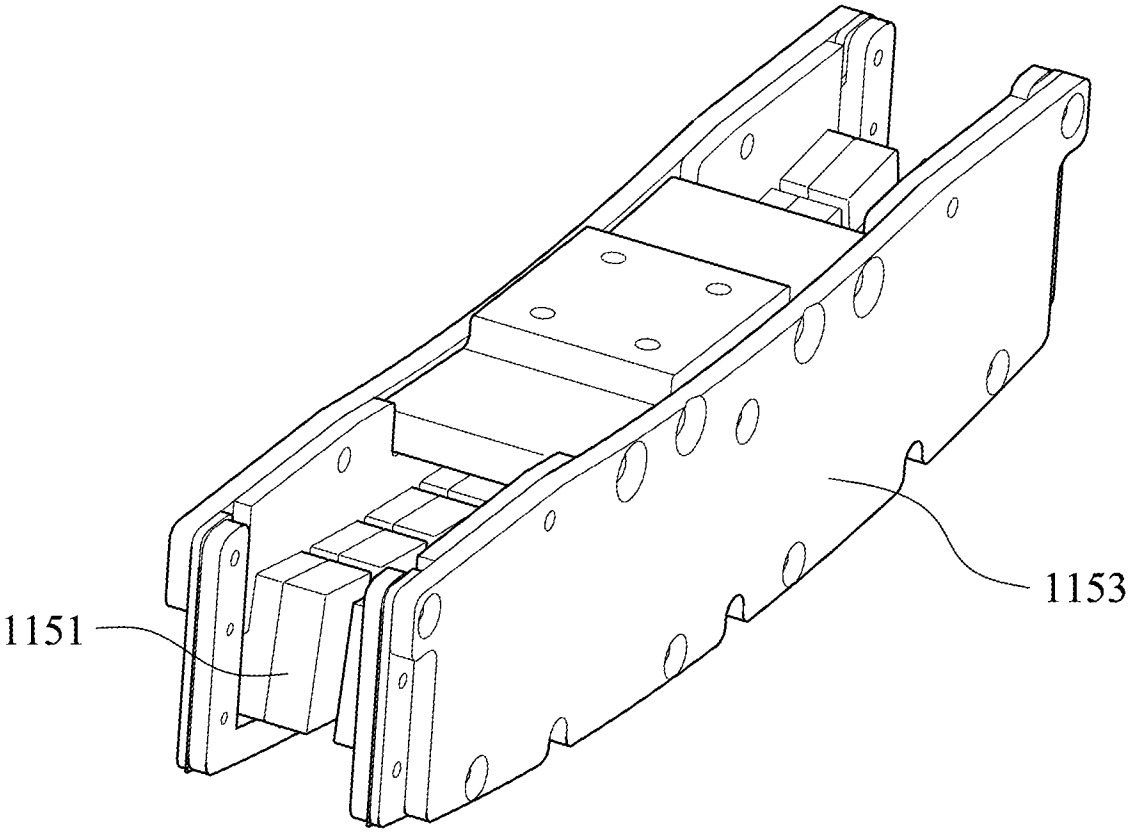
FIG. 21C is a schematic view of a magnet base according to the embodiment of FIG. 21A.
Figure 21D:
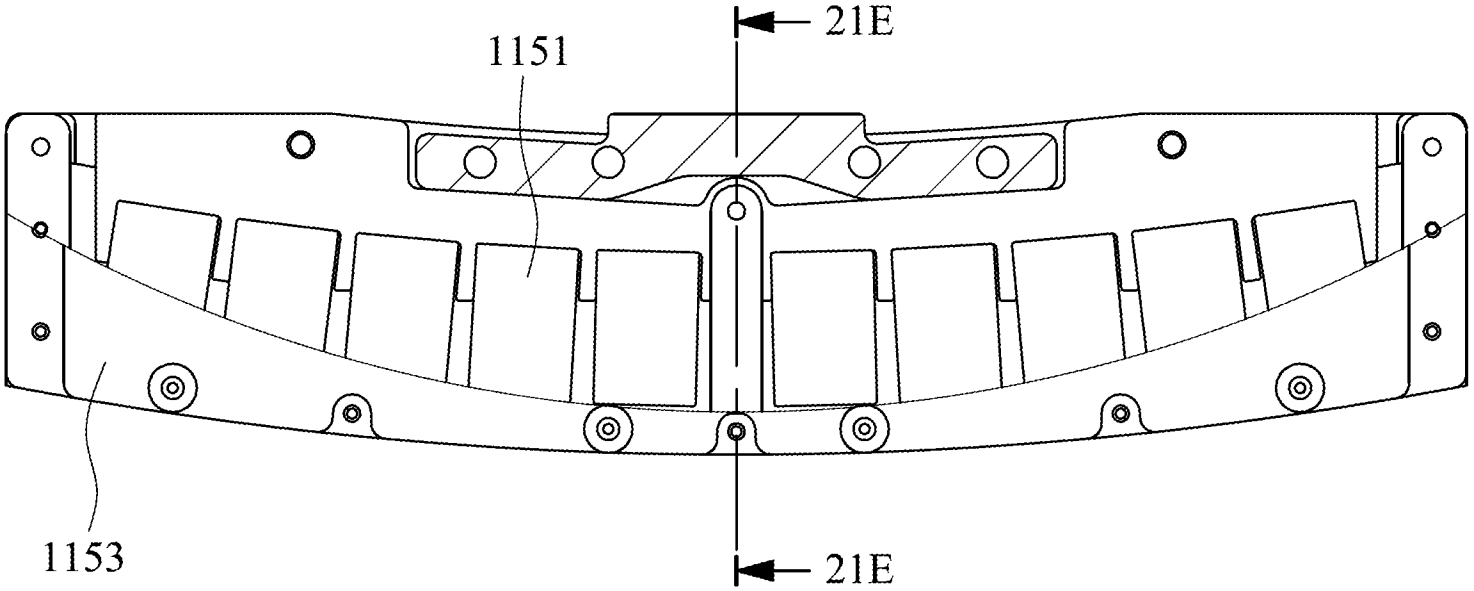
FIG. 21D is a schematic view of a first magnetic resistance element in the magnet base according to the embodiment of FIG. 21A.

In FIG. 21A, the exercise apparatus 1100 includes a resistance device 1150, wherein the resistance device 1150 can be driven by one of the driving levers 1120 so as to generate the magnetic resistance. FIG. 21C is a schematic view of a magnet base 1153 according to the embodiment of FIG. 21A, FIG. 21D is a schematic view of a first magnetic resistance element 1151 in the magnet base 1153 according to the embodiment of FIG. 21A, FIG. 21E is a cross-sectional view along line 21E-21E of FIG. 21D. In FIG. 21C, FIG. 21D and FIG. 21E, the resistance device 1150 includes the magnet base 1153, the first magnetic resistance element 1151 and a second magnetic resistance element 1152. The magnet base 1153 is connected to the one of the two driving levers 1120. The first magnetic resistance element 1151 is disposed on the magnet base 1153. The second magnetic resistance element 1152 is disposed on the frame body 1110, specifically, the second magnetic resistance element 1152 can be disposed on the bottom base 1111 of the frame body 1110 and adjacent to the first magnetic resistance element 1151. At least one of the first magnetic resistance element 1151 and the second magnetic resistance element 1152 is at least one magnet (according to the embodiment of FIG. 21A, the first magnetic resistance element 1151 is at least one magnet being a permanent magnet), the other one of the first magnetic resistance element 1151 and the second magnetic resistance element 1152 is made of copper, silver or aluminum (according to the embodiment of FIG. 21A, the second magnetic resistance element 1152 is made of copper, silver, aluminum or alloys thereof). The magnet base 1153 is driven by the driving lever 1120 so as to move the first magnetic resistance element 1151 relative to the second magnetic resistance element 1152 for generating the magnetic resistance. According to the Lenz's law, the magnetic resistance can be generated by the relative movement between the first magnetic resistance element 1151 and the second magnetic resistance element 1152 without electrical energy or other external energy. The magnetic resistance is generated directly by the user, so that the exercise apparatus 1100 would not provide inertia during operating and the security thereof can be enhanced. Moreover, in FIGS. 21D and 21E, the first magnetic resistance element 1151 is a plurality of magnets which are disposed on two inner sides of the magnet base 1153 equally. A distance D between each two first magnetic resistance elements 1151 (magnets) disposed relative to each other is greater or equal to 4 mm. In FIG. 21A, the second magnetic resistance element 1152 according to the present disclosure is a copper sheet being curve-shaped along the swing track of the driving levers 1120. The second magnetic resistance element 1152 is disposed between the first magnetic resistance element 1151 (magnets) on the two inner sides of the magnet base 1153, and by the arrangement of the distance D, the second magnetic resistance element 1152 is adjacent to but not contact to the first magnetic resistance element 1151. Therefore, the noise during operating can be avoided, and the wear of the elements can be also avoided.

Figure 21F:
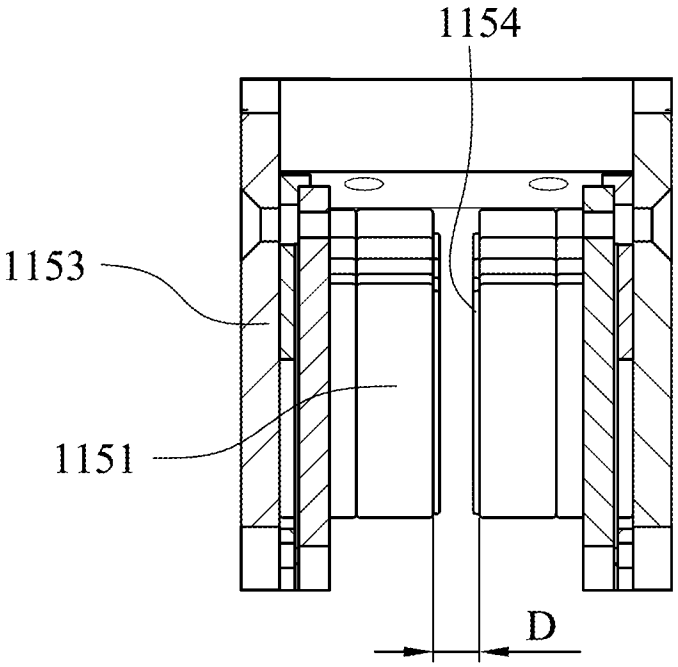
FIG. 21F is a cross-sectional view of another resistance device of another example according to the embodiment of FIG. 21A.
Figure 21E:
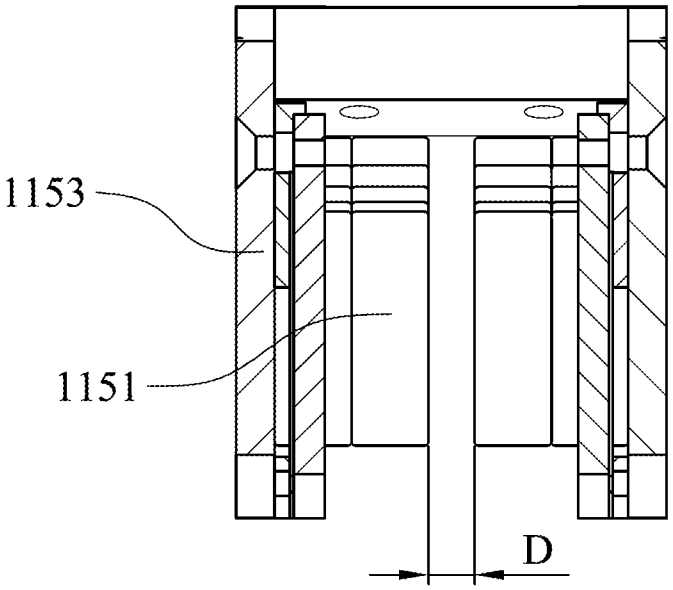
FIG. 21E is a cross-sectional view along line 21E-21E of FIG. 21D.

Moreover, FIG. 21F is a cross-sectional view of another resistance device 1150 of another example according to the embodiment of FIG. 21A. In FIG. 21F, the resistance device 1150 can further include a friction matrix 1154 disposed between the first magnetic resistance element 1151 and the second magnetic resistance element 1152. In detail, the friction matrix 1154 can be a soft friction plate and is disposed on the first magnetic resistance element 1151, so that the first magnetic resistance element 1151 and the second magnetic resistance element 1152 would not contact against each other directly which might damage the lifetime of the elements.

Figure 22B:
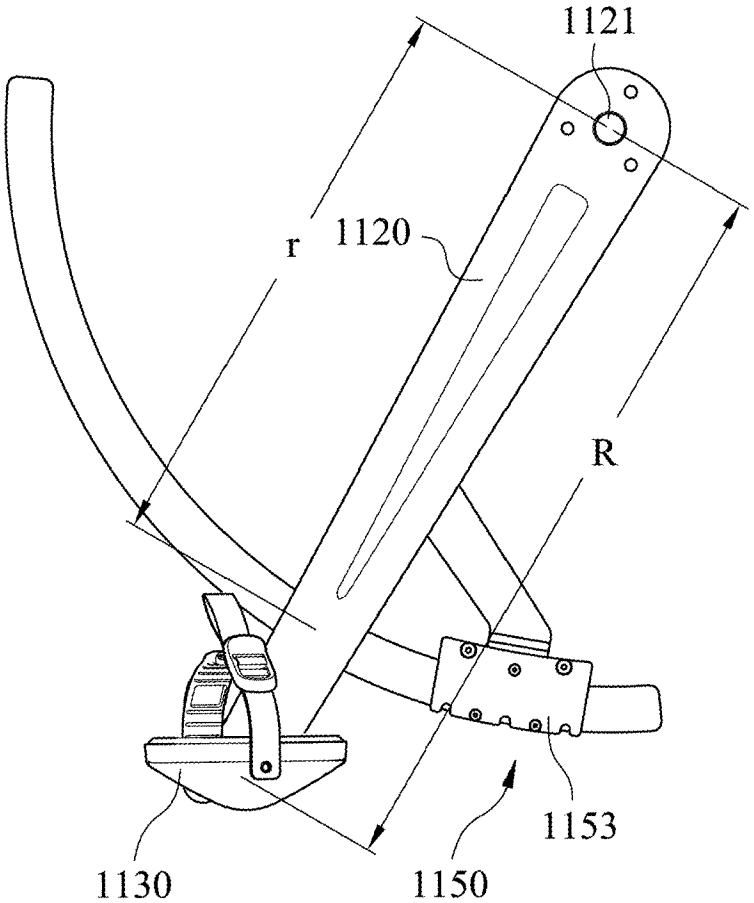
FIG. 22B is a schematic view of another relative position of the pedal and the resistance device according to the embodiment of FIG. 21A.
Figure 22A:
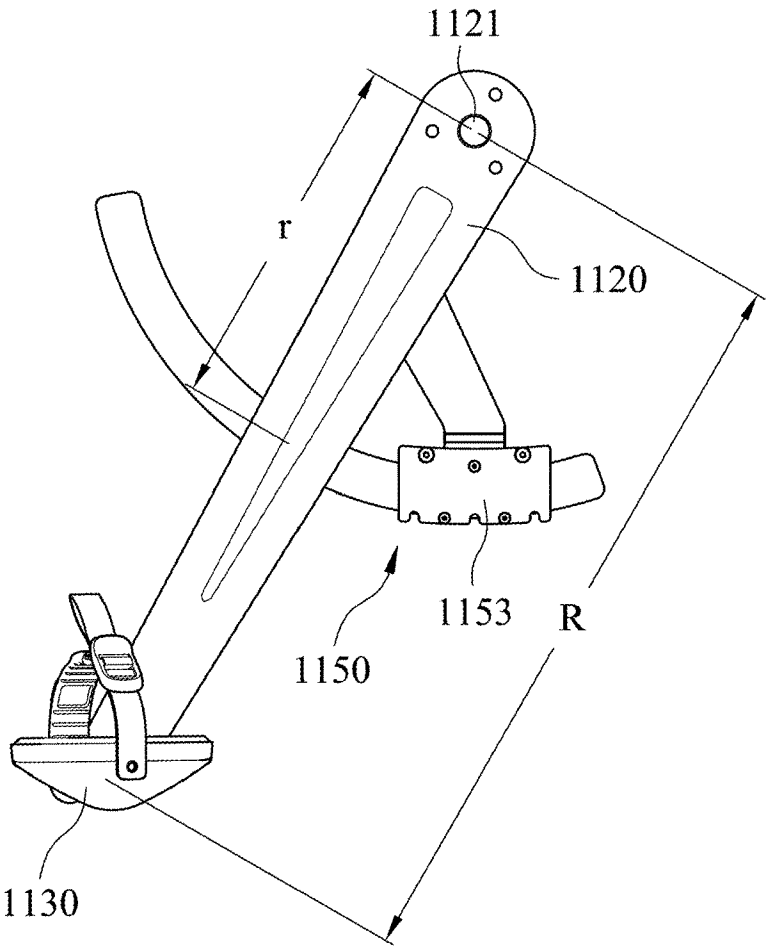
FIG. 22A is a schematic view of a relative position of the pedal and the resistance device according to the embodiment of FIG. 21A.
Figure 22C:
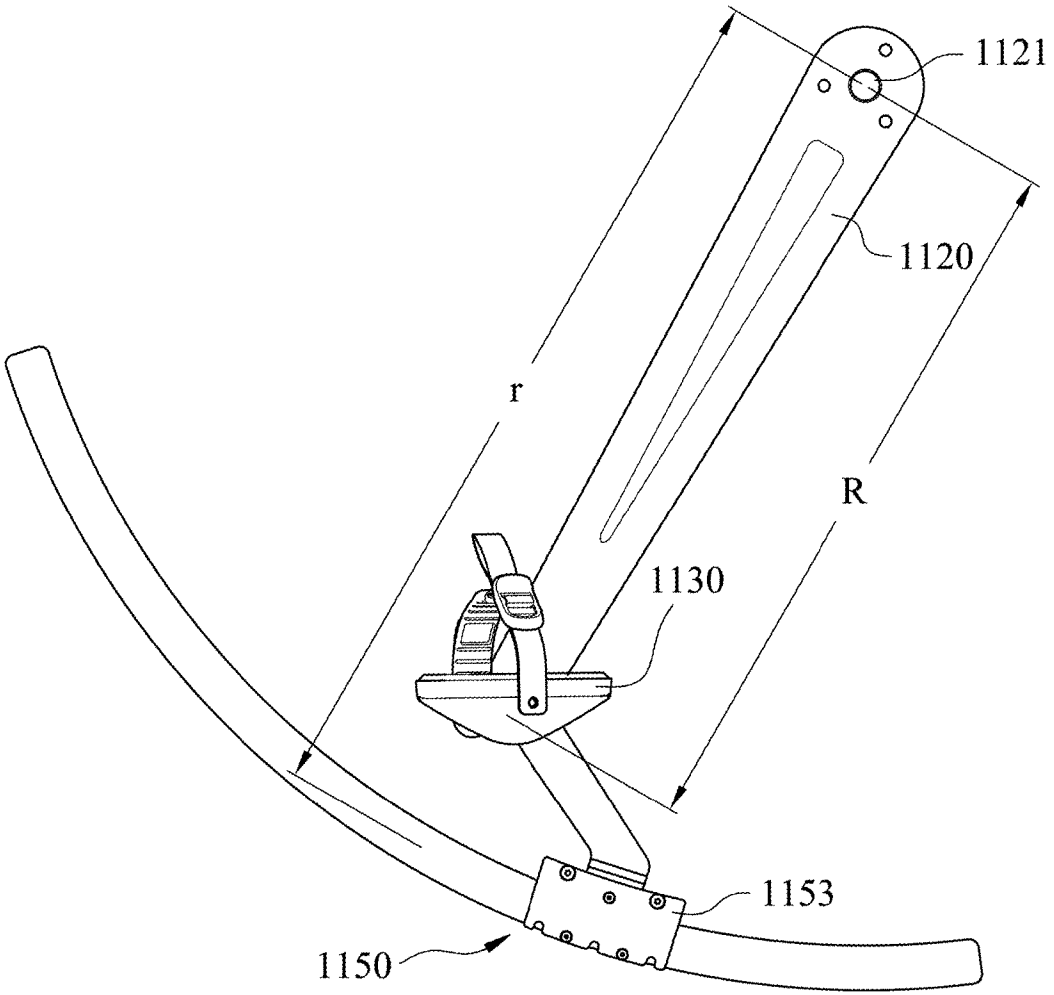
FIG. 22C is a schematic view of another relative position of the pedal and the resistance device according to the embodiment of FIG. 21A.

FIGS. 22A, 22B and 22C are three schematic views of three different relative positions of the pedal 1130 and the resistance device 1150 according to the embodiment of FIG. 21A. FIG. 22A, when a central distance between the pivoting axle 1121 of each of the driving lever 1120 and the pedal 1130 connected the driving lever 1120 is R, and a central distance between the pivoting axle 1121 of the driving lever 1120 which is connected to the magnet base 1153 and the resistance device 1150 is r, the following relationship is satisfied:

$$r \geq 0.5\ R.$$

Thus, when the user drives the driving levers 1120 and operates the resistance device 1150 to generate the magnetic resistance, the effective linear velocity can be obtained. In FIG. 22B, the following relationship can be satisfied:

$$r \geq 0.8\ R.$$

Thus, the arrangement can promote the generation of the magnetic resistance when the user drives the driving levers 1120. In FIG. 22C, the following relationship can be satisfied:

$$r \geq R.$$

Thus, the arrangement can further promote the generation of the magnetic resistance when the user drives the driving levers 1120. In detail, the arrangement of FIG. 21A is corresponding to FIG. 22C, but is not limited thereto. Moreover, in practical production and reasonable size, R>400 mm.

Figure 23A:
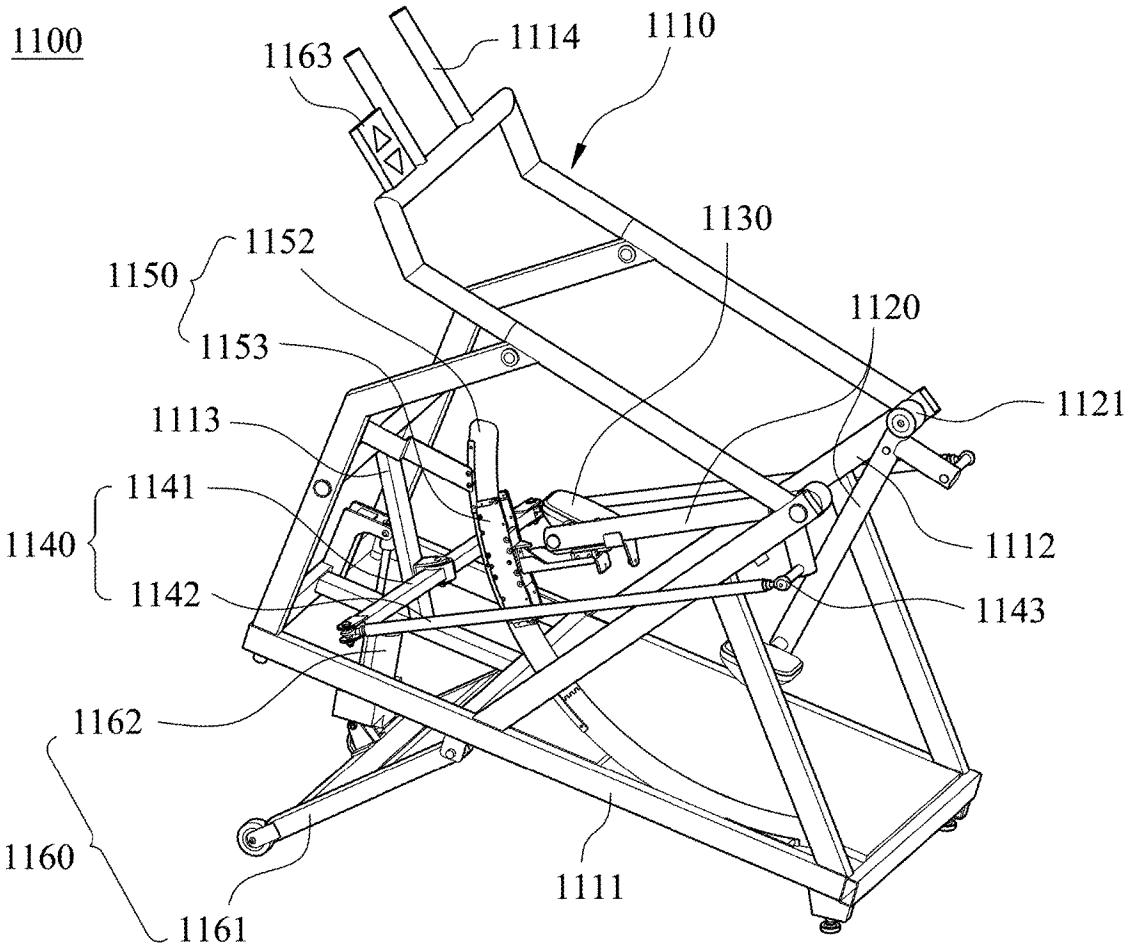
FIG. 23A is a three dimensional view of the angle adjusting mechanism in an unfold state according to the embodiment of FIG. 21A.
Figure 23B:
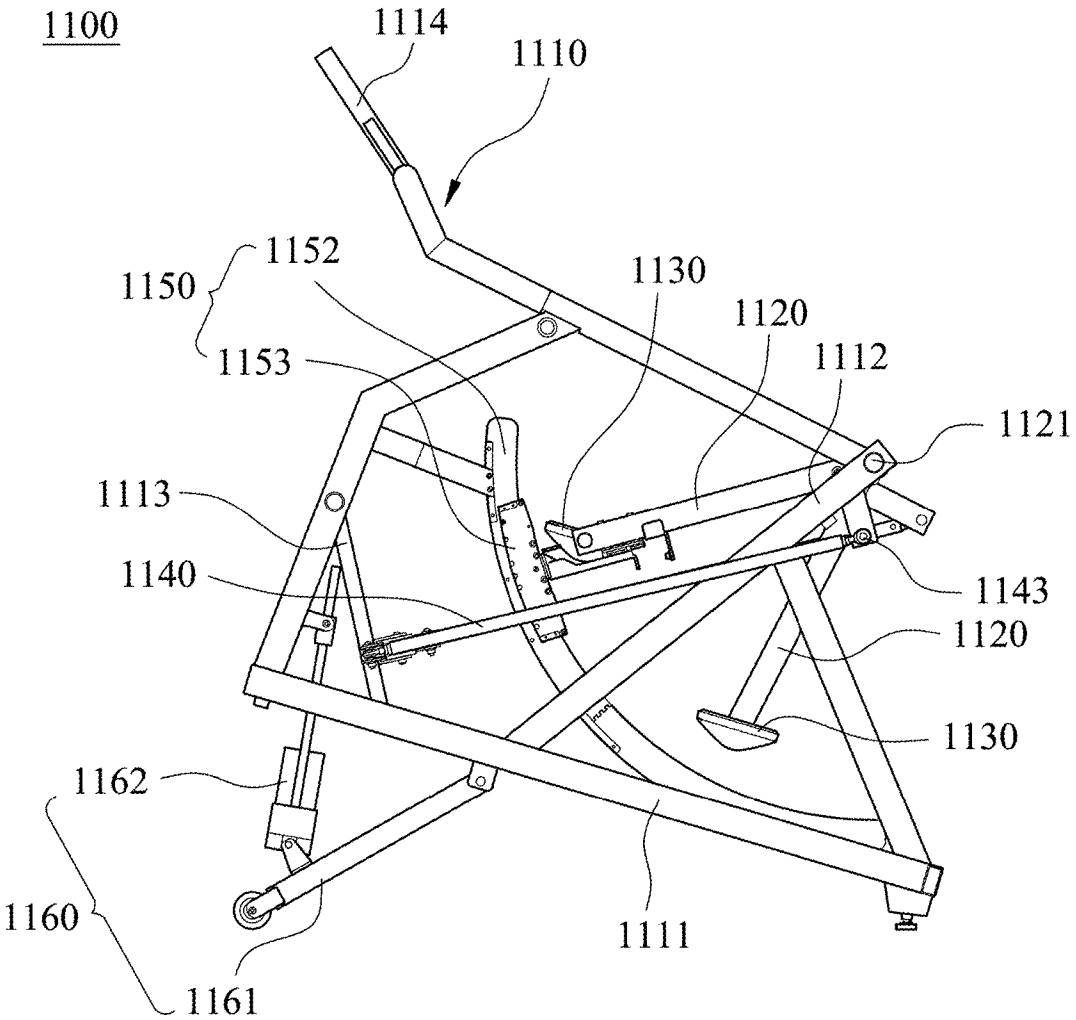
FIG. 23B is a side view of the angle adjusting mechanism of FIG. 23A.

Furthermore, the exercise apparatus 1100 according to the embodiment of FIG. 21A further include an angle adjusting mechanism 1160 for forming an angle between the bottom base 1111 and the ground. FIG. 23A is a three dimensional view of the angle adjusting mechanism 1160 in an unfold state according to the embodiment of FIG. 21A. FIG. 23B is a side view of the angle adjusting mechanism 1160 of FIG. 23A. In detail, the angle adjusting mechanism 1160 includes a supporting base 1161 and a lifting mechanism 1162. The supporting base 1161 is pivotally connecting one side of the bottom base 1111 face to the ground. The lifting mechanism 1162 connects the supporting base 1161 and the bottom base 1111 so as to unfold the supporting base 1161 from the bottom base 1111. Due to the arrangement of the linking relationship of the two driving levers 1120 and for securing the balance when the user stands on the pedals 1130, when the exercise apparatus 1100 is in a static state, the two driving levers 1120 are parallel to each other and there is a balancing angle between each of the driving levers 1120 and an virtual line which is vertical to a ground; in other words, the user's feet can swing in opposite directions simultaneously during operating the exercise apparatus, and it is favorable for the user fully stretch themselves as possible. Further, the balancing angle can be adjusted by the angle adjusting mechanism 1160 so as to change the user's posture for training different parts of body. The lifting mechanism 1162 can be an elevator motor which can be manually controlled via the switch 1163, wherein the switch 1163 is electrically connected to the lifting mechanism 1162, and the connecting wire is located in the frame body 1110 which is not shown in the figure. Moreover, the lifting mechanism 1162 also can be electrically controlled. The elevator motor and the controlling way thereof is common knowledge in the art of the present disclosure, and will not describe detailed herein.

Figure 24B:
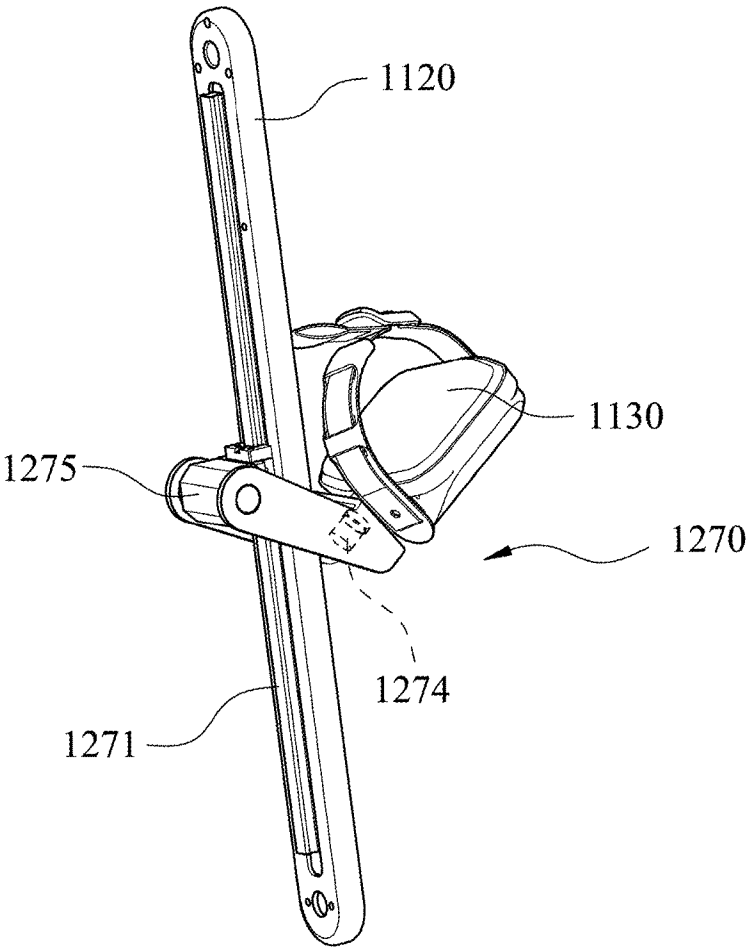
FIG. 24B is a three dimensional view of the pedal adjusting mechanism in another state of FIG. 24A.
Figure 24A:
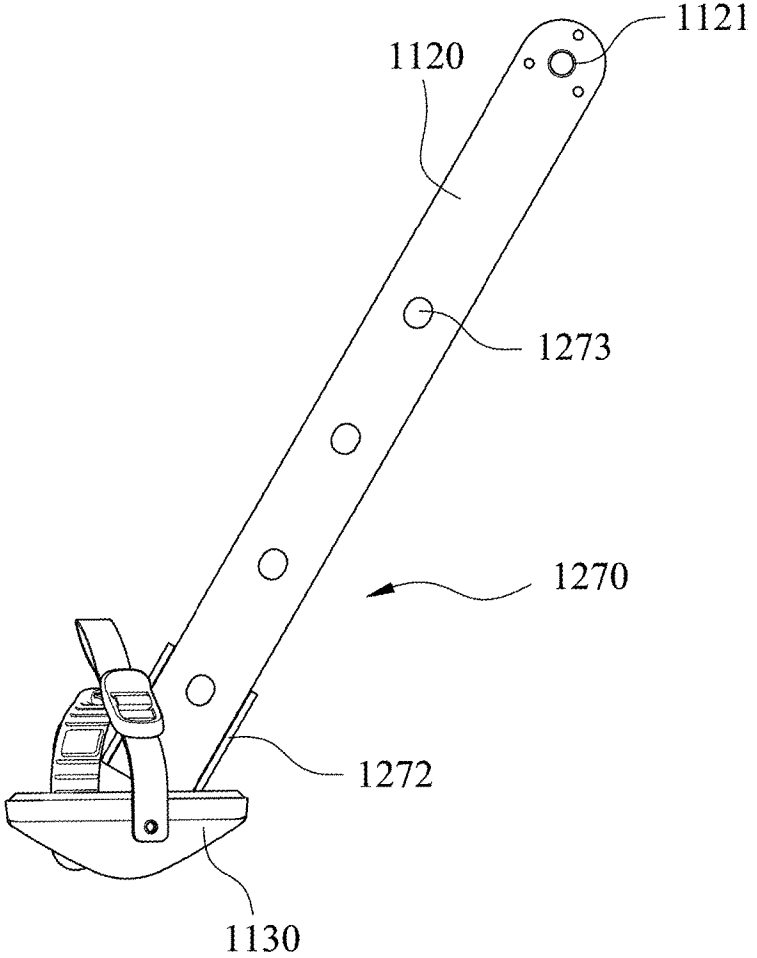
FIG. 24A is a plan view of a pedal adjusting mechanism in one state according to another embodiment the exercise apparatus of the present disclosure.
Figure 24D:
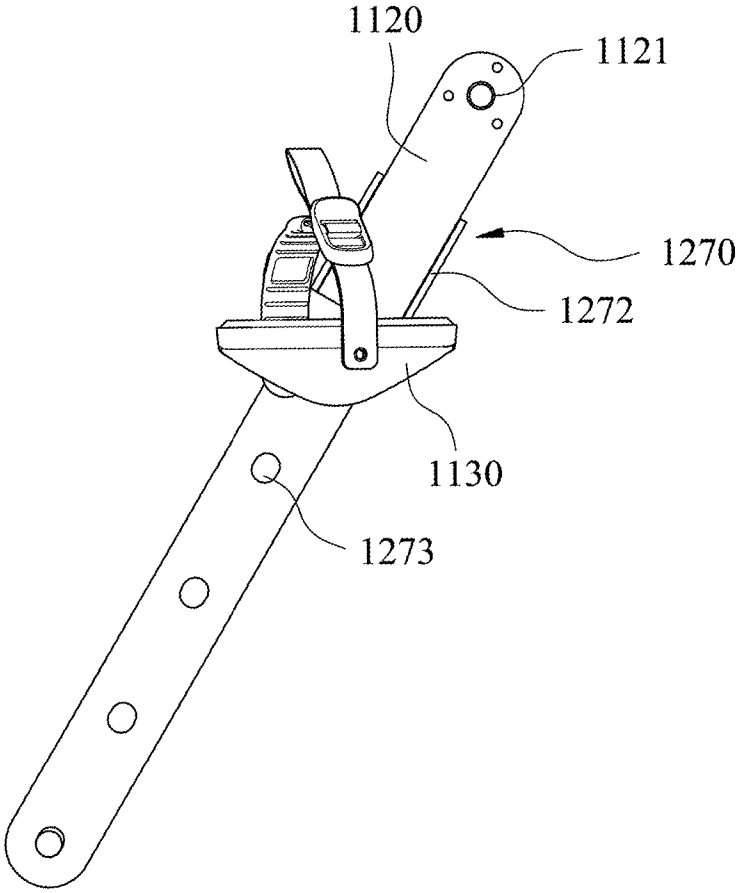
FIG. 24D is another plan view of the pedal adjusting mechanism in yet another state of FIG. 24A.
Figure 24C:
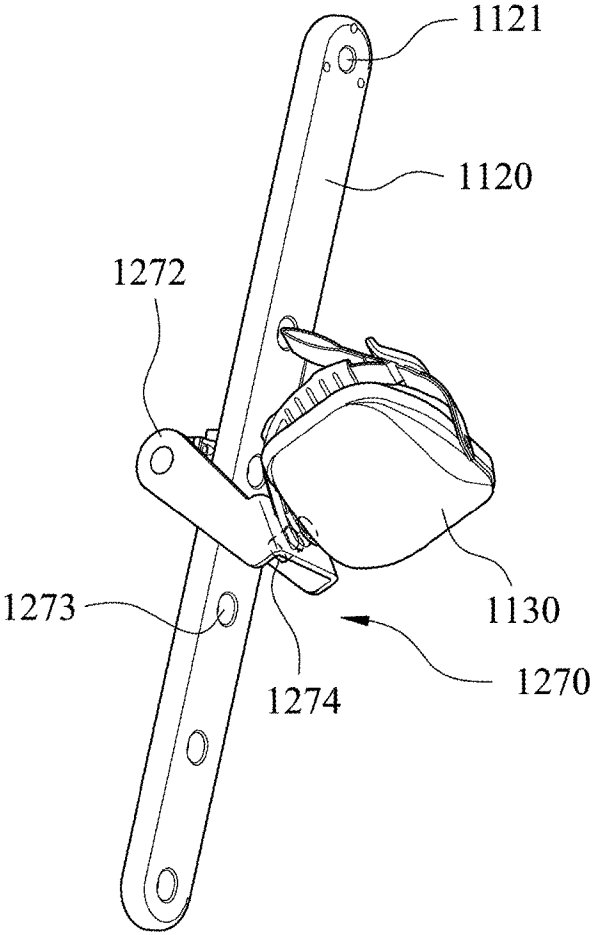
FIG. 24C is another three dimensional view of the pedal adjusting mechanism in further another state of FIG. 24A.

FIG. 24A is a plan view of a pedal adjusting mechanism 1270 in one state according to another embodiment the exercise apparatus of the present disclosure. FIG. 24B is a three dimensional view of the pedal adjusting mechanism 1270 in another state of FIG. 24A. FIG. 24C is another three dimensional view of the pedal adjusting mechanism 1270 in further another state of FIG. 24A. FIG. 24D is another plan view of the pedal adjusting mechanism 1270 in yet another state of FIG. 24A. According to the aforementioned description, by adjusting the relationship between the parameters r and R, the user can use the exercise apparatus of the present disclosure in different exercise postures. Hence, according to the embodiment in FIG. 24A, the exercise apparatus can further include two pedal adjusting mechanisms, each of the two pedal adjusting mechanisms 1270 is for adjusting a location of each of the two pedals 1130 on each of the driving levers 1120. The difference between the exercise apparatus in FIGS. 24A to 24D and the exercise apparatus 1100 in FIG. 21A is about the pedal adjusting mechanisms 1270, and the arrangements and the relationship of other elements are the same and will not describe herein.

In FIGS. 24B and 24C, the pedal adjusting mechanism 1270 includes a track 1271, a linkage member 1272, a plurality of positioning concaves 1273 and a positioning protrusion 1274. The track 1271 is disposed on one of the driving levers 1120 along an axial direction thereof. The linkage member 1272 is connected to one of the pedals 1130 and for leading the one of the pedals 1130 to move along the track 1271; in detail, according to the embodiment in FIG. 24B, a revolving axle is disposed on the linkage member 1272 which is favorable for the pedal 1130 moving along the track 1271. The positioning concaves 1273 are disposed on the driving lever 1120 along the axial direction thereof, the positioning protrusion 1274 is disposed on the linkage member for positioning in one of the positioning concaves 1273. Therefore, the user can adjust the position of the pedal 1130 on the driving lever 1120, that is, the central distance between the pivoting axle 1121 of the driving lever 1120 and the pedal 1130 R can be adjusted on demand.

Figure 25A:
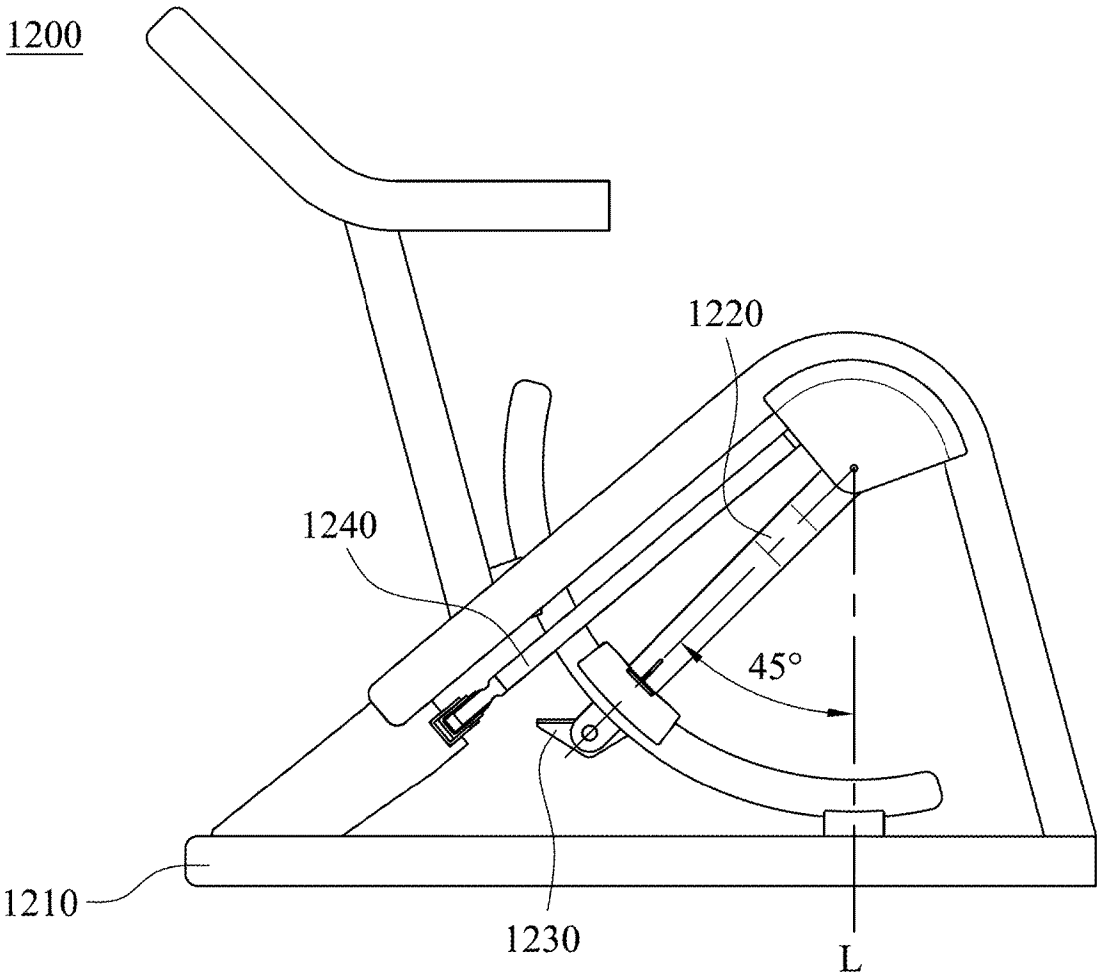
FIG. 25A is a schematic view of the exercise apparatus with the driving lever in a balancing angle 45 degrees according to another embodiment of the present disclosure.
Figure 25B:
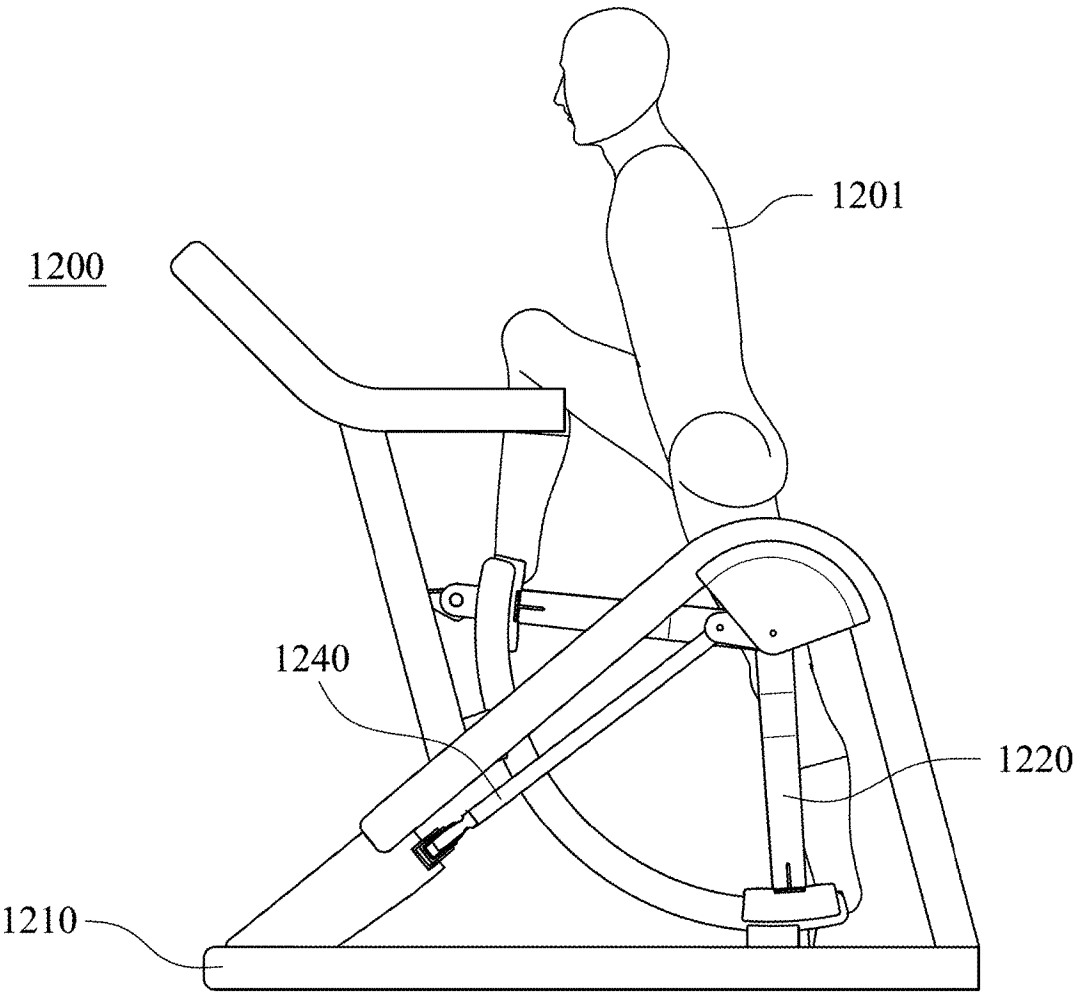
FIG. 25B is a schematic view of the exercise apparatus of FIG. 25A which is used by the user.

For describing the relationship between the balancing angle of the driving levers 1120 and the exercising postures, FIGS. 25A, 25B, 26A, 26B, 27A and 27B are provided for explaining the relationship therebetween, and in FIGS. 25A, 25B, 26A, 26B, 27A and 27B, the exercise apparatus 1200 is briefly shown, the arrangement and relationship of the elements of the exercise apparatus 1200 are the same with the exercise apparatus 1100 in FIG. 21A, except for the shape of the frame body 1210 and connecting relationship of partial elements. In detail, FIG. 25A is a schematic view of the exercise apparatus 1200 with the driving lever 1220 in a balancing angle 45 degrees according to another embodiment of the present disclosure. FIG. 25B is a schematic view of the exercise apparatus 200 of FIG. 25A which is used by the user 1201. Due to the driving levers 1220 are linked with each other via a linking device 1240, thus, when the exercise apparatus 1200 is in a static state, the two driving levers 1220 are parallel to each other (that is, the two pedals 1230 are at the same height) and there is the balancing angle being 45 degrees between each of the driving levers 1220 and an virtual line L which is vertical to the ground. In FIG. 25B, after the user 1201 stands on the pedals 1230 at the balancing angle 45 degrees, one of the user's feet can rise one driving lever 1220 forward, and the other of the user's feet can lead the other driving lever 1220 backward. Due to the limitation of the angle stretching backward of the user's feet, when the balancing angle is 45 degrees, the user can hold a straight posture to maximize the stretching of the feet as a high knee exercise.

Figure 26A:
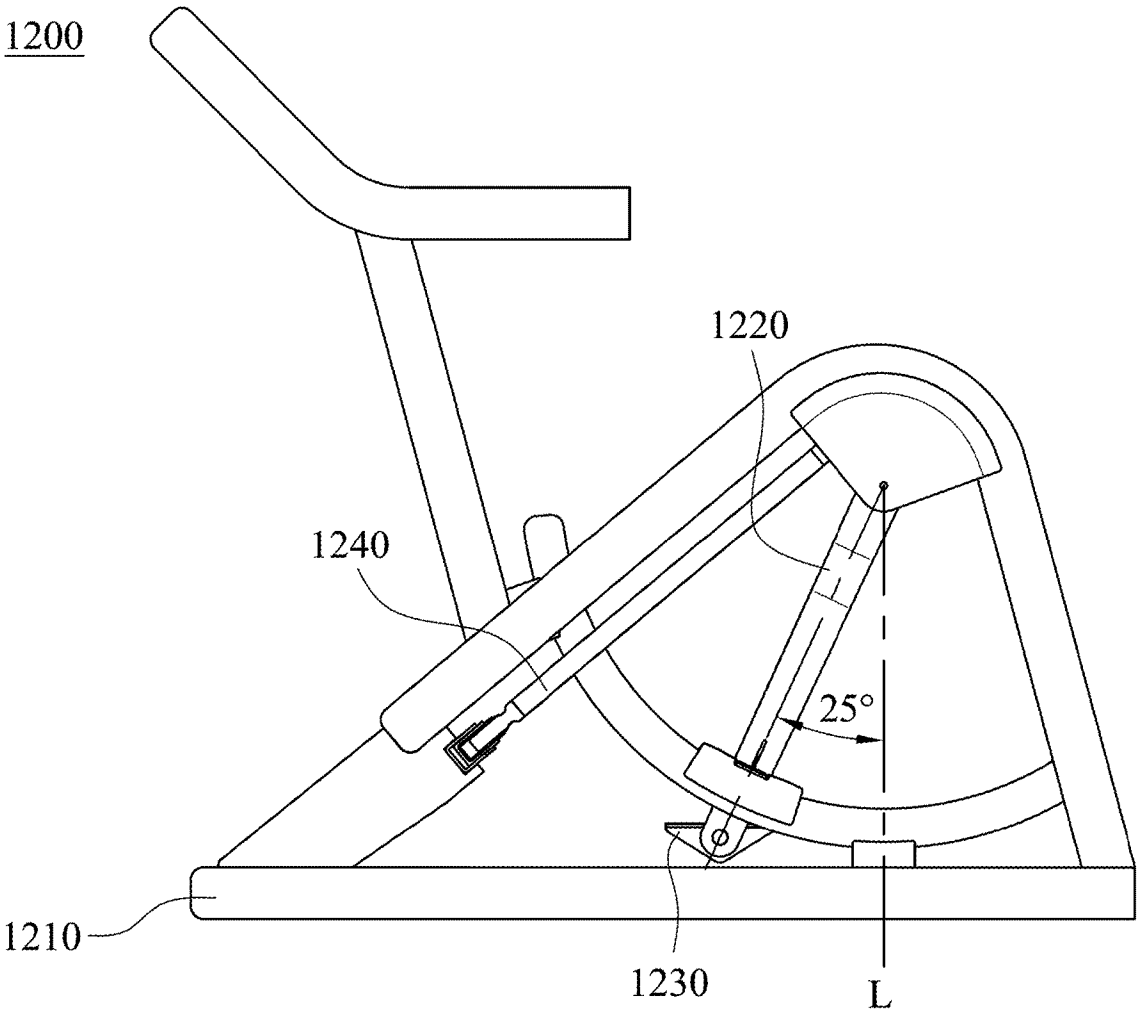
FIG. 26A is a schematic view of the exercise apparatus with the driving lever in a balancing angle 25 degrees according to another embodiment of the present disclosure.
Figure 26B:
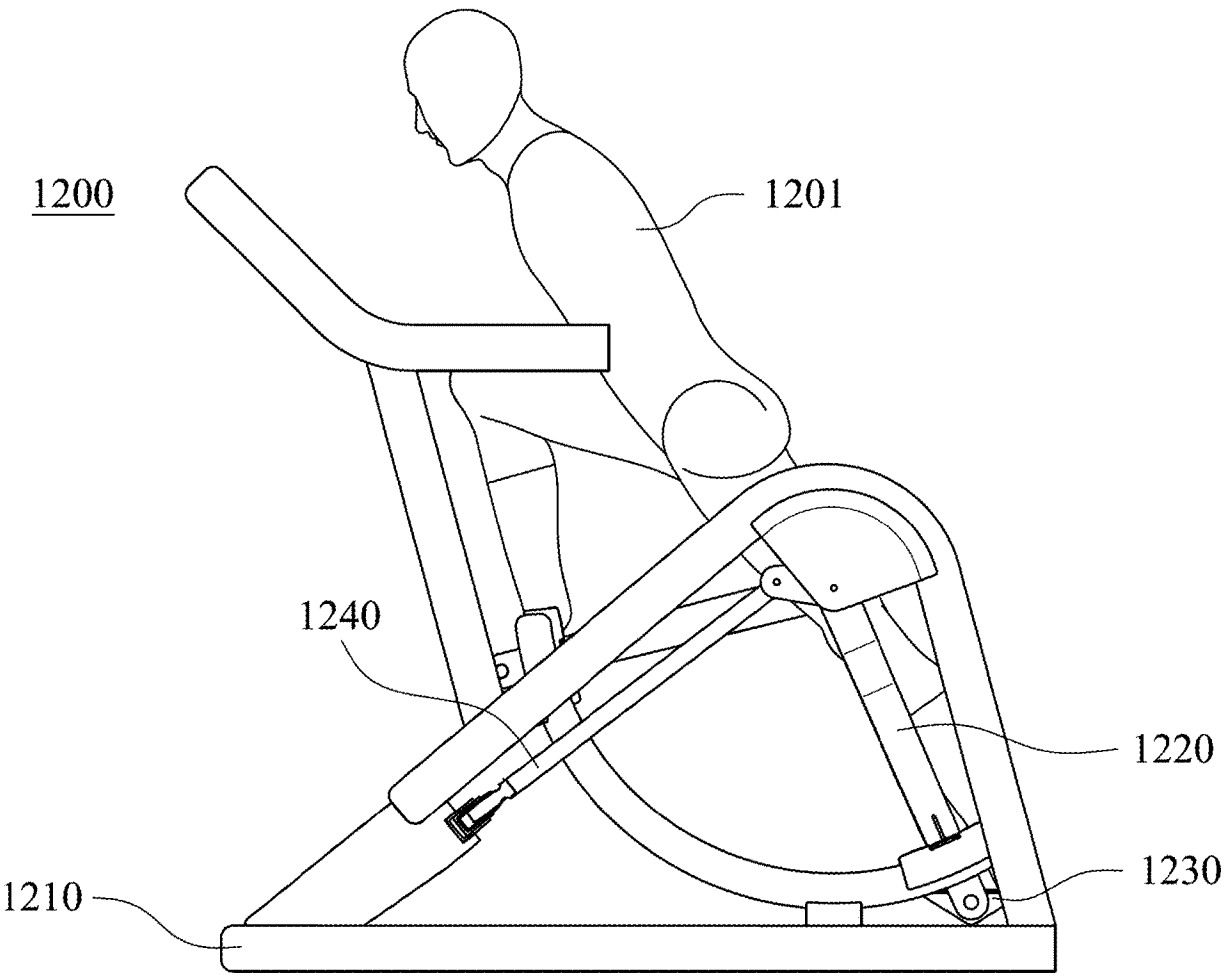
FIG. 26B is a schematic view of the exercise apparatus of FIG. 26A which is used by the user.

FIG. 26A is a schematic view of the exercise apparatus 1200 with the driving lever 1220 in a balancing angle 25 degrees according to another embodiment of the present disclosure. FIG. 26B is a schematic view of the exercise apparatus 1200 of FIG. 26A which is used by the user 1201. In FIG. 26A, when the exercise apparatus 1200 is in a static state, the two driving levers 1220 are parallel to each other and there is the balancing angle being 25 degrees between each of the driving levers 1220 and an virtual line L which is vertical to the ground. In FIG. 26B, after the user 1201 stands on the pedals 1230 at the balancing angle 25 degrees, one of the user's feet can rise one driving lever 1220 forward, and the other of the user's feet can lead the other driving lever 1220 backward. Due to the limitation of the angle stretching backward of the user's feet, when the balancing angle is 25 degrees and the user still holds a straight posture, the feet swings backward would limit the stretching of the other feet, and the user' body should be forward so as to perform high knee exercise. Therefore, when the balancing angle of the exercise apparatus 1200 is changed, the user should change the posture for performing the high knee exercise so as to train different portions of muscle.

Figure 27A:
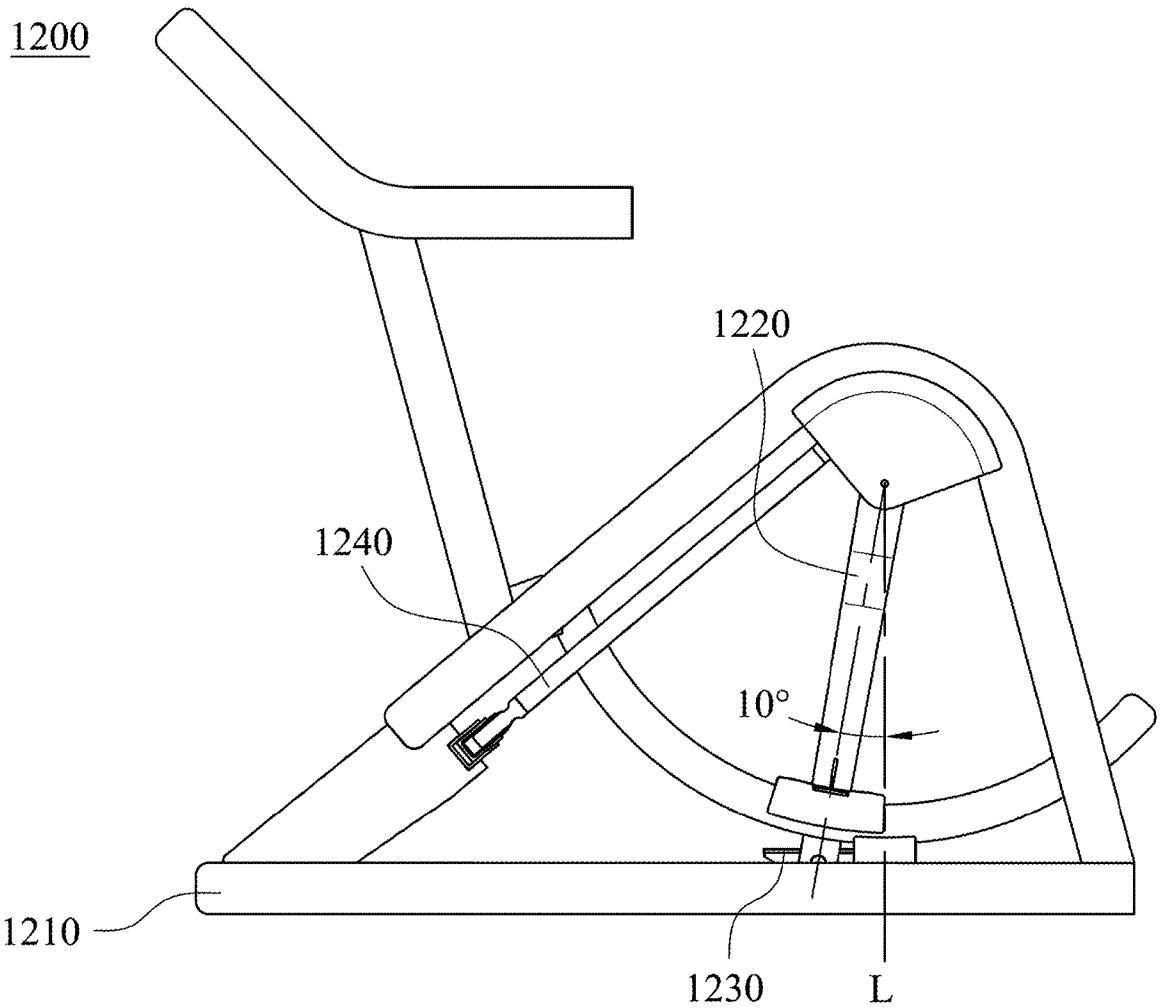
FIG. 27A is a schematic view of the exercise apparatus with the driving lever in a balancing angle 10 degrees according to another embodiment of the present disclosure.
Figure 27B:
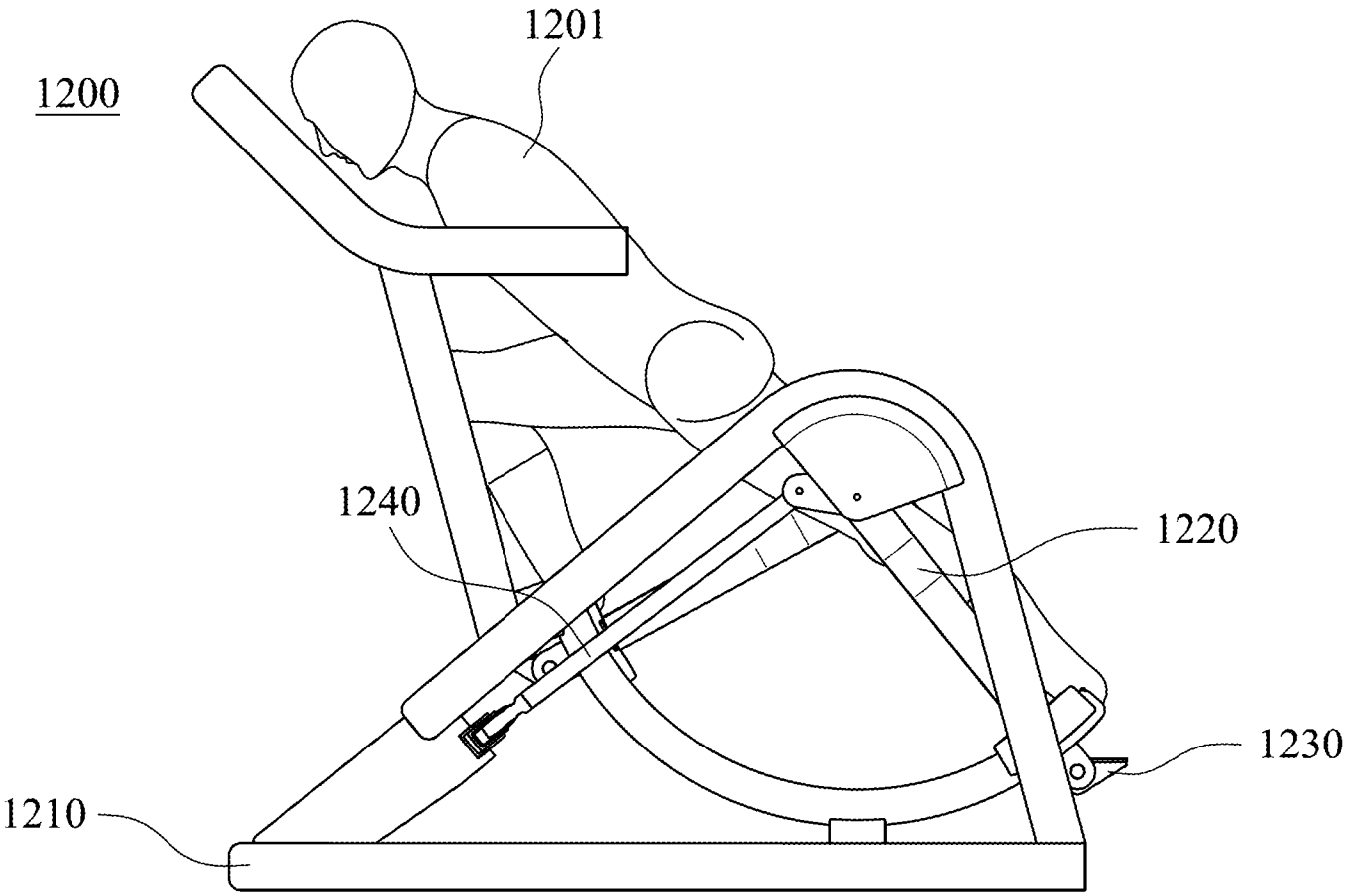
FIG. 27B is a schematic view of the exercise apparatus of FIG. 27A which is used by the user.

FIG. 27A is a schematic view of the exercise apparatus 1200 with the driving lever 1220 in a balancing angle 10 degrees according to another embodiment of the present disclosure. FIG. 27B is a schematic view of the exercise apparatus 1200 of FIG. 27A which is used by the user 1201. When the balancing angle is 10 degrees, the user' body should be further forward so as to perform high knee exercise, so that the different portion of muscles can be trained.

Figure 28A:
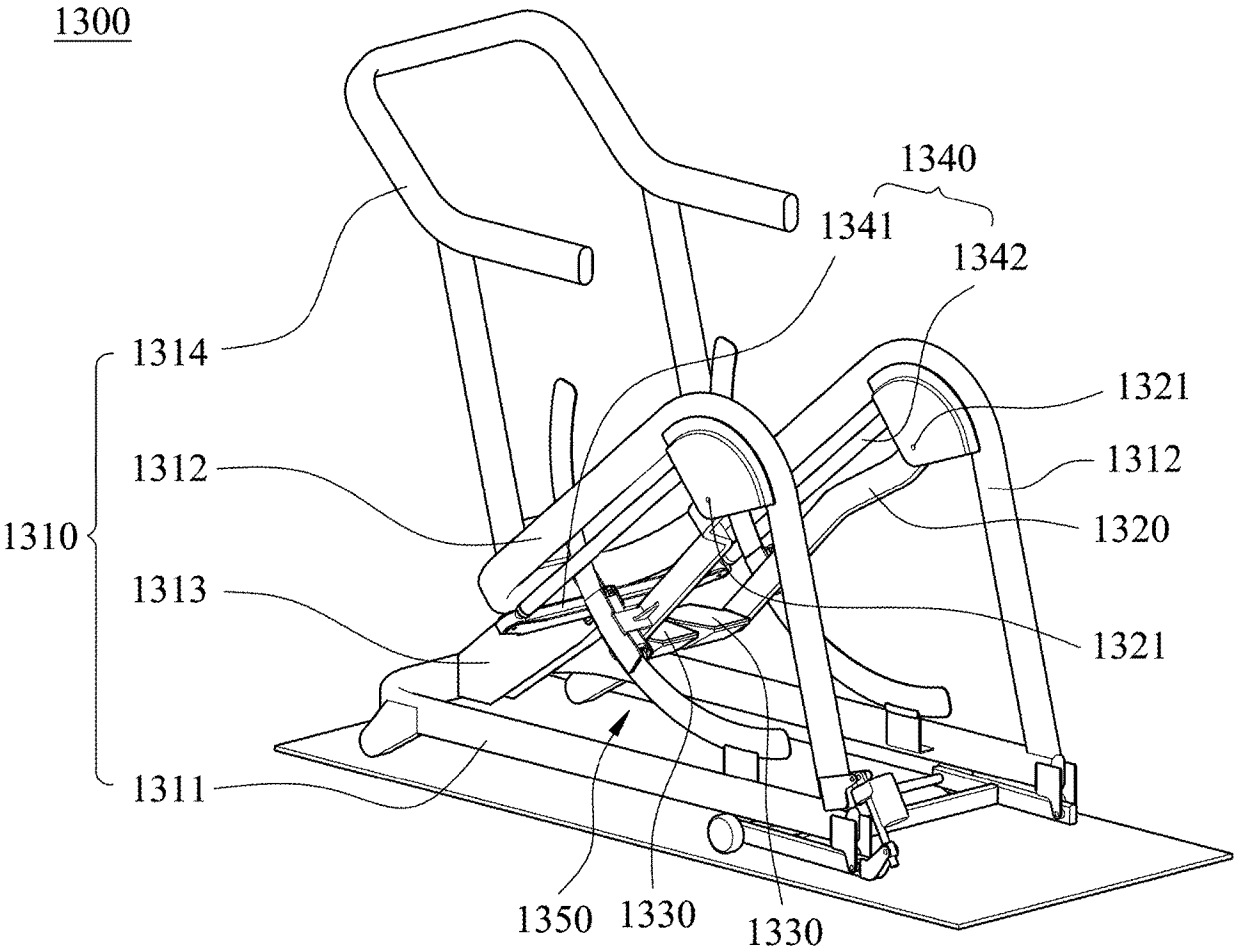
FIG. 28A is a three dimensional view of an exercise apparatus according to another embodiment of the present disclosure.

FIG. 28A is a three dimensional view of an exercise apparatus 1300 according to another embodiment of the present disclosure. In FIG. 28A, the exercise apparatus 1300 includes a frame body 1310, two driving levers 1320, two pedals 1330, a linking device 1340 and two resistance devices 1350. The two driving levers 1320 are pivotally connected to two side of the frame body 1310, respectively. The two pedals 1330 are connected to the two driving levers 1320, respectively. The linking device 1340 is connected the two driving levers 1320 so as to lead the two driving levers 1320 to be swung reciprocally and simultaneously. The resistance devices 1350 are driven by the two driving levers 1320 so as to generate a magnetic resistance, respectively. Therefore, the user can stand on the two pedals 1330 during operating the exercise apparatus 1300, and can reciprocally swing the two driving levers 1320 for exercising and training.

In detail, the frame body 1310 includes a bottom base 1311 and two side frames 1312, wherein the bottom base 1311 is for putting on the ground or a plane to be disposed, and the two side frames 1312 are connected to two side of the bottom base 1311 and extend uptoward, the two side frames 1312 are integrally formed. Moreover, the frame body 1310 can further include a front frame 1313 and a handle 1314. In FIG. 28A, the front frame 1313 is located on the front side of the exercise apparatus 1300 and connects the bottom base 1311 and the two side frames 1312. The handle 1314 is connected to the two side frames 1312 and extend toward the front of the exercise apparatus 1300. Therefore, the entire frame body 1310 is deemed as a frame, and the exercise apparatus 1300 is a frame like exercise apparatus.

The two driving levers 1320 are pivotally connected to the two side frames 1312, respectively, wherein each of the driving levers 1320 is pivotally connected to each of the two side frames 1312 via a pivoting axle 1321.

The two pedals 1330 are connected to the two driving levers 1320, respectively. Therefore, the user can stand thereon and swing the two driving levers 1320 for doing high knee exercise.

Figure 28B:
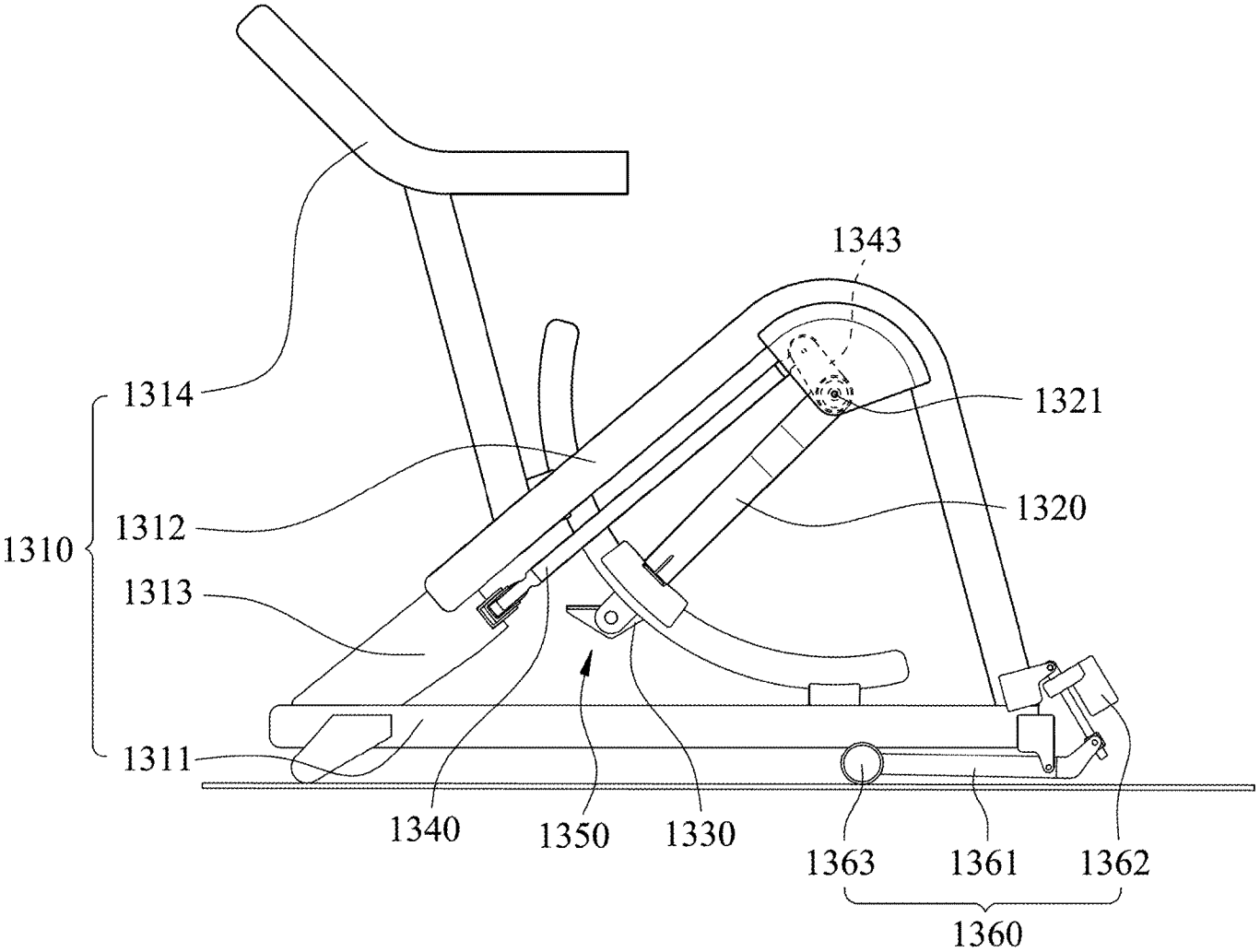
FIG. 28B is a side view of the exercise apparatus of FIG. 28A.

FIG. 28B is a side view of the exercise apparatus 1300 of FIG. 28A. In FIGS. 28A and 28B, the linking device 1340 is connected the two driving levers 1320 so as to lead the two driving levers 1320 to be swung reciprocally and simultaneously. In detail, according to the embodiment of FIG. 28A, the linking device 1340 includes a linking shaft 1341 and two side shafts 1342. The linking shaft 1341 is pivotally connected to the frame body 1310, specifically, the linking shaft 1341 is pivotally connected to the front frame 1313 of the frame body 1310 according to the embodiment of FIG. 28A. One end of each of the side shafts 1342 is pivotally connected to each of two ends of the linking shaft 1341, and the other end of each of the side shafts 1342 is linked with each of the two driving levers 1320, wherein each of the side shafts 1342 is linked with each of the two driving levers 1320 via an axle member 1343.

In FIG. 28A, the exercise apparatus 1300 includes two resistance devices 1350, wherein the resistance devices 1350 can be driven by the driving levers 1320 so as to generate the magnetic resistance. Each of the resistance devices 1350 is the same with the resistance device 1150 in FIGS. 21A, 21C and 21D, and will not describe again herein.

Figure 28C:
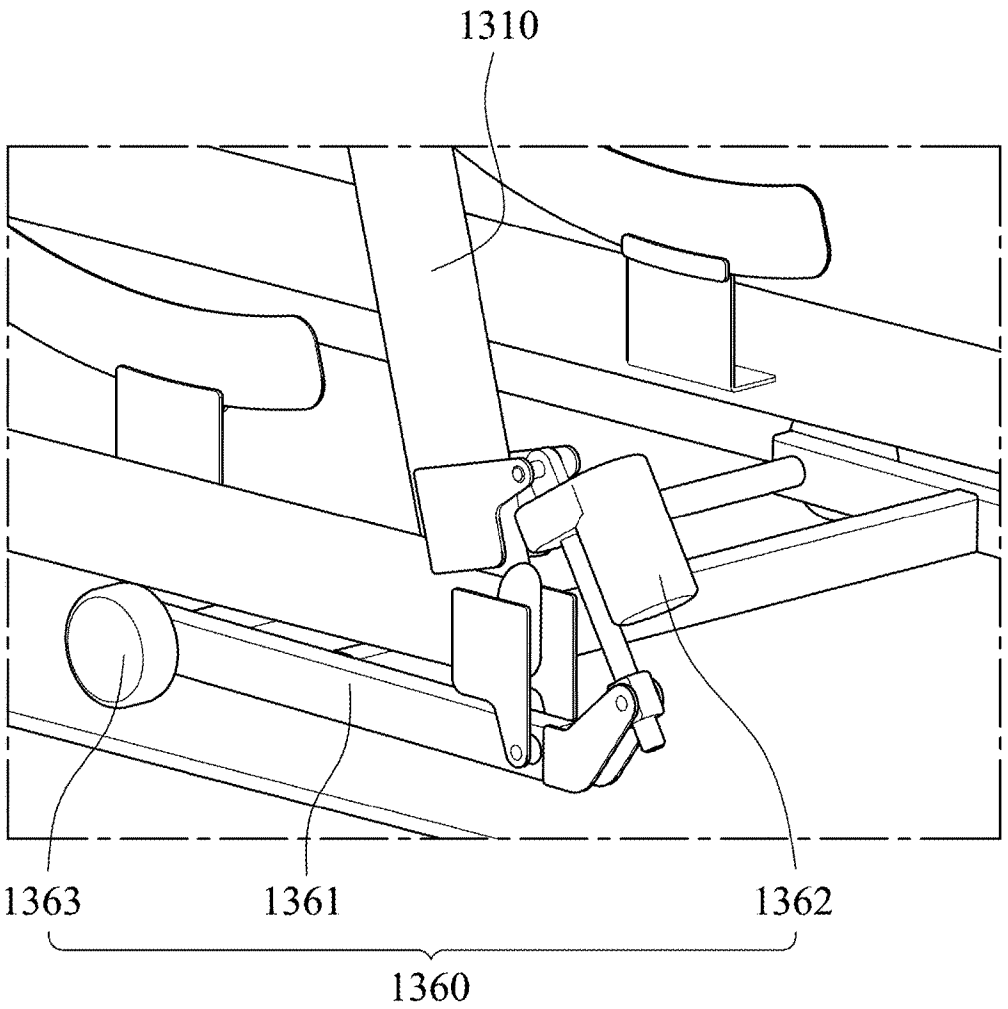
FIG. 28C is a schematic view of an angle adjusting mechanism of the exercise apparatus of FIG. 28A.

FIG. 28C is a schematic view of an angle adjusting mechanism 1360 of the exercise apparatus 1300 of FIG. 28A. The exercise apparatus 1300 further includes the angle adjusting mechanism 1360 for forming an angle between the bottom base 1311 and the ground. In detail, the angle adjusting mechanism 1360 includes a supporting base 1361 and a lifting mechanism 1362. The supporting base 1361 is pivotally connecting one side of the bottom base 1311 face to the ground. The lifting mechanism 1362 connects the supporting base 1361 and the bottom base 1311 so as to unfold the supporting base 1361 from the bottom base 1311. For enhancing the stability of the supporting base 1361 when the bottom base 1311 is lifted, two rollers 1363 is disposed on the supporting base 1361. The lifting mechanism 1362 can be an elevator motor. The elevator motor and the controlling way thereof is common knowledge in the art of the present disclosure which is the same with the embodiment of FIGS. 23A and 23B, and will not describe detailed herein.

Figure 28D:
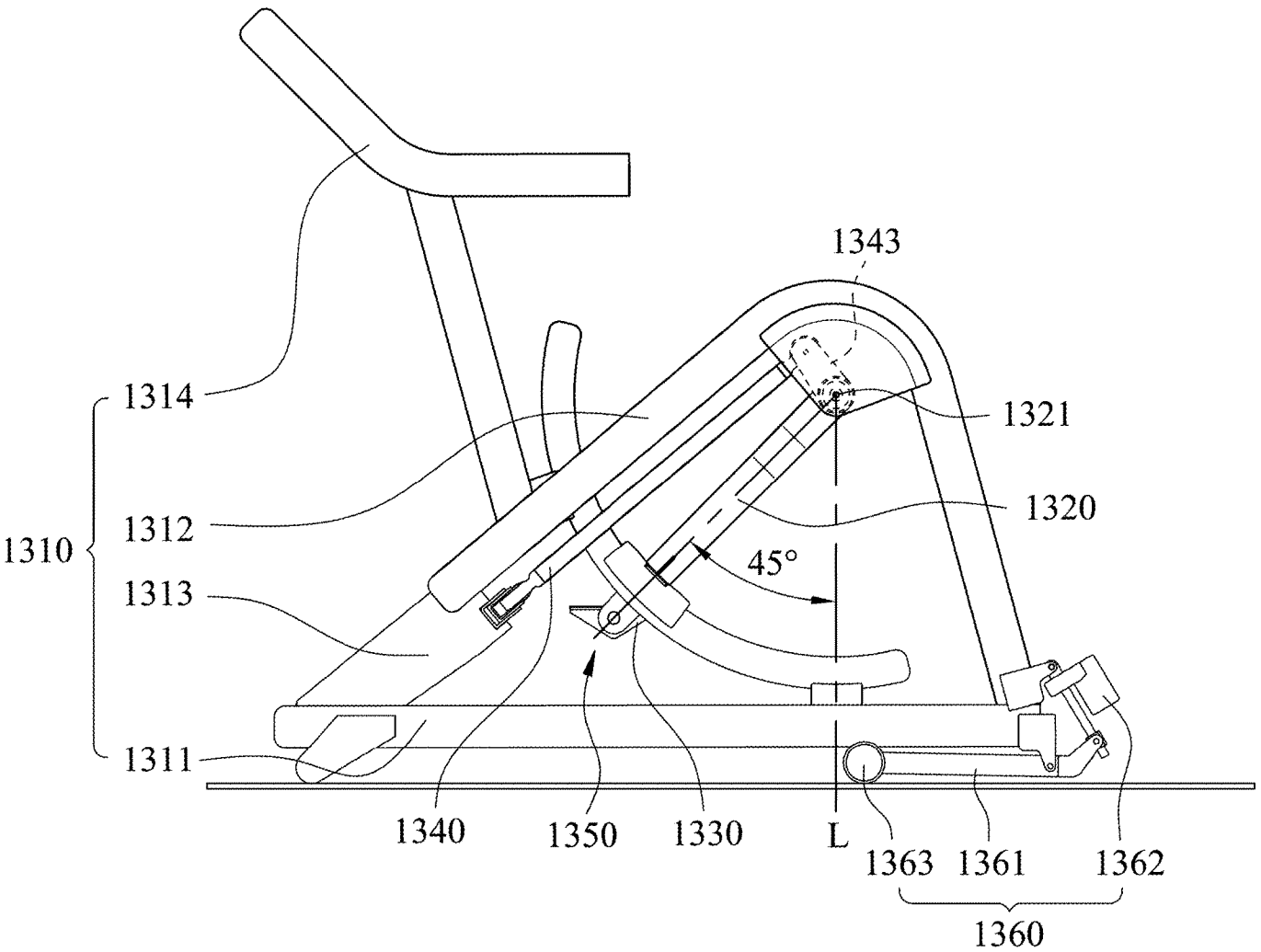
FIG. 28D is a schematic view of the exercise apparatus of FIG. 28A with the driving lever in a balancing angle 45 degrees.
Figure 28E:
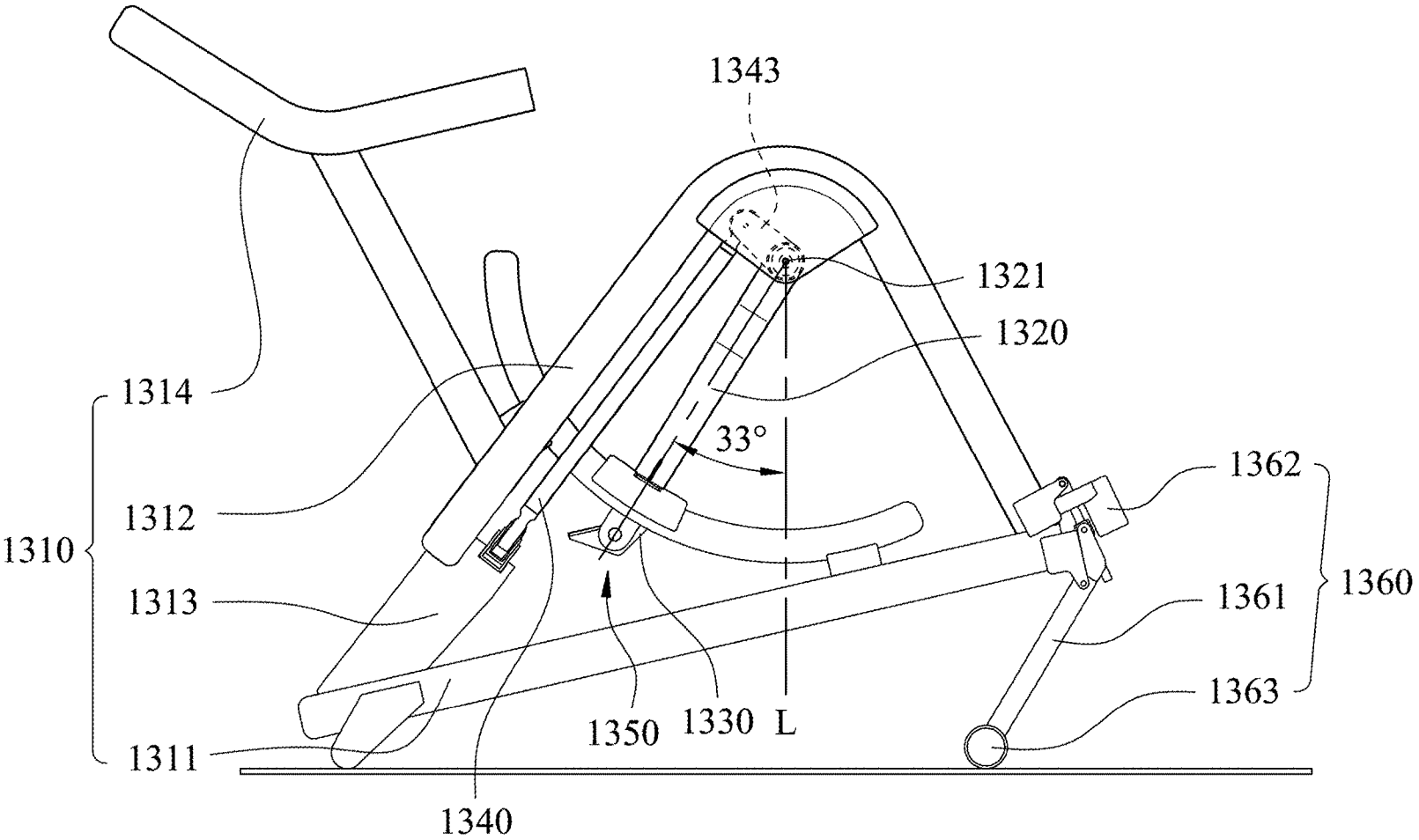
FIG. 28E is a schematic view of the exercise apparatus of FIG. 28A with the driving lever in a balancing angle 33 degrees.

FIG. 28D is a schematic view of the exercise apparatus 1300 of FIG. 28A with the driving lever 1320 in a balancing angle 45 degrees. FIG. 28E is a schematic view of the exercise apparatus 1300 of FIG. 28A with the driving lever 1320 in a balancing angle 33 degrees. In FIG. 28D, when the exercise apparatus 1300 is in a static state, the two driving levers 1320 are parallel to each other and there is the balancing angle being 45 degrees between each of the driving levers 1320 and an virtual line L which is vertical to the ground. According to the aforementioned description with FIGS. 25A and 25B, when the balancing angle is 45 degrees, the user can hold a straight posture to maximize the stretching of the feet as a high knee exercise. In FIG. 28E, when the angle adjusting mechanism 1360 lifts the bottom base 1311 from the ground and the the exercise apparatus 1300 is in a static state, the two driving levers 1320 are parallel to each other and there is the balancing angle being 33 degrees between each of the driving levers 1320 and an virtual line L which is vertical to the ground. Therefore, the user should adjusts the using posture for maximizing the stretching angle of feet.

Figure 29A:
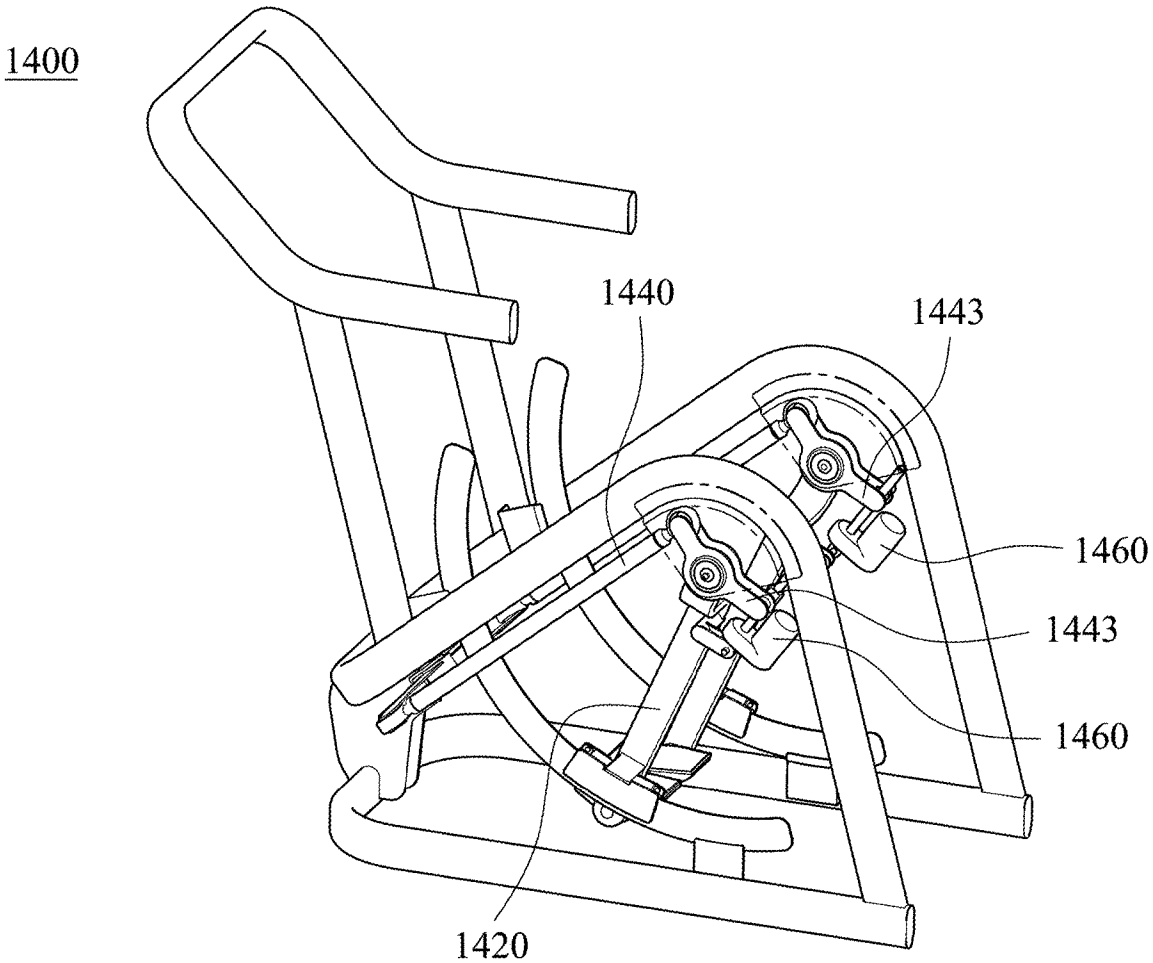
FIG. 29A is a three dimensional view of an exercise apparatus according another embodiment of the present disclosure.

FIG. 29A is a three dimensional view of an exercise apparatus 1400 according another embodiment of the present disclosure. The difference between the exercise apparatus 1400 in FIG. 29A and the exercise apparatus 1300 in FIG. 28A is the arrangement of an angle adjusting mechanism 1460 and the connecting way between a linking device 1440 and a driving lever 1420. The arrangements and the relationship of other elements are the same and will not describe herein.

Figure 29B:
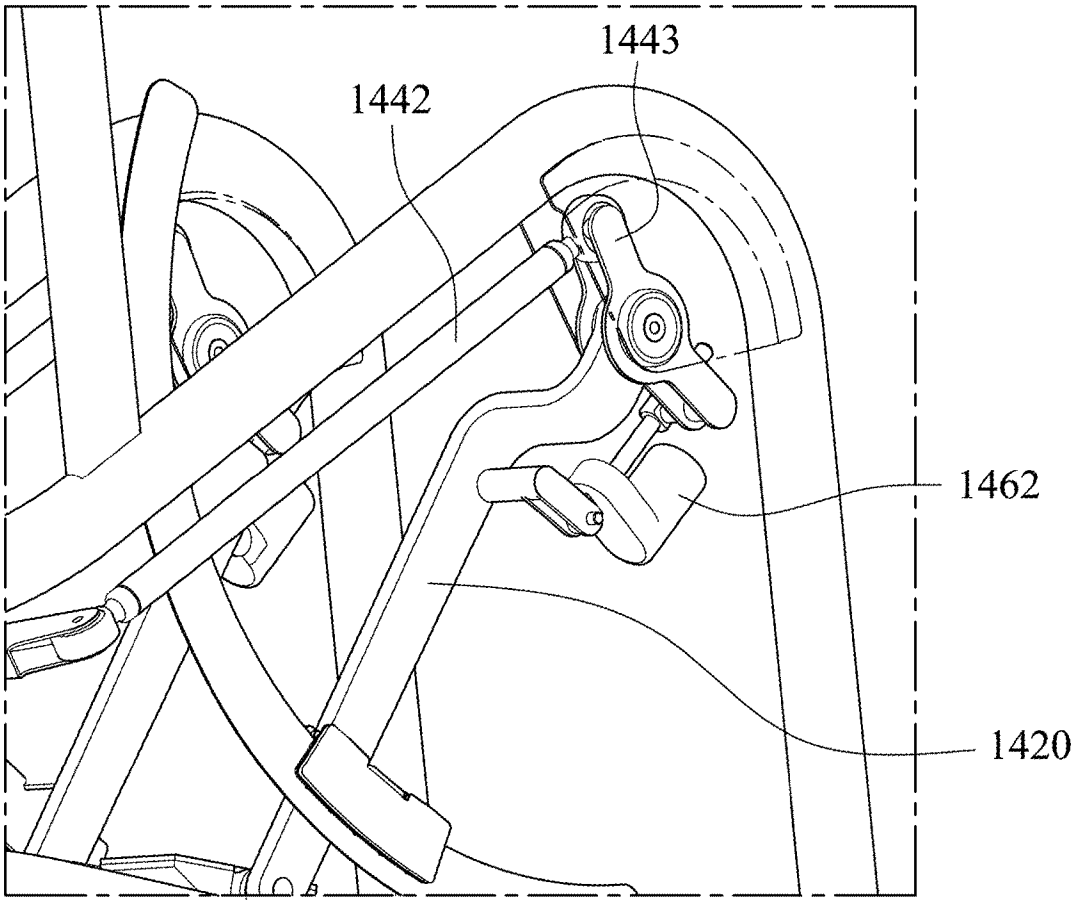
FIG. 29B is a schematic view of the angle adjusting mechanism of FIG. 29A.

FIG. 29B is a schematic view of the angle adjusting mechanism 1460 of FIG. 29A. In FIGS. 29A and 29B, the side shafts 1442 of the linking device 1440 is linked with the driving levers 1420 via the connecting members 1443. The angle adjusting mechanism 1460 includes two lifting mechanisms 1462, which are elevator motors. One end of each lifting mechanism 1462 is connected to the connecting member 1443, the other end of each lifting mechanism 1462 is connected to the driving lever 1420. The arrangement of the lifting mechanisms 1462 can adjust the balancing angle of the driving levers 1420. The elevator motor and the controlling way thereof is common knowledge in the art of the present disclosure, and will not describe detailed herein.

Figure 29C:
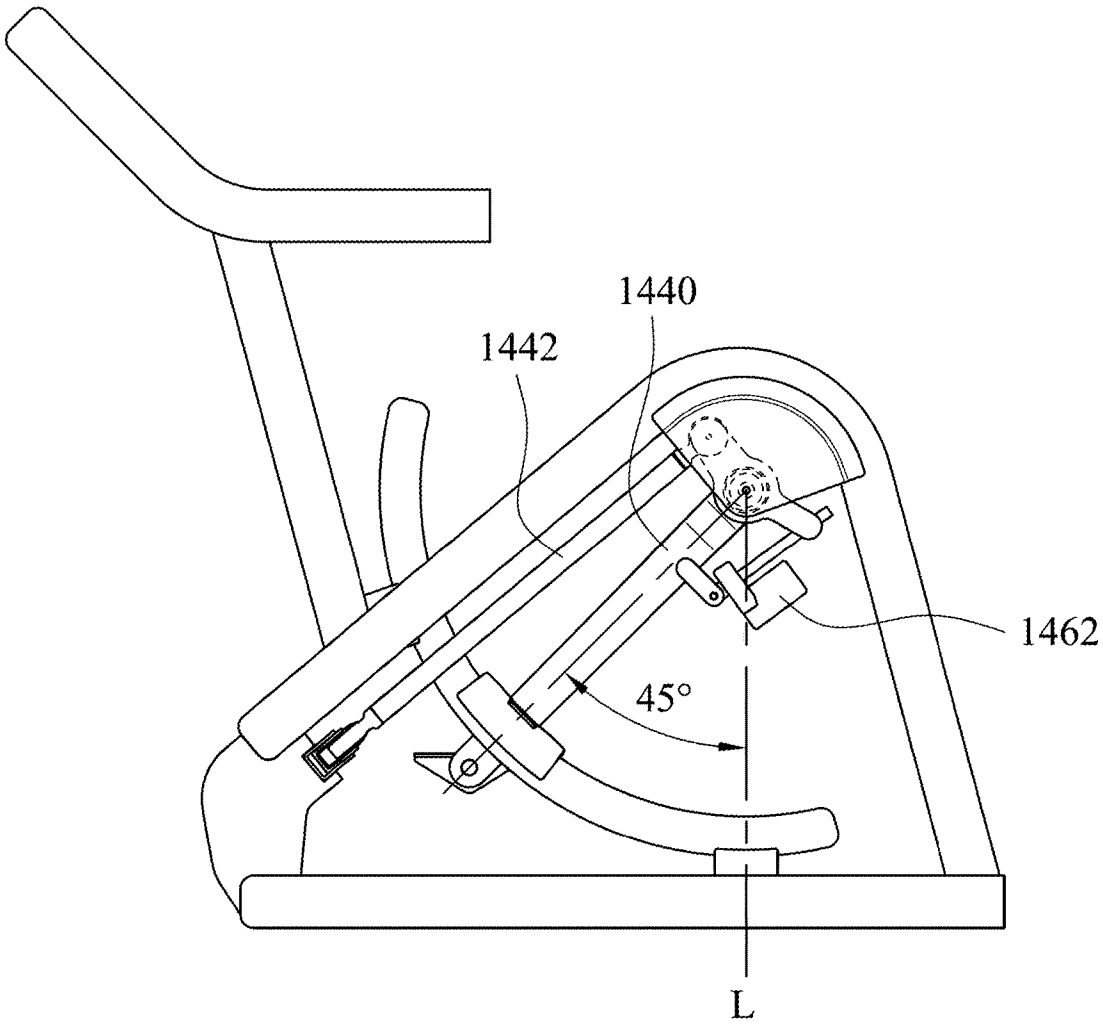
FIG. 29C is a schematic view of the exercise apparatus of FIG. 29A with the driving lever in a balancing angle 45 degrees.
Figure 29D:
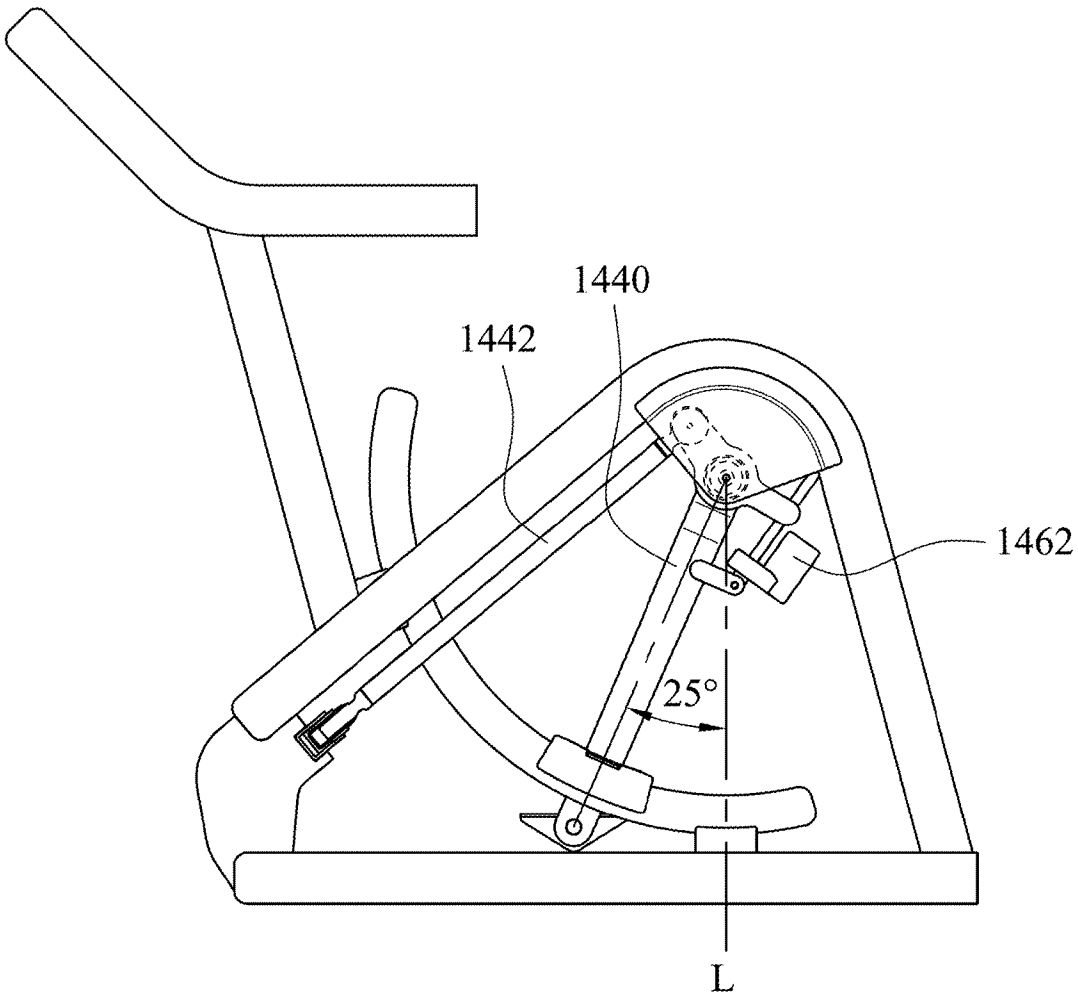
FIG. 29D is a schematic view of the exercise apparatus of FIG. 29A with the driving lever in a balancing angle 24 degrees.

FIG. 29C is a schematic view of the exercise apparatus 1400 of FIG. 29A with the driving lever 1420 in a balancing angle 45 degrees. FIG. 29D is a schematic view of the exercise apparatus 1400 of FIG. 29A with the driving lever 1420 in a balancing angle 24 degrees. When the lifting mechanisms 1462 of the angle adjusting mechanism 1460 is not activated, the two driving levers 1420 are parallel to each other and there is the balancing angle being 45 degrees between each of the driving levers 1420 and a virtual line L which is vertical to the ground. When the lifting mechanisms 1462 of the angle adjusting mechanism 1460 is activated, the two driving levers 1420 are parallel to each other and there is the balancing angle being 24 degrees between each of the driving levers 1420 and the virtual line L which is vertical to the ground. Therefore, the exercise apparatus 1400 can provide various exercise modes for training different portions of muscle.

Moreover, according to other embodiment of the present disclosure, the balancing angle can also be adjusted by adjusting the arrangement of the linking device so as to link up the driving levers. The arrangement of the linking device also can be adjusted by the angle adjusting mechanism, and will not be stated again herein.

By such arrangement, the high knees exercise apparatus would not provide inertia during working, so that the security of the high knees exercise apparatus is enhanced.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An exercise apparatus, comprising:

a frame body, comprising:

a bottom base; and two side frames connected to the bottom base;

two driving levers pivotally connected to the two side frames, respectively, wherein each of the driving levers is pivotally connected to each of the two side frames via a pivoting axle;

two pedals connected to the two driving levers, respectively;

a linking device connected the two driving levers so as to lead the two driving levers to be swung reciprocally and simultaneously;

at least one resistance device driven by one of the two driving levers so as to generate a magnetic resistance, the resistance device comprising:

a magnet base connected to the one of the two driving levers;

a first magnetic resistance element disposed on the magnet base; and a second magnetic resistance element disposed on the frame body and adjacent to the first magnetic resistance element, wherein at least one of the first magnetic resistance element and the second magnetic resistance element is at least one magnet, and the other one of the first magnetic resistance element and the second magnetic resistance element is made of copper, silver, aluminum or alloys thereof, the magnet base is driven by the driving lever so as to move the first magnetic resistance element relative to the second magnetic resistance element for generating the magnetic resistance;

wherein a central distance between the pivoting axle of each of the driving lever and the pedal connected the driving lever is R, a central distance between the pivoting axle of the driving lever which is connected to the magnet base and the resistance device is r, and the following relationship is satisfied:

$$r \geq 0.5\ R.$$

2. The exercise apparatus of claim 1, wherein a number of the resistance device is two, and each of the two resistance devices is driven by each of the two driving levers.

3. The exercise apparatus of claim 1, wherein the magnet is a permanent magnet.

4. The exercise apparatus of claim 1, wherein the following relationship is satisfied:

$$r \geq 0.8\ R.$$

5. The exercise apparatus of claim 4, wherein the following relationship is satisfied:

$$r \geq R.$$

6. The exercise apparatus of claim 1, wherein the resistance device further comprises a friction matrix disposed between the first magnetic resistance element and the second magnetic resistance element.

7. The exercise apparatus of claim 1, further comprising:

two pedal adjusting mechanisms, each of the two pedal adjusting mechanisms for adjusting a location of each of the two pedals on each of the driving levers, wherein each of the two pedal adjusting mechanisms comprises:

a track disposed on one of the driving levers along an axial direction thereof;

a linkage member connected to one of the pedals and for leading the one of the pedals to move along the track;

a plurality of positioning concaves disposed on the one of the driving levers along the axial direction thereof; and a positioning protrusion disposed on the linkage member for positioning in one of the positioning concaves.

8. The exercise apparatus of claim 1, further comprising:

an angle adjusting mechanism for forming an angle between the bottom base and a ground, wherein the angle adjusting mechanism comprises:

a supporting base pivotally connecting one side of the bottom base face to the ground; and a lifting mechanism connecting the supporting base and the bottom base so as to unfold the supporting base from the bottom base.

9. The exercise apparatus of claim 1, wherein the linking device comprises:

a linking shaft pivotally connected to the frame body; and two side shafts, one end of each of the side shafts pivotally connected to each of two ends of the linking shaft, the other end of each of the side shafts linked with each of the two driving levers.

10. The exercise apparatus of claim 1, wherein the first magnetic resistance element is a plurality of the magnet, the magnets are disposed on two inner sides of the magnet base, a distance between each two magnets disposed relative to each other is greater or equal to 4 mm.

11. The exercise apparatus of claim 1, further comprising:

an angle adjusting mechanism for adjusting a balancing angle between each of the driving levers and an virtual line which is vertical to a ground.

* * * * *